US011596855B2

(12) United States Patent
Pantazelos et al.

(10) Patent No.: US 11,596,855 B2
(45) Date of Patent: Mar. 7, 2023

(54) SENSOR-CONNECTED PROCESSOR-CONTROLLED SNOW SPORT BOOT BINDING

(71) Applicant: Stop River Development LLC, Park City, UT (US)

(72) Inventors: George Pantazelos, Park City, UT (US); Joseph K. Lane, Branford, CT (US); Michael Ryan Cameron, Millis, MA (US)

(73) Assignee: Stop River Development LLC, Park City, UT (US)

( * ) Notice: Subject to any disclaimer, the term of this patent is extended or adjusted under 35 U.S.C. 154(b) by 0 days.

(21) Appl. No.: 17/345,198

(22) Filed: Jun. 11, 2021

(65) Prior Publication Data

US 2021/0299548 A1 Sep. 30, 2021

Related U.S. Application Data

(60) Continuation of application No. 16/656,938, filed on Oct. 18, 2019, now Pat. No. 11,110,337, which is a (Continued)

(51) Int. Cl.
*A63C 7/10* (2006.01)
*A63C 5/00* (2006.01)

(Continued)

(52) U.S. Cl.
CPC ..... *A63C 7/102* (2013.01); *A43B 5/0421* (2013.01); *A63C 5/003* (2013.01); *A63C 9/0802* (2013.01);

(Continued)

(58) Field of Classification Search
CPC ... A43B 5/0421; A43B 5/0423; A63C 9/0802; A63C 9/086; A63C 9/088
See application file for complete search history.

(56) References Cited

U.S. PATENT DOCUMENTS 3,165,328 A 1/1965 Franklin
3,251,607 A 5/1966 Wren (Continued)

FOREIGN PATENT DOCUMENTS

CN 1736515 A 2/2006
CN 206636380 U 11/2017

(Continued)

OTHER PUBLICATIONS

Wunderly, G. et al.,"A New Electromechanical Binding/Dynamometer for Actively Controlled Snow Ski Binding Systems", Skiing Trauma and Safety, 1987, pp. 249-259, Sixth International Symposium, ASTM STP 938, American Society for Testing and Materials, Philadelphia.

(Continued)

*Primary Examiner* — Brian L Swenson
(74) *Attorney, Agent, or Firm* — Intrinsic Law Corp.

(57) ABSTRACT

Some aspects include a ski binding system using controllable electromagnets, alone or in combination with permanent magnets, as means of attaching or releasing a ski boot to a ski during use. Some aspects include a ski binding system using a controllable solenoid. In some aspects, microprocessor-based control releases binding electronically based on input from sensors located in binding, ski and/or boot, as well as in other equipment or clothing connected to them or to skier, or binding releases when a mechanical threshold is overcome. In some aspects, sensor data are recorded for analysis of system performance and for adjustment and improvement of system parameters based on data analytics.

19 Claims, 71 Drawing Sheets

Related U.S. Application Data division of application No. 15/921,068, filed on Mar. 14, 2018, now Pat. No. 10,569,155.

(60) Provisional application No. 62/559,174, filed on Sep. 15, 2017, provisional application No. 62/471,230, filed on Mar. 14, 2017.

(51) Int. Cl.

| | |
|---|---|
| ***H01F 7/06*** | (2006.01) |
| ***A43B 5/04*** | (2006.01) |
| ***A63C 9/08*** | (2012.01) |
| ***H01F 7/20*** | (2006.01) |
| ***A63C 9/086*** | (2012.01) |
| ***A63C 9/088*** | (2012.01) |

(52) U.S. Cl.

CPC ..... *A63C 9/086* (2013.01); *A63C 9/088* (2013.01); *H01F 7/064* (2013.01); *H01F 7/20* (2013.01)

(56) References Cited

U.S. PATENT DOCUMENTS

| | | | | |
|---|---|---|---|---|
| 3,318,610 | A | 5/1967 | Kulick | |
| 3,606,370 | A | 9/1971 | Spademan | |
| 3,671,054 | A | 6/1972 | Mittelstadt | |
| 3,960,383 | A | 6/1976 | O'Neil | |
| 4,063,752 | A | 12/1977 | Whitaker et al. | |
| 4,130,296 | A | 12/1978 | D'Antonio et al. | |
| 4,270,770 | A | 6/1981 | Spademan | |
| 4,291,894 | A | 9/1981 | D'Antonio et al. | |
| 4,360,218 | A | 11/1982 | Spademan | |
| 4,385,773 | A * | 5/1983 | Scheck | A63C 9/088 280/612 |
| 4,415,176 | A | 11/1983 | Hull et al. | |
| 4,436,321 | A | 3/1984 | Storandt et al. | |
| 4,492,387 | A | 1/1985 | Spademan | |
| 4,522,423 | A | 6/1985 | Haldemann et al. | |
| 4,536,006 | A | 8/1985 | Haldemann et al. | |
| 4,600,214 | A | 7/1986 | Spademan | |
| 4,640,026 | A | 2/1987 | Kirsch | |
| 4,657,277 | A | 4/1987 | Haldemann et al. | |
| 4,735,845 | A | 4/1988 | Haldemann et al. | |
| 5,755,046 | A | 5/1998 | Dodge | |
| 6,007,086 | A | 12/1999 | Hopkins | |
| 6,095,547 | A | 8/2000 | Vandergrift et al. | |
| 6,338,497 | B1 | 1/2002 | Chevalier et al. | |
| 6,742,801 | B1 | 6/2004 | Dodge | |
| 6,769,711 | B1 | 8/2004 | Martin et al. | |
| 7,063,345 | B2 * | 6/2006 | Holzer | A63C 9/088 280/611 |
| 7,837,218 | B2 | 11/2010 | Flaig | |
| 7,841,614 | B2 | 11/2010 | Saloman | |
| 8,439,389 | B2 | 5/2013 | Moore et al. | |
| 8,990,048 | B2 | 3/2015 | Czaja et al. | |
| 9,545,972 | B2 | 1/2017 | Williams | |
| 10,780,340 | B2 | 9/2020 | Carrodine | |
| 2003/0094788 | A1 | 5/2003 | Jacobs | |
| 2006/0107827 | A1 | 5/2006 | Richards | |
| 2009/0212534 | A1 | 8/2009 | Mercat et al. | |
| 2011/0057420 | A1 | 3/2011 | Walker | |
| 2016/0178337 | A1 | 6/2016 | Graber | |
| 2017/0080325 | A1 | 3/2017 | Barden et al. | |
| 2018/0264349 | A1 | 9/2018 | Aanes et al. | |

FOREIGN PATENT DOCUMENTS

| | | | |
|---|---|---|---|
| DE | 4446260 | A1 | 8/1995 |
| DE | 10309388 | A1 | 9/2004 |
| DE | 102007001599 | A1 | 7/2007 |
| ES | 2341826 | B1 | 5/2011 |
| FR | 2348719 | A1 | 11/1977 |
| IT | 1044301 | B | 10/1975 |
| SI | 24286 | A | 8/2014 |
| WO | 8203183 | A1 | 9/1982 |
| WO | 0205909 | A1 | 1/2002 |
| WO | 2019010739 | A1 | 1/2019 |

OTHER PUBLICATIONS

Neptune, R.R. et al., "A New Electromechanical Ski Binding with Release Sensitivity to Torsion and Bending Moments Transmitted by the Leg", Skiing Trauma and Safety, 1996, pp. 339-353, vol. 10, ASTM STP 1266, American Society for Testing and Materials.

Hull, M.L., "A Survey of Actively Controlled (Electronic) Snow Ski Bindings", Skiing Trauma and Safety, 1985, pp. 238-257, Fifth International Symposium, ASTM STP 860, American Society for Testing and Materials, Philadelphia.

Eseltine, K. et al., "An Alpine Ski Binding with Electrically Modulated Twist Release", Skiing Trauma and Safety, 1993, pp. 200-212, Ninth International Symposium, ASTM STP 1182, American Society for Testing and Materials, Philadelphia.

Wunderly, G. et al., "A Mechanical Alpine Ski Binding with Programmable Release", Skiing Trauma and Safety, 1989, pp. 199-209, Seventh International Symposium, ASTM STP 1022, American Society for Testing and Materials, Philadelphia.

Wunderly, G. et al.,"Measurement of Boot Loads Using a Second-Generation Microcomputer-Controlled Snow Ski Binding System", Skiing Trauma and Safety, 1989, pp. 181-198, Seventh International Symposium, ASTM STP 1022, American Society for Testing and Materials, Philadelphia.

Hull, M.L. et al., "Electromechanical Ski Release Binding with Mechanical Backup," Skiing Trauma and Safety, 1997, pp. 81-92, vol. 11, ASTM STP 1289, American Society for Testing and Materials.

Caldwell, B. et al., "A New Mechanical Ski Binding with Heel Release Activated by the Bending Moment at the Boot Sole", Skiing Trauma and Safety, 1993, pp. 189-199, Ninth International Symposium, ASTM STP 1182, American Society for Testing and Materials, Philadelphia.

Macgregor, D. et al., "Field Testing of a Microcomputer-Controlled Snow Ski Binding System", Skiing Trauma and Safety, 1985, pp. 258-281, Fifth International Symposium, ASTM STP 860, American Society for Testing and Materials, Philadelphia.

Shealy, J.E. et al., "What Do We Know About Ski Injury Research that Relates Binding Function to Knee and Lower Leg Injuries?", Skiing Trauma and Safety, 2003, pp. 36-52, vol. 14, ASTM STP 1440, ASTM International, West Conshohocken, PA.

Ettlinger, C.F. et al., "Where Do We Go From Here?", Skiing Trauma and Safety, 2003, pp. 53-63, vol. 14, ASTM STP 1440, ASTM International, West Conshohocken, PA.

Gulick, D.W. et al., "Design of a Learning Binding for Alpine Skiing", Skiing Trauma and Safety, 2000, pp. 30-49, vol. 13, ASTM STP 1397, American Society for Testing and Materials, West Conshohocken, PA.

Crawford, R.P. et al., "Fuzzy Logic Control of Bioadaptive Ski Binding Release", Skiing Trauma and Safety, 1995, pp. 323-338, vol. 10, ASTM STP 1266, American Society for Testing and Materials, Philadelphia.

Goodwin, D.A. et al., "Variable Influence in On-Snow Ski Boot Pressure Measurements", Skiing Trauma and Safety, 2000, pp. 50-67, vol. 13, ASTM STP 1397, American Society for Testing and Materials, West Conshohocken, PA.

ISA, "International Search Report", PCT/US2018/022421, dated May 29, 2018.

CNIPA, "Office Action", CN Application No. 201880029918.5, dated Jul. 12, 2021.

Extended European Search Report, (EESR) for EP Application No. 20762260.6, dated Apr. 19, 2022.

* cited by examiner

SECTION A-A

SENSOR-CONNECTED PROCESSOR-CONTROLLED SNOW SPORT BOOT BINDING

RELATED APPLICATIONS

This application is a continuation of U.S. application Ser. No. 16/656,938, filed on Oct. 18, 2019 and entitled "Processor-Controlled Snow Sport Boot Binding", which is a divisional of U.S. application Ser. No. 15/921,068 (now U.S. Pat. No. 10,569,155), filed on Mar. 14, 2018 and entitled "Processor-Controlled Snow Sport Boot Binding", which claims benefit of and priority to U.S. Provisional Application No. 62/471,230, filed on Mar. 14, 2017, entitled "Electromagnetic Ski Binding System with Microprocessor Control" and U.S. Provisional Application No. 62/559,174, filed on Sep. 15, 2017, entitled "Electromagnetic Ski Binding System with Microprocessor Control". This application is also related to U.S. application Ser. No. 16/298,623 (now U.S. Pat. No. 11,040,267) filed on Mar. 11, 2019 and entitled "Processor-Controlled Sport Boot Binding". These applications are incorporated by reference herewith in their entirety.

TECHNICAL FIELD

The present disclosure is generally directed to ski and binding systems and methods.

BACKGROUND

Ski binding systems are used to attach a boot to a ski. Ideally, the binding system keeps boot securely attached to the ski during normal use, but releases the boot from the ski during a fall or other mishap in order to prevent the ski from exerting undue torque, tension or force on the skier's leg and thereby causing injury. Present day ski binding systems in mass production use mechanical means, e.g. spring-loaded clamps, to affix the boot to the ski during use and release the boot. Such mechanical means are affixed permanently to the top of the ski, and are designed to mechanically couple with the boots with which they are used. However, existing ski binding systems do not always release when appropriate to prevent injury, and sometimes release at inappropriate times, in particular when the ski flexes during use. Thus, there is a need for improved binding systems.

SUMMARY

Some aspects and/or embodiments thereof disclosed herein are directed to a system, apparatus and/or method that use a controllable solenoid in releasably retaining a boot to a ski.

In some aspects, an apparatus for use in releasably retaining a boot plate to a ski comprises: a binding plate attachable to the ski and having a surface to receive the boot plate; a first clamp rotatably coupled to the binding plate; a second clamp spaced laterally from the first clamp and rotatably coupled to the binding plate, wherein the first and second clamps have a first position in which the first and second clamps releasably retain the boot plate to the binding plate, and wherein the first and second clamps have a second position in which the first and second clamps release the boot plate; a solenoid defining a channel and controllable to provide a first state and a second state; a plunger having a first end slidably received within the channel, the plunger having a first plunger position associated with the first state of the solenoid and a second plunger position associated with the second state of the solenoid; and mechanical linkage disposed at least in part between the plunger and the first and second clamps and movably coupled to the binding plate to cause the first and second clamps to rotate toward their second position if the plunger moves from the first plunger position to the second plunger position.

In at least some embodiments, the apparatus further comprises a control system coupled to the solenoid.

In at least some embodiments the mechanical linkage comprises: a slide disposed at least in part between the first and second clamps and slidably coupled to the binding plate, wherein the slide has a first slide position and a second slide position that is forward of the first slide position and in which the slide applies force to the first and second clamps to force the first and second clamps toward their second position; a lever pivotably coupled to the binding plate, the lever having a first lever position and a second lever position and biased toward the second lever position; and a link pivotably coupled between the slide and the lever; wherein with the lever in the first lever position and the plunger in the first plunger position, the plunger prevents the lever from pivoting from the first lever position to the second lever position, and wherein with the plunger in the second plunger position the plunger does not prevent the lever from pivoting from the first lever position to the second lever position.

In at least some embodiments the mechanical linkage comprises: a first motion converter coupled to the first clamp; a second motion converter coupled to the second clamp; a first link coupled to the first cam; a second link coupled to the second cam; and a coupler coupled between the plunger and the first link and coupled between the plunger and the second link.

In at least some embodiments, the first motion converter comprises a first cam; and the second motion converter comprises a second cam.

In some aspects, apparatus for use in releasably retaining a boot plate to a ski comprises: a binding plate attachable to the ski and having a surface to receive the boot plate; a first clamp having a first jaw and a first arm coupled thereto; a second clamp having a second jaw and a second arm coupled thereto, wherein the first and second arms are laterally spaced from one another and pivotably coupled to the binding plate, wherein the first and second arms have a first position in which the first and second jaws have a first lateral spacing and releasably retain the boot plate to the binding plate, and wherein the first and second arms have a second position in which the first and second jaws have a second lateral spacing greater than the first lateral spacing and are spaced apart from the boot plate; a slide disposed at least in part between the first and second arms and slidably coupled to the binding plate, wherein the slide has a first slide position and a second slide position that is forward of the first slide position and in which the slide applies force to the first and second arms to force the first and second arms toward their second position; a lever pivotably coupled to the binding plate, the lever having a first lever position and a second lever position and biased toward the second lever position, the lever having a portion displaced forward if the lever pivots from the first lever position to the second lever position; a link pivotably coupled between the lever and the portion of the lever that is displaced forward if the lever pivots from the first lever position to the second lever position such that the slide is pulled toward the second slide position that is forward of the first slide position if the lever pivots from the first lever position to the second lever position; a solenoid defining a channel and controllable to provide a first state and a second state; and a plunger having a first end slidably received within the channel, the plunger having a first plunger position associated with the first state of the solenoid and a second plunger position associated with the second state of the solenoid; wherein with the lever in the first lever position and the plunger in the first plunger position, the plunger prevents the lever from pivoting from the first lever position to the second lever position, and wherein with the plunger in the second plunger position the plunger does not prevent the lever from pivoting from the first lever position to the second lever position.

In at least some embodiments, the apparatus further comprises a control system coupled to the solenoid.

In at least some embodiments, the apparatus comprises a spring to bias the lever toward the second lever position.

In at least some embodiments, the second plunger position is forward of the first plunger position.

In at least some embodiments, the plunger includes a second end and with the lever in the first lever position and the plunger in the first plunger position, the second end of the plunger is in contact with a surface of the lever to prevent the lever from pivoting from the first lever position to the second lever position.

In at least some embodiments, the second end of the plunger includes a rear facing surface and with the lever in the first lever position and the plunger in the first plunger position, the rear facing surface of the second end of the plunger is in contact with the surface of the lever to prevent the lever from pivoting from the first lever position to the second lever position.

In at least some embodiments, with the lever in the first lever position and the plunger in the first plunger position, only a portion of the rear facing surface of the second end of the plunger is in contact with the surface of the lever to prevent the lever from pivoting from the first lever position to the second lever position.

In at least some embodiments, a lateral width of the portion of the rear facing surface is no greater than one half a lateral width of the rear facing surface.

In at least some embodiments, the apparatus includes: a first pivot pivotably coupling the lever to the binding plate; a second pivot pivotably coupling the linkage to the lever; and a third pivot pivotably coupling the linkage to the slide.

In at least some embodiments, with the lever in the first lever position, the first, second and third pivots are each disposed at least in part on a same line.

In at least some embodiments, with the lever in the second lever position, the first and third pivots each remain disposed at least in part on the line.

Some aspects and/or embodiments thereof disclosed herein are directed to a system, apparatus and/or method for use in binding a ski to a ski boot during use, using controllable electromagnets and/or permanent magnets to keep the boot in place, and using information obtained from electronic sensors to determine when to release the binding by disabling the electromagnets and/or enabling the electromagnets so as to counteract the permanent magnets.

In some aspects, apparatus for use in releasably retaining a boot plate to a ski comprises: a binding plate attachable to the ski, the binding plate including a surface to receive the boot plate and an electromagnet to receive electrical power and provide a magnetic force in response thereto to attract the boot plate to the surface of the binding plate.

In at least some embodiments, the apparatus further comprises a control system coupled to the electromagnet.

In at least some embodiments, the surface of the binding plate includes a raised portion.

In at least some embodiments, the binding plate includes a plurality of electromagnets to receive electrical power and provide a magnetic force in response thereto to attract the boot plate to the surface of the binding plate.

In at least some aspects, the binding plate comprises a toe plate and a heel plate spaced apart from the toe plate, the toe plate includes the electromagnet and the heel plates includes an electromagnet to receive electrical power and provide a magnetic force in response thereto to attract the boot plate to the surface of the binding plate.

In at least some embodiments, the surface of the binding plate includes a plurality of raised portions.

In at least some embodiments, the surface of the toe plate defines one of the plurality of raised portions and wherein the surface of the heel plate defines another of the plurality of raised portions.

In some aspects, apparatus comprises: a boot plate comprising a material attracted by a magnetic field from a permanent magnet; a binding plate attachable to a ski, the binding plate including a surface to receive the boot plate and an electromagnet to receive electrical power and provide a magnetic force in response thereto. In one embodiment, the electromagnet acts to negate a magnetic field that attracts the boot plate to the surface of the binding plate. In another embodiment, the electromagnet provides the force to keep the boot plate and the surface of the binding in contact. That is, some embodiments use an electromagnet to add closing force to keep the boot and binding plate together, while in other embodiments the electromagnet is used to apply a repulsive force to overcome the force of the permanent magnet so as to release the boot from the binding.

In at least some embodiments, the apparatus further comprises a control system coupled to the electromagnet.

In at least some embodiments, the boot plate comprises a ferromagnetic material.

In at least some embodiments, the surface of the binding plate includes a raised portion and wherein the boot plate defines an indentation to receive the raised portion.

In at least some embodiments, the surface of the binding plate includes a plurality of raised portions and wherein the boot plate defines a plurality of indentations to receive the plurality of raised portions.

Some aspects and/or embodiments thereof are shown and/or otherwise described herein in the context of alpine skiing, but the aspects and/or embodiments thereof can also be used for cross-country skiing, snowboarding, or any similar activity in which a boot or shoe worn by the user is affixed to a ski, board or other similar implement.

This overview is intended to provide an overview of subject matter of the present patent application. It is not intended to provide an exclusive or exhaustive explanation of the invention. Further limitations and disadvantages of conventional and traditional approaches will become apparent to one of skill in the art, through comparison of such systems with some aspects of the present invention as set forth in the remainder of the present application with reference to the drawings.

The aspects and embodiments described above, as well as additional aspects and embodiments, are described further below. These aspects and/or embodiments may be used individually, all together, or in any combination of two or more, as the technology described herein is not limited in this respect.

BRIEF DESCRIPTION OF THE DRAWINGS

For a fuller understanding of the nature and advantages of the present invention, reference is made to the following detailed description of preferred embodiments and in connection with the accompanying drawings, in which.

DETAILED DESCRIPTION

The following description and drawings set forth certain illustrative implementations of the disclosure in detail, which are indicative of several exemplary ways in which the various principles of the disclosure may be carried out. The illustrative examples, however, are not exhaustive of the many possible embodiments of the disclosure.

Some aspects disclosed herein are directed to a binding system that includes a solenoid to initiate release of a boot from a ski. The binding system may further include a control system having an electrical power source in electrical communication with the solenoid. In at least some embodiments, the binding system is intended to be used in lieu of a conventional ski binding system.

Figure 1:
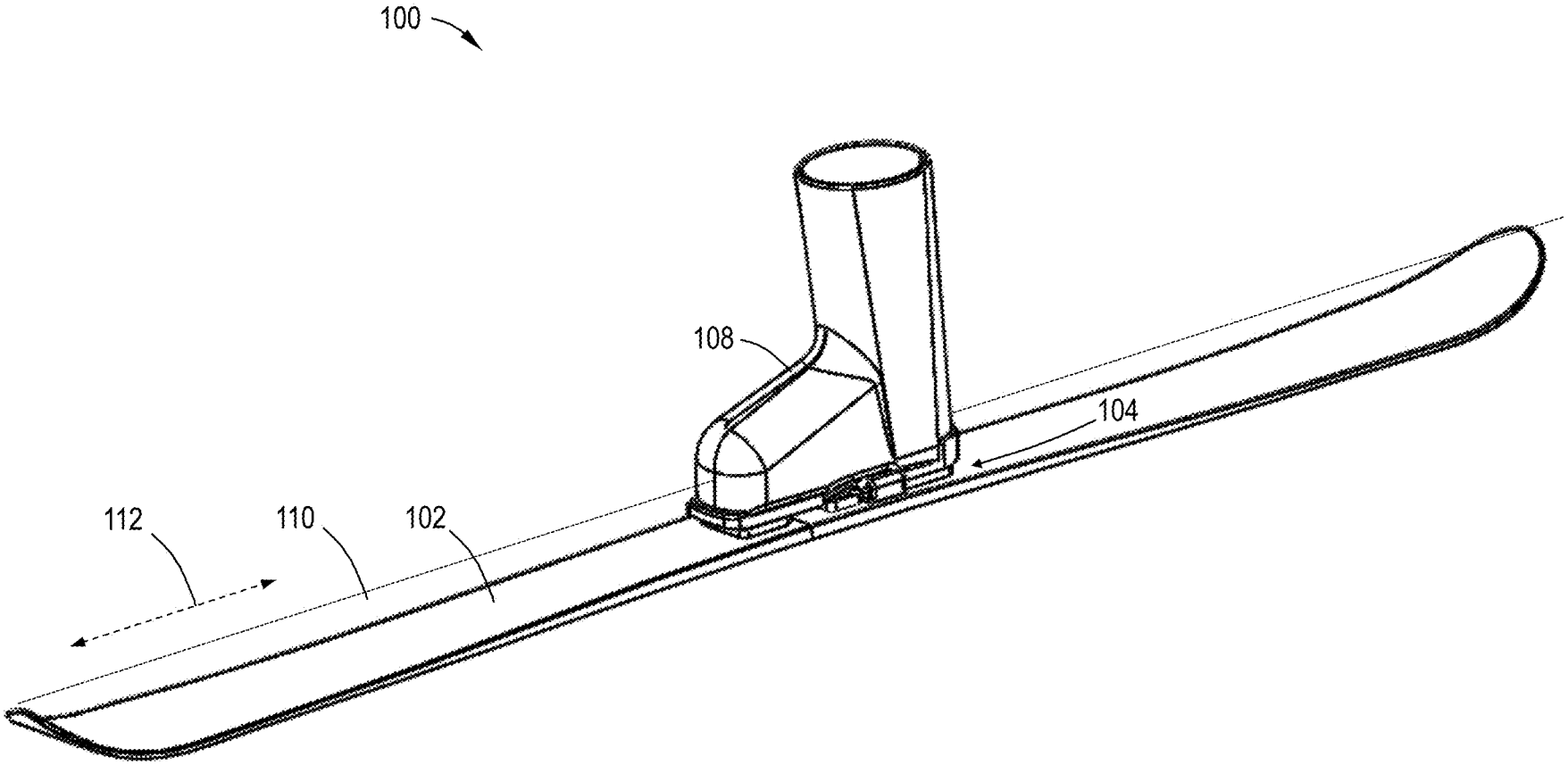
FIG. 1 is a perspective view of a system that includes a binding system, in a first state, in accordance with at least some embodiments.

FIG. 1 is a perspective view of a system 100 that includes a solenoid to initiate release of a boot from a ski, in accordance with at least some embodiments.

Figure 2:
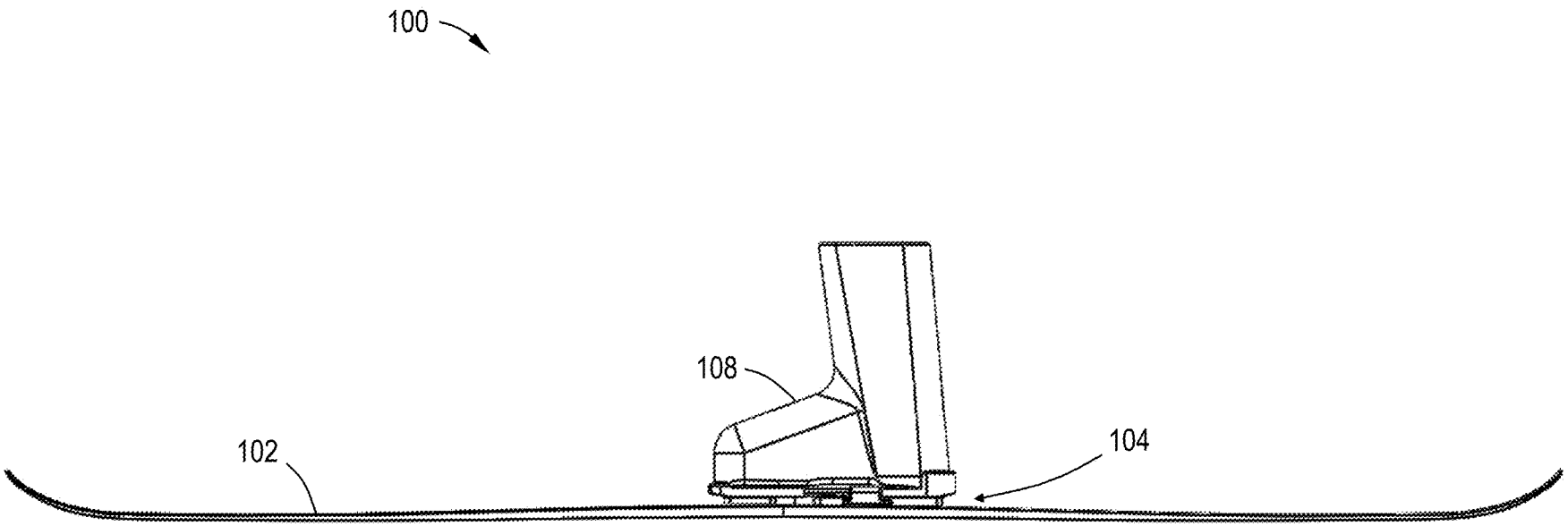
FIG. 2 is a side view of the system, in accordance with at least some embodiments.

FIG. 2 is a side view of the system 100, in accordance with at least some embodiments.

Figure 3:
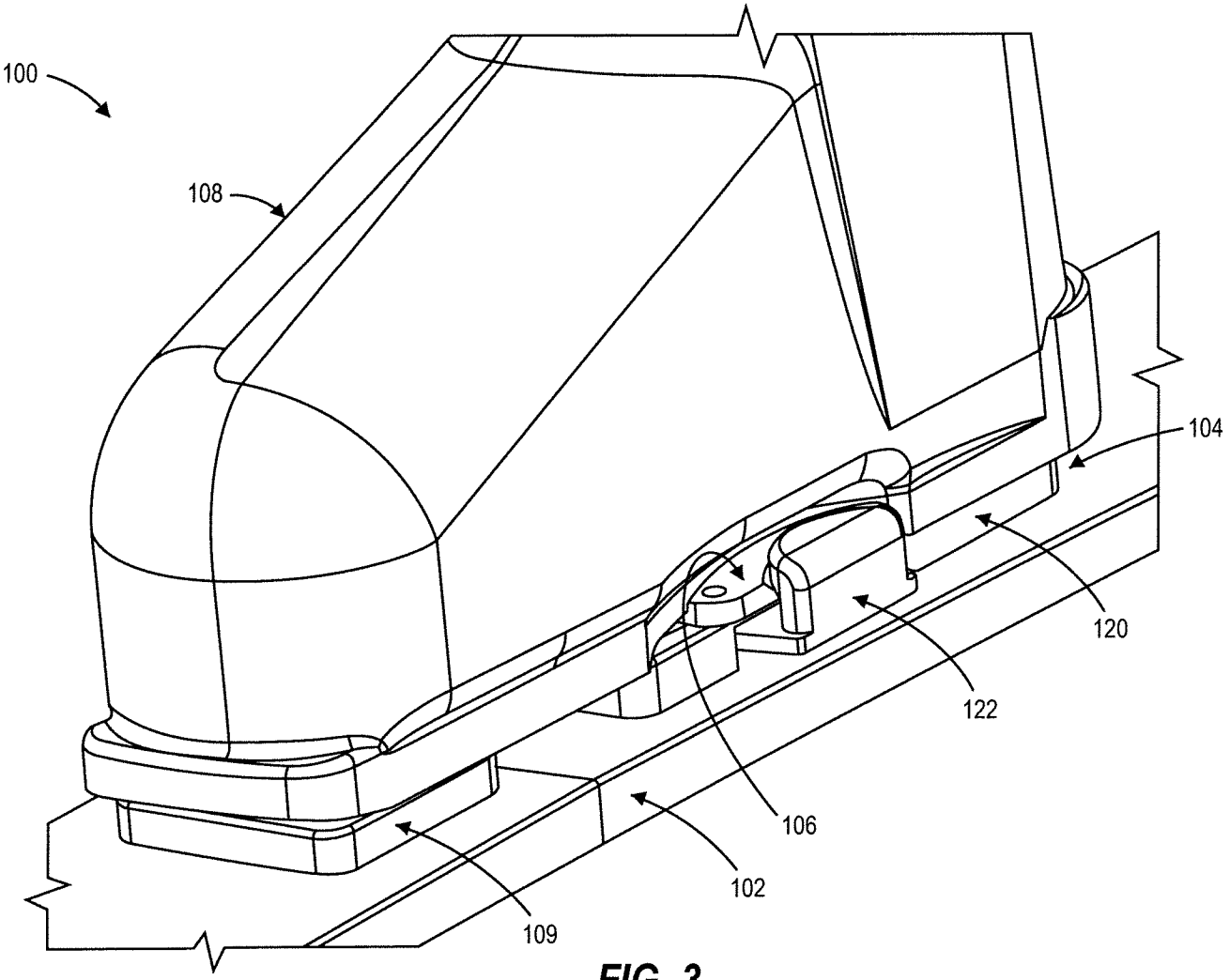
FIG. 3 is an enlarged perspective view of a portion of the system, in accordance with at least some embodiments.

FIG. 3 is an enlarged perspective view of a portion of the system 100, in accordance with at least some embodiments.

Referring to FIGS. 1-3, in accordance with at least some embodiments, the system 100 includes a ski 102, a binding system 104, a boot plate 106 (FIG. 3), a boot 108, and a toe plate 109 (FIG. 3).

Unless stated otherwise, the term "ski" is used herein to mean a ski for any type of skiing, a board for snowboarding and/or a ski or other type of board for any other activity in which a boot or shoe worn (or to be worn) by a user is to be releasably affixed to the ski or other type of board.

The binding system 104 may be mounted (directly and/or indirectly) to an upper and/or other surface of the ski 102. The boot plate 106 may be attached (directly and/or indirectly) to a sole and/or other portion of the boot 108 (e.g., using screws (or other fasteners (threaded or otherwise)), claws and/or any other type of fasteners (not shown)). The boot plate 106 may also be releasably attached to the binding system 104, (thereby releasably attaching the boot 108 to the binding system 104), sometimes referred to herein as a first (or releasably attached) state.

The system 100 may have a longitudinal axis 110 (FIG. 1) and/or may extend in longitudinal directions 112 (FIG. 1).

Figure 4:
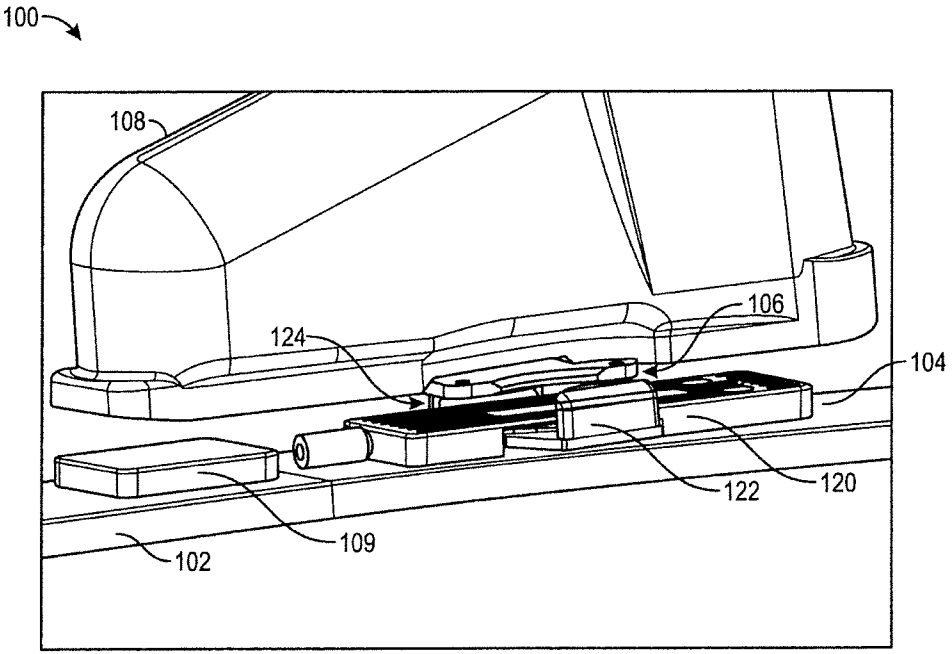
FIG. 4 is an enlarged perspective view of a portion of the system, in a second state, in accordance with at least some embodiments.

FIG. 4 is a perspective view of the system 100 with the boot 108 released from the binding system 104, sometimes referred to herein as a second (or released or detached) state.

Figure 5:
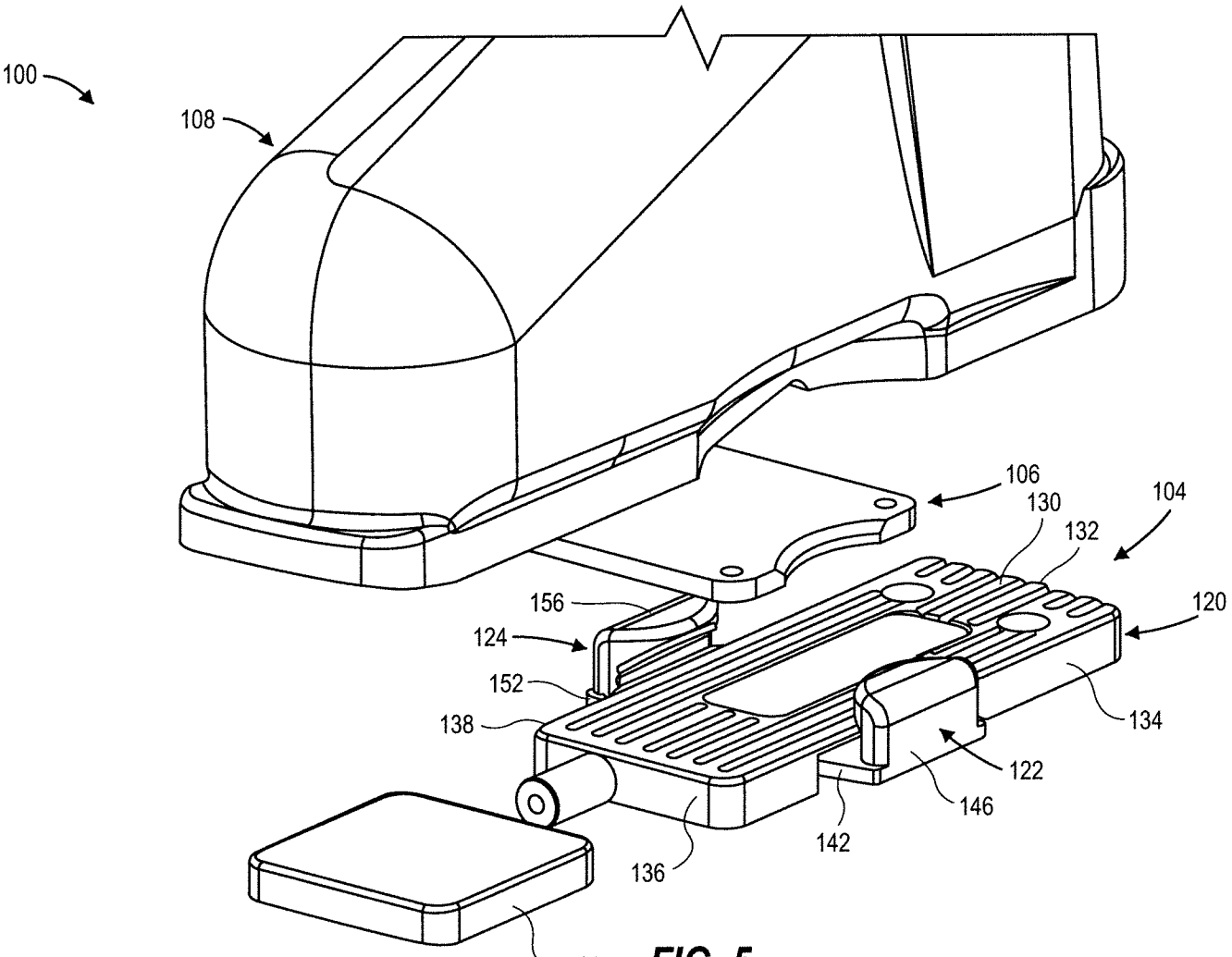
FIG. 5 is an enlarged perspective view of a portion of the system, in a disassembled state, in accordance with at least some embodiments.

FIG. 5 is an enlarged perspective view of a portion of the system 100, without the ski 102 and in a disassembled state.

Referring also now to FIGS. 4-5, in accordance with at least some embodiments, the binding system 104 may include a binding plate 120 and one or more clamps, e.g., two clamps 122, 124. The binding plate 120 may be mounted (directly or indirectly) to the upper or other surface of the ski 102 (FIGS. 1-4). The two clamps 122, 124 may be pivotably or otherwise rotatably coupled (directly and/or indirectly) to the binding plate 120.

Figure 6:
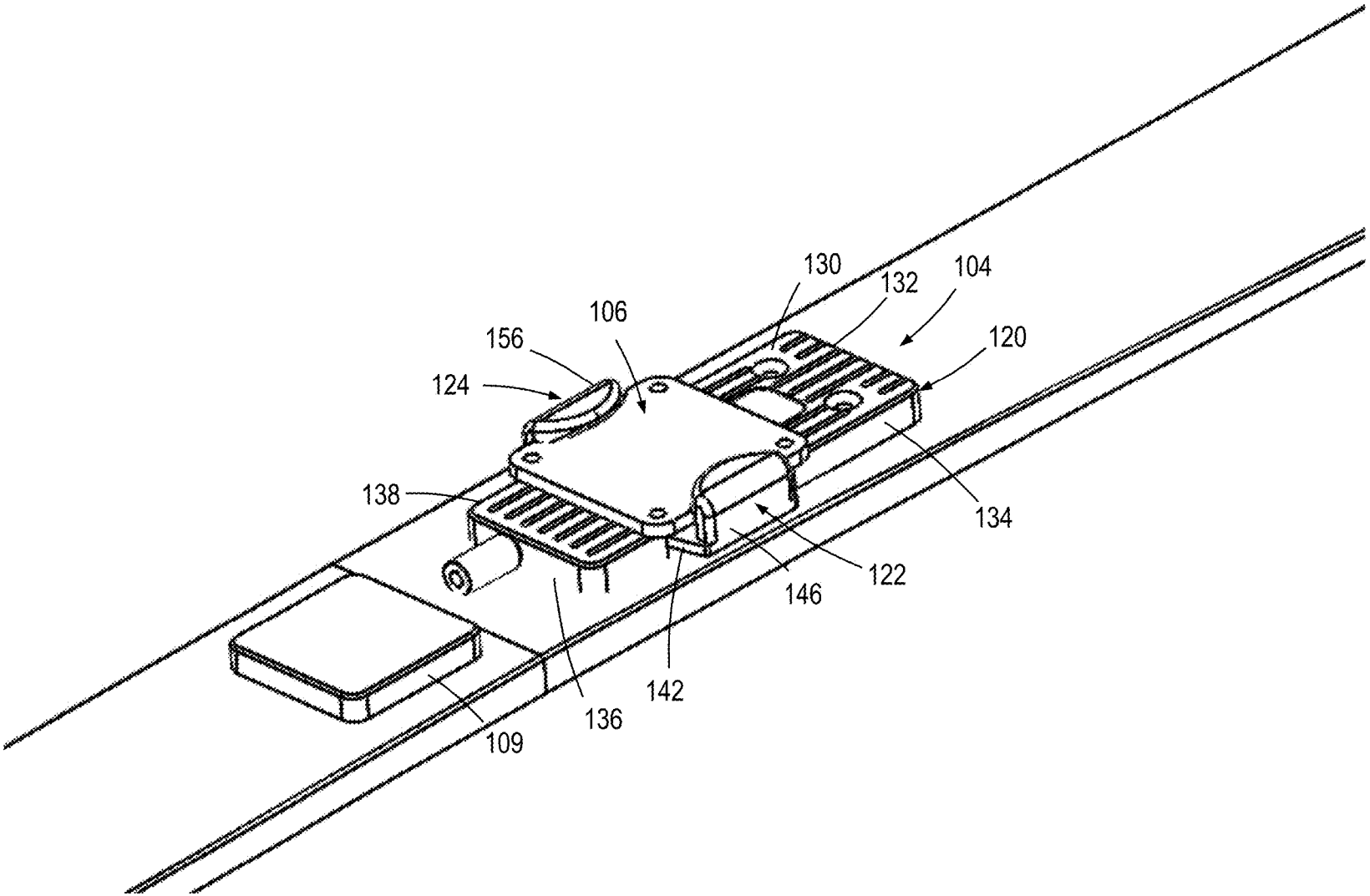
FIG. 6 is a perspective view of a portion of the system, in accordance with at least some embodiments.

FIG. 6 is a perspective view of a portion of the system 100, without the boot 108, showing a relative positioning of the boot plate 106, the binding plate 120 and the clamps 122, 124, with the binding system 104 in the first (or releasably attached) state, in accordance with at least some embodiments.

Figure 7:
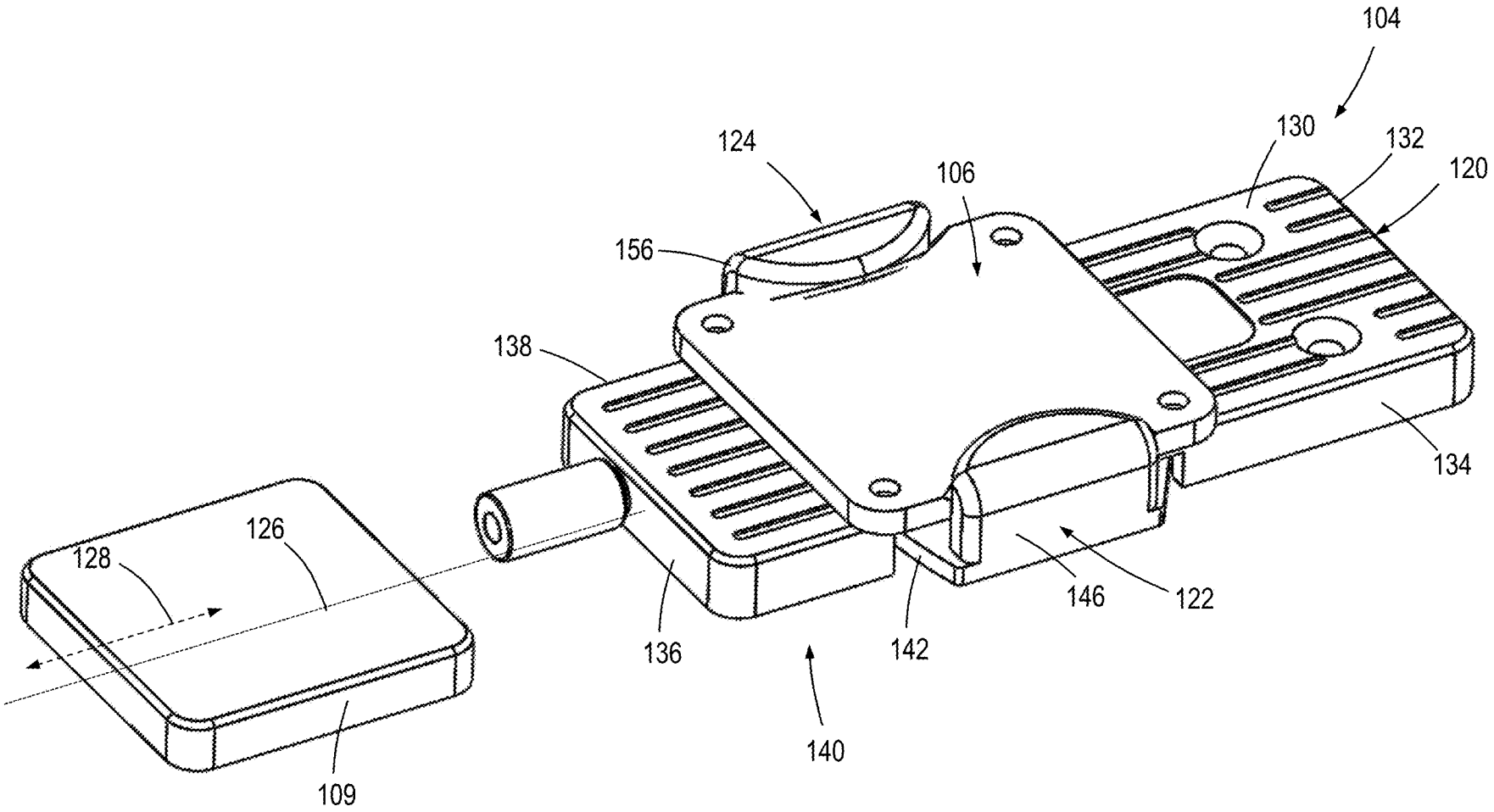
FIG. 7 is an enlarged perspective view of the binding system, in accordance with at least some embodiments.

FIG. 7 is an enlarged perspective view showing a relative positioning of the boot plate 106, the binding plate 120 and the clamps 122, 124, with the binding system 104 in the first (or releasably attached) state, in accordance with at least some embodiments.

The binding system 104 and/or binding plate 120 may have a longitudinal axis 126 (FIG. 7) and/or may extend in longitudinal directions 128 (FIG. 7). In at least some embodiments, the longitudinal axis 126 of the binding system 104 and/or binding plate 120 may be co-extensive with the longitudinal axis 110 of the system 100. The clamps 122, 124 may be disposed on opposite sides of the longitudinal axis 110 and/or the longitudinal axis 126.

Figure 8:
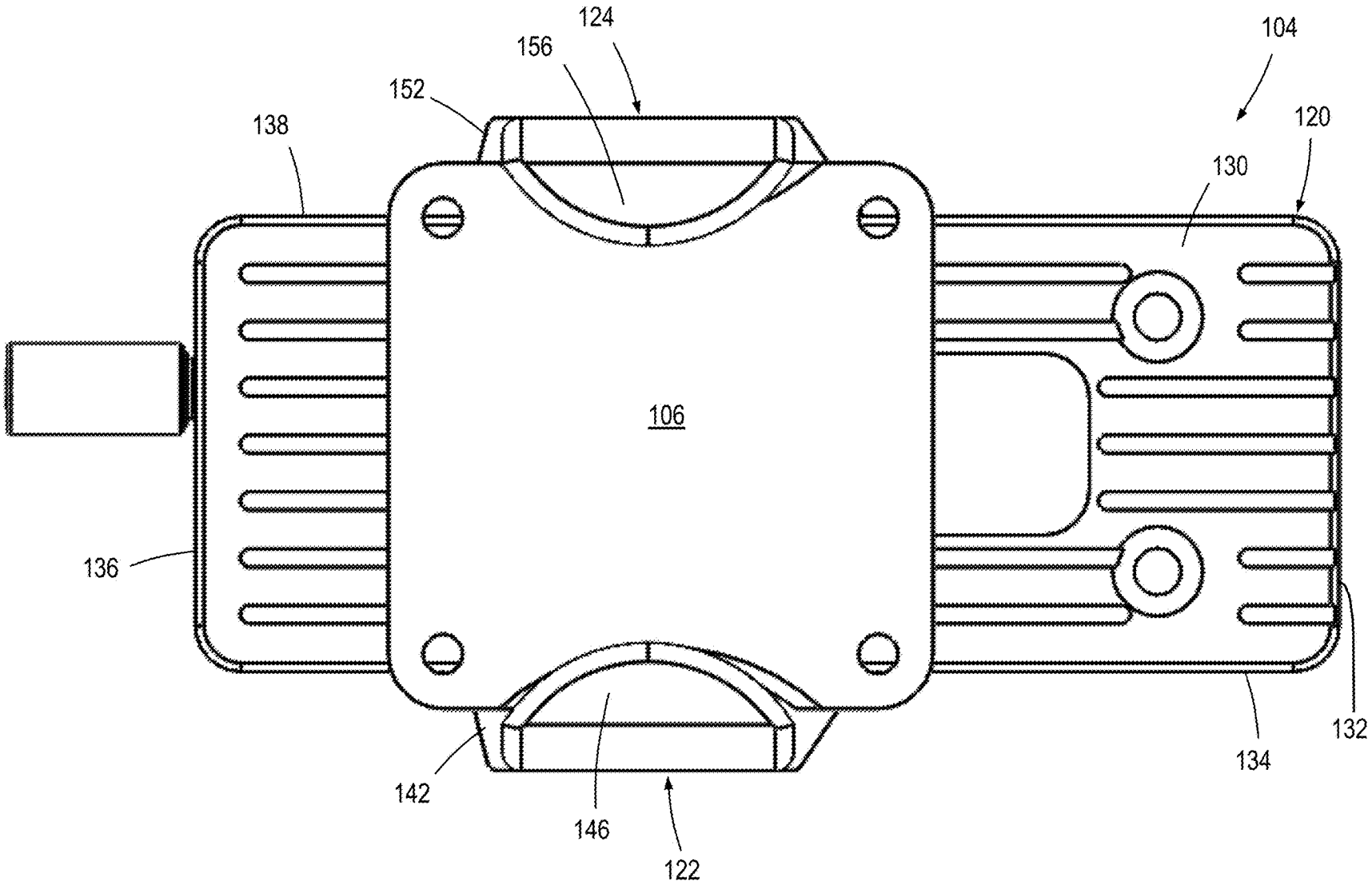
FIG. 8 is an enlarged top view of the binding system, in accordance with at least some embodiments.

FIG. 8 is an enlarged top view showing a relative positioning of the boot plate 106, the binding plate 120 and the clamps 122, 124, with the binding system 104 in the first (or releasably attached) state, in accordance with at least some embodiments.

Figure 9:
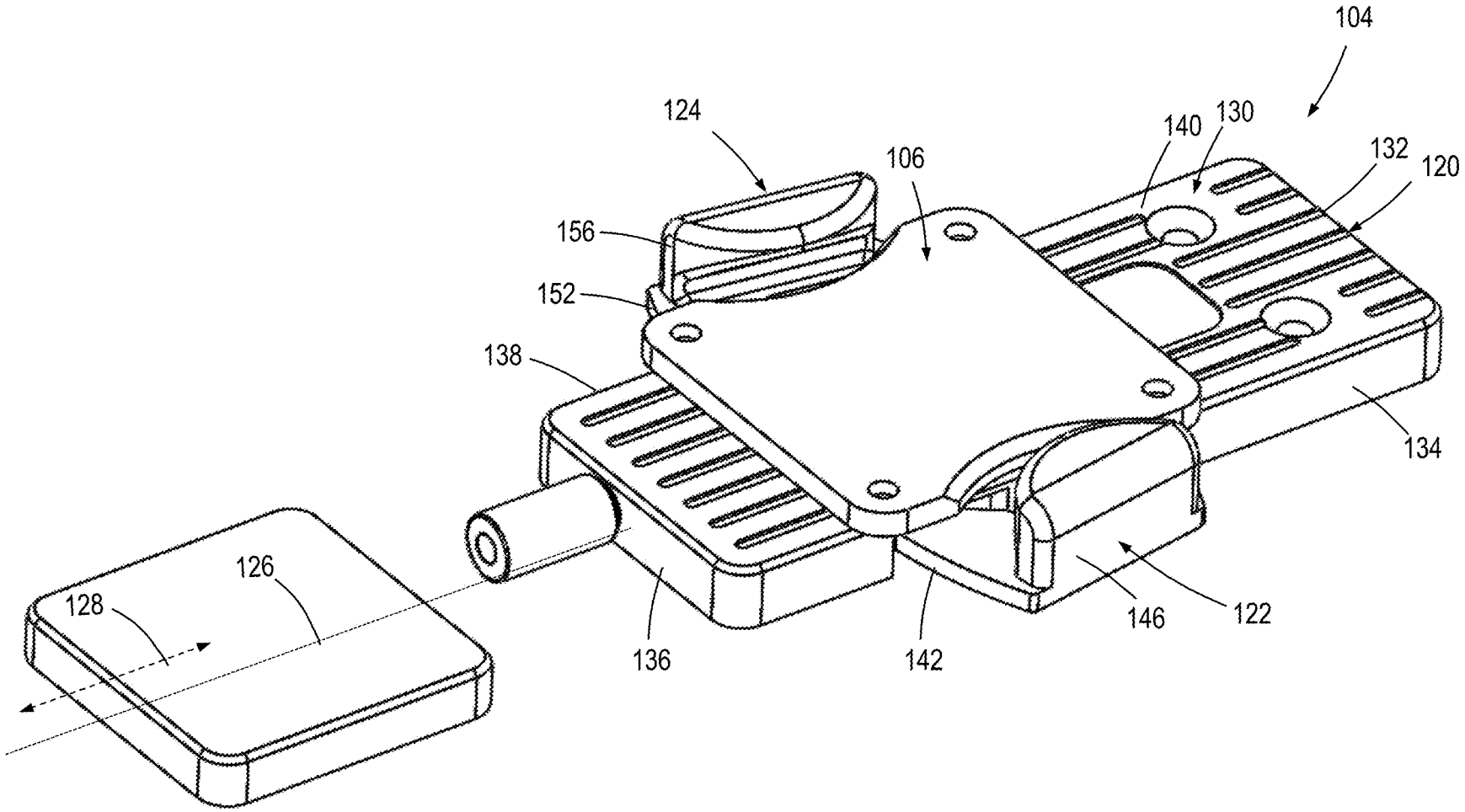
FIG. 9 is an enlarged perspective view of the binding system, in the second state, in accordance with at least some embodiments.

FIG. 9 is an enlarged perspective view showing a relative positioning of the boot plate 106, the binding plate 120 and the clamps 122, 124, with the binding system 104 in the second (or released or detached) state, in accordance with at least some embodiments.

Figure 10:
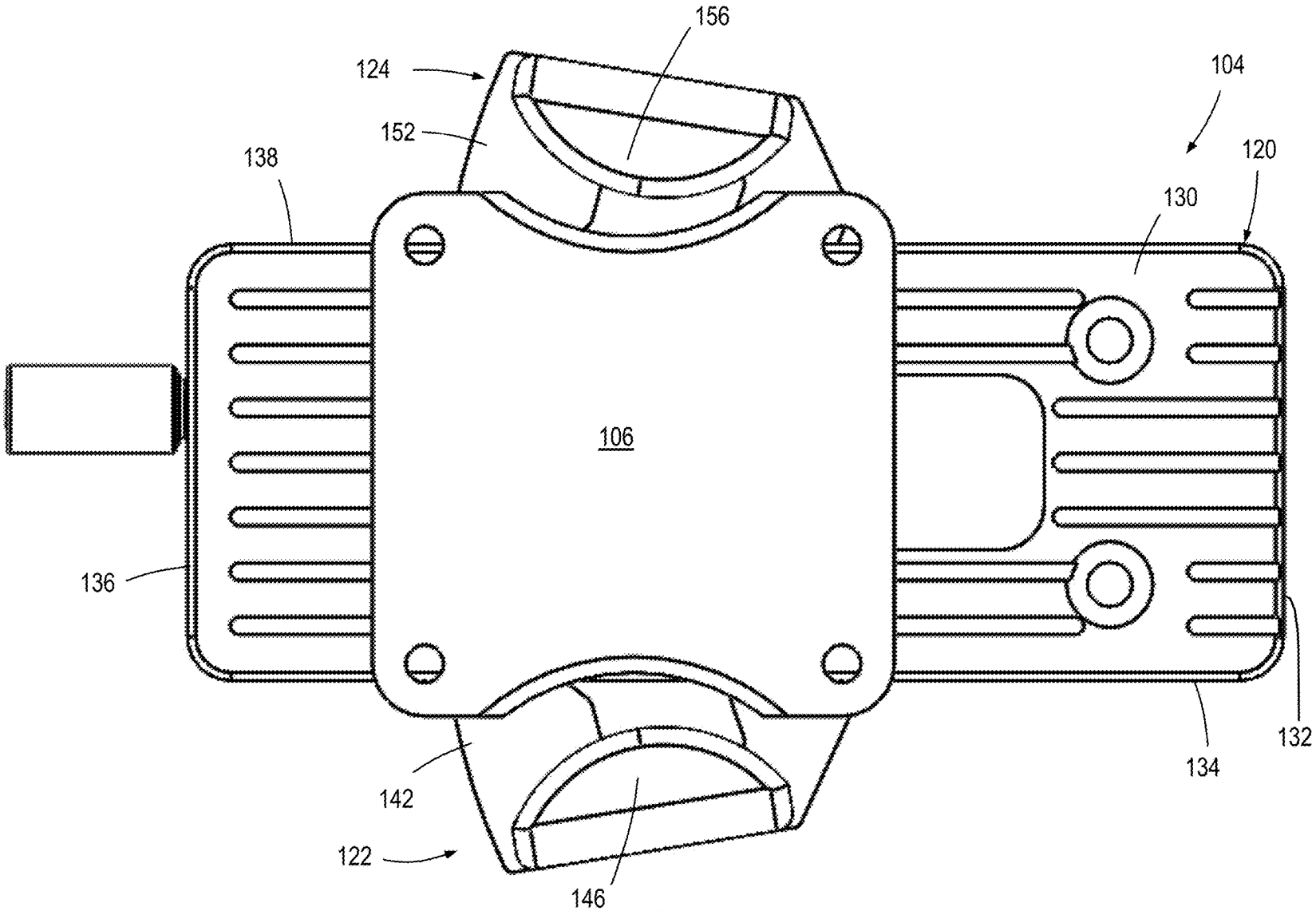
FIG. 10 is an enlarged top view of the binding system, in the second state, in accordance with at least some embodiments.

FIG. 10 is an enlarged top view showing a relative positioning of the boot plate 106, the binding plate 120 and the clamps 122, 124, with the binding system 104 in the second (or released or detached) state, in accordance with at least some embodiments.

Figure 11:
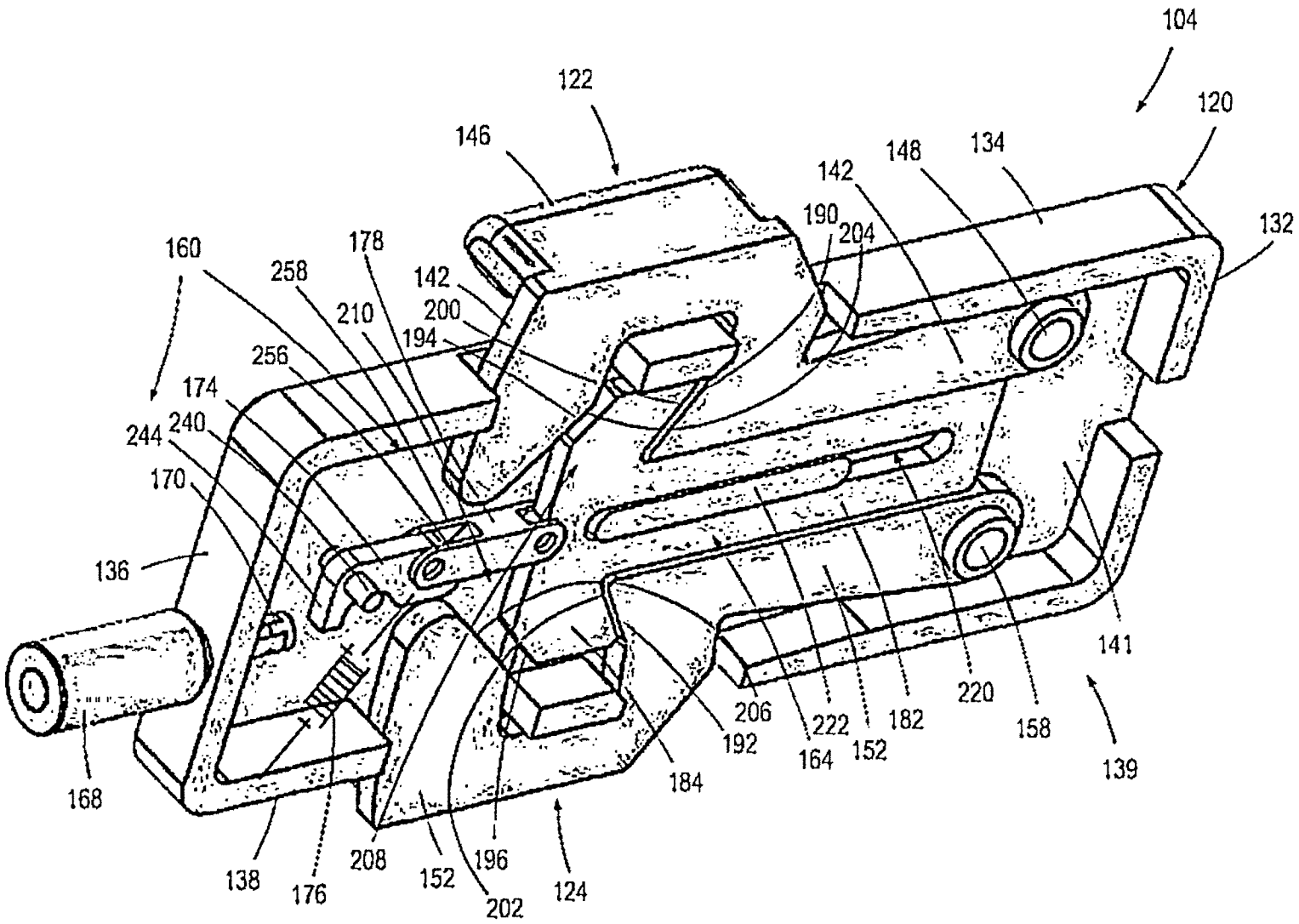
FIG. 11 is an enlarged bottom perspective view of the binding system, in accordance with at least some embodiments.

FIG. 11 is an enlarged perspective bottom view of the binding plate 120 and portions of the binding system 104 coupled thereto, in accordance with at least some embodiments.

Figure 12:
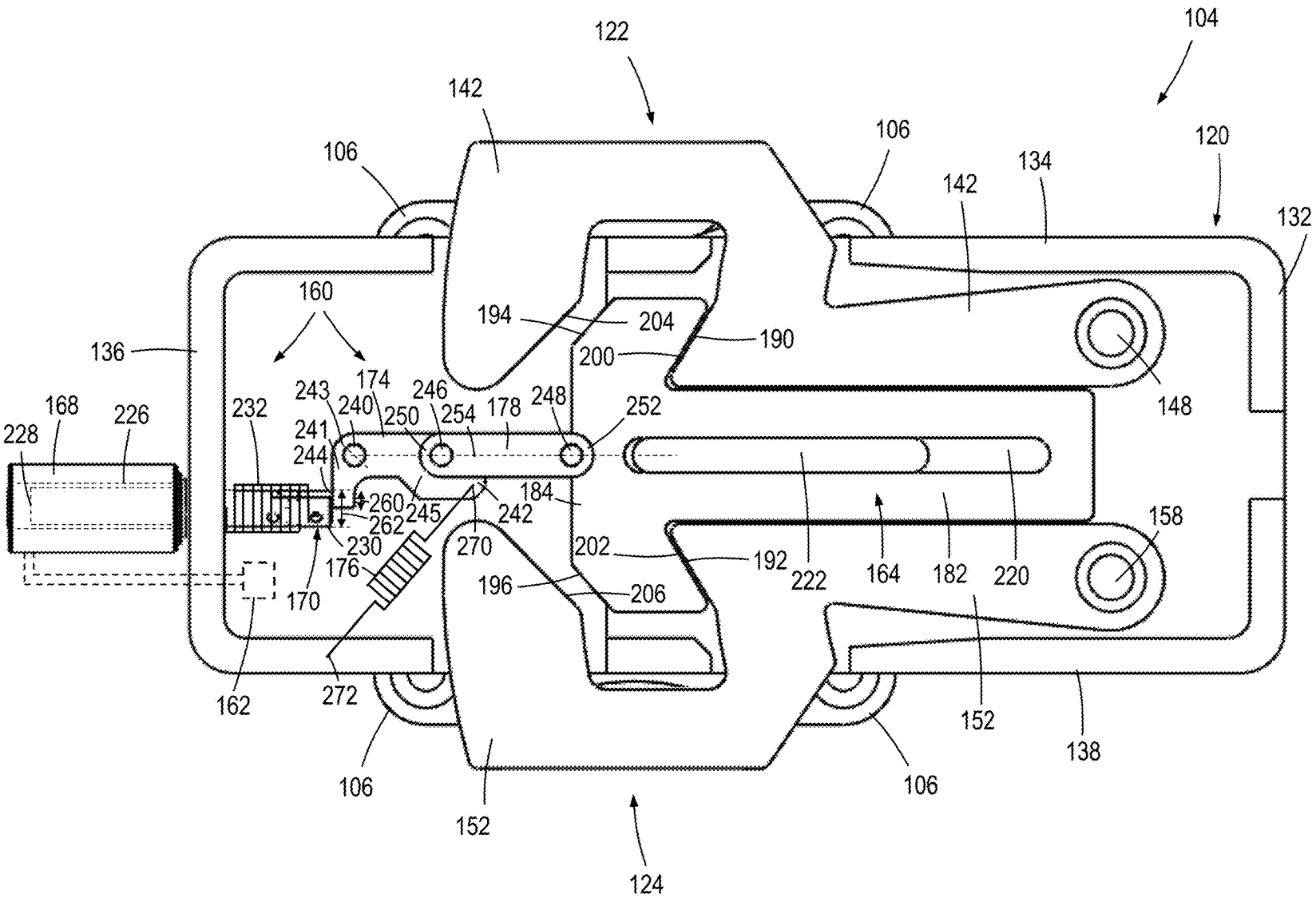
FIG. 12 is an enlarged bottom view of the binding system, in the first state, in accordance with at least some embodiments.

FIG. 12 is an enlarged bottom view of the binding plate 120 and portions of the binding system 104 coupled thereto, with the binding system 104 in the first state, in accordance with at least some embodiments.

Figure 13:
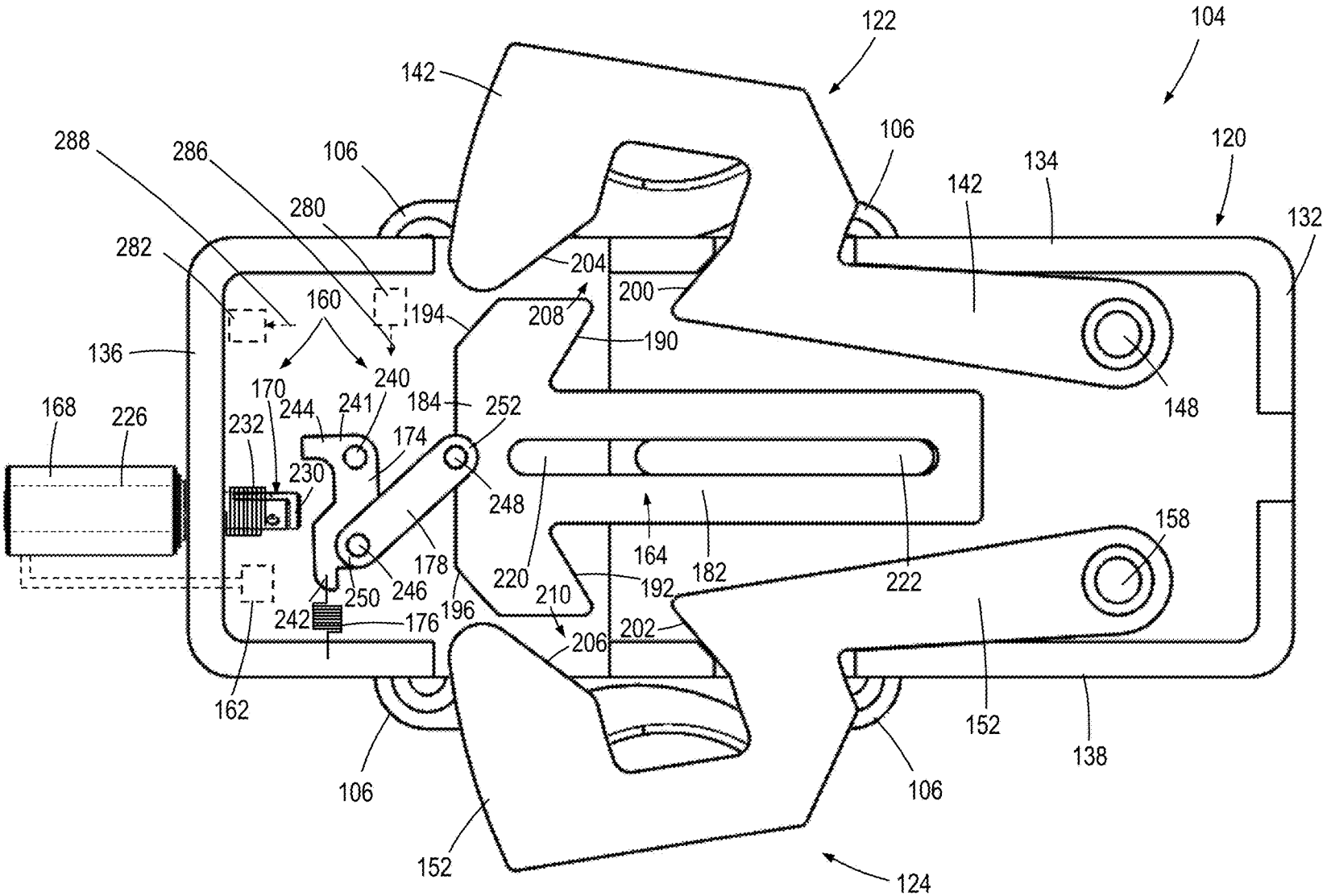
FIG. 13 is an enlarged bottom view of the binding system in the second state, in accordance with at least some embodiments.

FIG. 13 is an enlarged bottom view of the binding plate 120 and portions of the binding system 104 coupled thereto, with the binding system in the second state, in accordance with at least some embodiments.

Referring also now to FIGS. 9-13, the binding plate 120 may include a top 130, a side 132 (sometimes referred to herein as rear side 132), a side 134, a side 136 (sometimes referred to herein as front side 136) and a side 138. A bottom of the binding plate 120 may be open at least in part and thereby define an opening 139 (FIG. 11). The top may have an upper surface 140 (FIG. 9) and a lower surface 141 (FIG. 11).

The two clamps 122, 124 may each comprise an arm and a jaw coupled to the arm. In at least some embodiments, including but not limited to the illustrated embodiment, the clamp 122 may comprise an arm 142 and a jaw 146 coupled to the arm 142. The clamp 124 may comprise an arm 152 and a jaw 156 coupled to the arm 152.

The arms 142, 152 may be elongated and laterally spaced from one another, and may be pivotably coupled to the binding plate 120 by bolts 148, 158 (FIGS. 11-13), respectively, or other type(s) of pivots.

In at least some embodiments, including but not limited to the illustrated embodiment, the arms 142, 152 are disposed on opposite sides of and/or spaced laterally from the longitudinal axis 110 and/or the longitudinal axis 126, and may pivot towards (to become closer to) and away from (to become further from) the longitudinal axis 110 and/or the longitudinal axis 126.

The arms 142, 152 may have a first position (e.g., FIGS. 6-8 and 12) in which the jaws, e.g., jaws 146, 156, have a first lateral spacing and releasably retain the boot plate 106 to the binding plate. The arms 142, 152 may also have a second position (e.g., FIGS. 9-10 and 13) in which the jaws 146, 156 have a second lateral spacing greater than the first lateral spacing and are spaced apart from the boot plate 106.

In at least some embodiments, the first position of the arms 142, 152 may be a position of the arms 142, 152 that is most (pivotably) laterally inward. In at least some embodiments, with the arms 142, 152 in their first position, the jaws 146, 156 contact the boot plate 106 and force the boot plate 106 against the binding plate 120 or otherwise trap the boot plate 106 relative to the binding plate 120, to thereby releasably attach the boot plate 106 (and a boot, e.g., boot 108, to which the boot plate 106 is attached) to the binding plate 120, and in doing so, prevent or otherwise limit movement of the boot plate 106 relative to the binding plate 120. In at least some embodiments, movement may be prevented or otherwise limited in three dimensions (e.g., longitudinal, lateral and vertical).

In at least some embodiments, the second position of the arms 142, 152 may be a position of the arms that is most (pivotably) laterally outward. In at least some embodiments, with arms 142, 152 in their second position, the jaws 146, 156 may be in their position that is most spaced apart from the boot plate 106 such that the boot plate 106 (and a boot, e.g., boot 108, to which the boot plate 106 is attached) is most easily removed from the binding plate 120.

The binding system 104 may further include a processor controlled latch and release system 160 (FIGS. 12-13). The latch and release system 160 may include a processor based control system 162, a slide 164, a solenoid 168, a plunger 170, a lever 174, a spring 176 (or other bias element(s)) and a link 178.

The control system 162 may be coupled to the solenoid 168 and configured to receive one or more signals, from one or more sensors or otherwise, indicative of one or more conditions of the system, and to determine, based at least in part thereon, whether (and/or when) to power the solenoid 168 to initiate release of the boot plate 106 (and boot 108 to which the boot plate 106 is mounted).

As stated above, ideally, a binding system keeps the boot plate (and thus the boot attached thereto) securely attached to the ski during normal use, and releases the boot plate (and thus the boot attached thereto) from the ski during a fall or other mishap in order to prevent the ski from exerting undue torque, tension or force on the skier's leg and thereby causing injury.

The control system 162 may have a centralized or distributed architecture. In at least some embodiments, one or more portions of the control system 162 may be disposed on or otherwise coupled to the binding plate 120. In some at least some embodiments, one or more portions of the control system 162 may be disposed on or otherwise coupled to the skier and/or an article (e.g., clothing or otherwise) worn by the skier.

The slide 164 may be disposed at least in part between arms 142, 152 of clamps 122, 124, respectively, and may be slidably coupled to the binding plate 120 so as to be slidable in longitudinal directions 112 and/or longitudinal directions 128. In at least some embodiments, the slide has a first position (e.g., FIG. 12) and a second position (e.g., FIG. 13) that is forward of the first position.

As used herein, the term "forward of" means "closer to a front of the binding plate than is".

As used herein, the term "rearward of" means "closer to a rear of the binding plate than is".

In at least some embodiments, the slide 164 may be centered about or otherwise disposed on the longitudinal axis 110 and/or the longitudinal axis 126.

The slide 164 may include a body 182 and a head 184 or other abutment coupled thereto. The body 182 may extend in (or at least substantially in) longitudinal directions 112 and/or longitudinal directions 128. The head 184 or other abutment may be elongated in a lateral direction and may have a lateral width greater than that of the body 182 with portions, on laterally opposite sides of the head 184 or other abutment, that extend laterally beyond the sides of the body 182.

The head 184 or other abutment may define abutment surfaces 190, 192, 194, 196. Abutment surfaces 190, 192 may be disposed on a rear side and/or rear surfaces of the head 184 or other abutment. Abutment surfaces 194, 196 may be disposed on a front side and/or front surfaces of the head 184 or other abutment.

The abutment surfaces 190, 192, 194, 196 may be configured to contact abutment surfaces 200, 202, 204, 206, respectively, of clamps 122, 124. In at least some embodiments, the clamps 122, 124 define channels 208 (FIG. 13), 210 (FIG. 13), respectively, and the abutment surfaces 200 202, 204, 206 are disposed within the channels 208, 210. In the illustrated embodiment, the abutment surfaces 200, 202 are defined by rear surfaces of the channels 208, 210, respectively. The abutment surfaces 204, 206 are defined by front surfaces of the channels 208, 210, respectively.

In at least some embodiments, the abutment surfaces 190, 192 of the slide 164 define a catch to force the arms laterally inward (and/or toward their first position) and/or to trap the arms in their laterally inward position. To facilitate such, the abutment surfaces 190, 200 may be angled and/or complementary. The abutment surfaces 192, 202 may be angled and/or complementary.

In at least some embodiments, the abutment surfaces 194, 196 of the slide 164 define a wedge to force the arms laterally outward and/or toward their second position. The abutment surfaces 194, 204 may be angled and complementary to one another to facilitate sliding contact therebetween. The abutment surfaces 196, 206 may be angled and complementary to one another to facilitate sliding contact therebetween.

The slide 164 may define a slot 220 or other channel, which may be elongated and may extend in (or at least substantially in) longitudinal directions 112 and/or longitudinal directions 128.

As used herein, the term "at least substantially in" means "in, +/−5 degrees,".

The slot 220 or other channel may receive a rail 222 or other raised portion that extends from or is otherwise coupled to the binding plate 120 to guide at least in part sliding movement of the slide 164 relative to the binding plate 120. In some other embodiments, the binding plate 120 may define the slot 220 or other channel and the slide 164 may define the rail 222 or other raised portion.

The solenoid 168 may have a first state (e.g., unpowered, FIG. 12) and a second state (e.g., powered, FIG. 13) and may define a channel 226 configured to receive the plunger 170. The channel 226 may be elongated and may extend in (or at least substantially in) the longitudinal directions 112 and/or the longitudinal directions 128.

The plunger 170, which may also be elongated and may extend in (or at least substantially in) the longitudinal directions 112 and/or the longitudinal directions 128, may include a first (or proximal) end 228 (FIG. 12) and a second (or distal) end 230. The first end 228 may be slidingly received within the channel 226 defined by the solenoid 168. The second end 230 may be biased away from the solenoid 168 by a spring 232 (or other bias element(s)), which may be disposed circumferentially about the plunger 170.

The plunger 170 may have a first position (e.g., FIG. 12) associated with the first state of the solenoid 168 and a second position (e.g., FIG. 13) associated with the second state of the solenoid 168.

The lever 174, the spring 176 (or other bias element(s)) and the link 178, may collectively define a mechanical amplifier that is disposed at least in part between the plunger 170 and the slide 164.

The lever 174 may be pivotably coupled to the binding plate 120 by a shaft 240 or other type of pivot. Thus, the lever 174 may have a first position (e.g., FIG. 12) and a second position (e.g., FIG. 13) that is pivotably offset from the first position. The spring 176 or other bias element may bias the lever 174 toward the second position.

The lever 174 may be elongated and may have first and second ends 241, 242. The shaft 240 (or other pivot) may be disposed at, proximal to or otherwise toward the first end 241. The lever 174 may define a bend having a centerline 243 (FIG. 12) and the shaft 240 or other pivot may be disposed at least in part on the centerline 243. The bend may be a sharp bend (with a sharp corner) or a more gradual bend (with a radius). The spring 176 or other bias element may attach to the lever 174 at or proximal to or otherwise toward the second end 242.

As used herein, the term "toward the second end" means closer to the second end than to the first end.

The lever 174 further includes an abutment surface 244. In at least some embodiments, the abutment surface 244 may be disposed at or otherwise proximal to the first end 241.

In the first position (e.g., FIG. 12), the lever 174 may extend in (or at least substantially in) longitudinal directions 112 and/or longitudinal directions 128.

In the second position (e.g., FIG. 13), the lever 174 may extend in (or at least substantially in) a lateral direction.

In at least some embodiments, lateral direction(s) is/are perpendicular to longitudinal directions 112 and/or longitudinal directions 128.

In at least some embodiments, with the lever 174 in the second position, the lever 174 may extend in a direction that is pivotally offset from the first position by 90 degrees or substantially 90 degrees.

As used herein, the term "substantially 90 degrees" means 90 degrees +/−10%.

In at least some embodiments, with the lever 174 in the second position, the lever 174 may extend in a direction that is pivotally offset from the first position by an angle in the range of 60 degrees to 120 degrees.

In at least some embodiment, with the lever 174 in its first position and the solenoid 168 in its first state (FIG. 12), the second end of the plunger 170 is biased, by the spring 232 or other bias element, into contact with the abutment surface 244 of the lever 174, which prevents or otherwise limit pivoting movement of the lever 174 from its first position to its second position. In at least some embodiments, the contact between the plunger 170 and the lever 174 is provided by a rear facing surface of the second end 230 of the plunger 170.

In at least some embodiments, the contact is provided by only a portion of the rear facing surface of the second end 230 of the plunger 170. In at least some embodiments, a lateral width 260 of such portion of the rear facing surface is no greater than one half a lateral width 262 of the rear facing surface. In at least some embodiments, this may reduce the possibility of undesired interference between the plunger and the lever and/or speed release of the boot plate 106 when it is desired to release the boot plate 106.

The lever 174 further includes a portion 245 that is displaced forwardly if the lever 174 pivots from the first position to the second position.

As used herein, the term "displaced forwardly" means "displaced so as to be closer to a front of the binding plate," and does not preclude additional displacements in other dimensions, e.g., laterally in addition to forwardly. (In the illustrated embodiment, the portion 245 is also displaced laterally.)

In at least some embodiments, the lever 174 is rigid and/or has a fixed shape.

The spring 176 or other bias element(s) may have first and second ends 270, 272 (FIG. 12). A first end 270 of the spring 176 or other bias element(s) may attach to the lever 174 at, proximate to or otherwise toward the second end 242 of the lever 174.

A second end 272 of the spring 176 or other bias element(s) may be coupled to the binding plate 120. In at least some embodiments, the second end 272 of the spring 176 or other bias element(s) may attach to a location of the binding plate 120 that is laterally offset from the first shaft 240 or other pivot. In at least some embodiments, the location may have the same longitudinal position as the first shaft 240. In at least some other embodiments, the location may be forward of or rearward of the first shaft 240.

The link 178 is coupled (directly and/or indirectly) between the slide 164 and the lever 174. Thus, the link 178 may also have a first position (e.g., FIG. 12) and a second position (e.g., FIG. 13).

In at least some embodiments, the link 178 is pivotably coupled to the lever 174 by a shaft 246 (or other pivot) and pivotably coupled to the slide 164 by a shaft 248 (or other pivot).

The link 178 may be elongated and may have first and second ends 250, 252. One shaft 246 (or other pivot) may be disposed at, proximate to or otherwise toward the first end 250. The other shaft 248 (or other pivot) may be disposed at, proximate to or otherwise toward the second end 252.

In at least some embodiments, the link 178 has a rigid and/or a fixed shape. In at least some embodiments, the link comprises only one link stage. In at least some embodiments, the link comprises one link stage that includes a plurality of parallel link portions 256, 258 (e.g., FIG. 11).

In at least some embodiments, the link 178 attaches to the lever at a portion 245 of the lever 174 that is displaced forward if the lever 174 pivots from its first position to its second position so as to cause the slide to be pulled forward if the lever pivots from the first lever position to the second lever position. In at least some embodiments, the link 178 attaches to the lever 174 at, proximal to or otherwise toward the second end 242 of the lever 174. In at least some embodiments, this may increase forward displacement of the slide 164 in the second state, which may speed or otherwise assist in release of the boot plate 106.

In at least some embodiments, the link 178 attaches at a portion of the lever 174 that is displaced forwardly by an amount that is at least 50% of the amount that the second end 242 of the lever 174 is displaced forwardly.

In its second position (e.g., FIG. 13), the link 178 may extend in (or at least substantially in) a direction that is pivotally offset from its first position by 45 degrees or substantially 45 degrees.

As used herein, the term "substantially 45 degrees" means 45 degrees +/−10%.

In some embodiments, in its second position (e.g., FIG. 13), the link 178 may extend in a direction that is pivotally offset from its first position by an angle in the range of 30 degrees to 60 degrees.

The location of the three shafts 240, 246, 248 or other types of pivots may be chosen such that with the lever 174 in its first position, the link 178 may also extend in (or at least substantially in) longitudinal directions 112 and/or longitudinal directions 128, and may be aligned with the lever 174. In some embodiments, the above may include arranging the three shafts 240, 246, 248 or other type pivots so as to be at least in part on a same line 254. In at least some embodiments, with the lever 174 in its second position, two of the shafts 240, 248 or other type pivots may remain disposed at least in part on the line 254.

In at least some embodiments, the binding system 104 has a latch state (e.g., FIG. 12) and a release state (e.g., FIG. 13). In at least some embodiments, the latch state operates as follows. The arms 142, 152, of the clamps 122, 124 are in a first position (e.g., FIG. 12) in which the jaws have a first lateral spacing and releasably retain the boot plate 106 to the binding plate 120, and the slide 164 is in a first position (e.g., FIG. 12). The solenoid 168 is in a first state (e.g., unpowered, FIG. 12) and the second end 230 of the plunger 170 is biased, by the spring 232 or other bias element, into contact with the abutment surface 244 of the lever 174. This prevent or otherwise limits pivoting movement of the lever 174 from the first position to the second position and may position the lever 174 so as to extend in (or at least substantially in) longitudinal directions 112 and/or longitudinal directions 128. The link 178 may also be positioned so as to extend in (or at least substantially in) longitudinal directions 112 and/or longitudinal directions 128. Such positioning of the lever 174 and/or the link 178 may force the slide 164 rearward, which may cause the abutment surfaces 190, 192 of the slide 164 to apply force to the abutment surfaces 200, 202, respectively, of the clamps 122, 124, respectively, to retain the arms 142, 152, respectively, of the clamps 122, 124 laterally inward and/or toward their first position.

In at least some embodiments, the release state operates as follows. The solenoid 168 is powered (energized) and the resulting magnetic field results in a force that counters the bias of the spring 232 or other bias element and pulls the plunger 170 out of contact with the lever 174, thereby allowing the lever 174 to pivot from its first position to its second position, in response to bias from the spring 176 or other bias element. As the lever 174 pivots, the portion 245 is displaced forwardly. The forward displacement causes the slide 164 coupled to the second end 252 of the link 178 to move toward a second position (e.g., FIG. 13) that is forward of the first position and in which the slide 164 applies force to the arms to force the arms 142, 152 toward their second position in which the jaws 146, 156 have a second lateral spacing greater than the first lateral spacing and in which the jaws 146, 156 are spaced apart from the boot plate. In at least some embodiments, the abutment surfaces 194, 196 of the slide 164 apply force to the abutment surfaces 204, 206, respectively, of the clamps 122, 124, respectively, which causes the arms 142, 152, respectively, of the clamps 122, 124 to pivot or otherwise move (laterally outward at least in part) toward their second position (e.g., FIG. 13).

In at least some embodiments, the binding system 104 may further include one or more additional solenoid, e.g., solenoids 280, 282 (which may be controlled by the control system 162) and/or one or more other bias element that is coupled to one or more portions of the binding system 104 to provide one or more additional force, e.g., force 284, 286, respectively, or other bias to supplement one or more force or other bias provided by the lever 174, spring 176 and/or link 178 to speed or otherwise assist in release of the boot plate 106 (and boot 108 attached thereto).

In at least some embodiments, the binding system 104 further includes a step-in closure.

In at least some embodiments, the binding system 104 may have a step-in closure as described above with respect to FIGS. 14-20.

Figure 14:
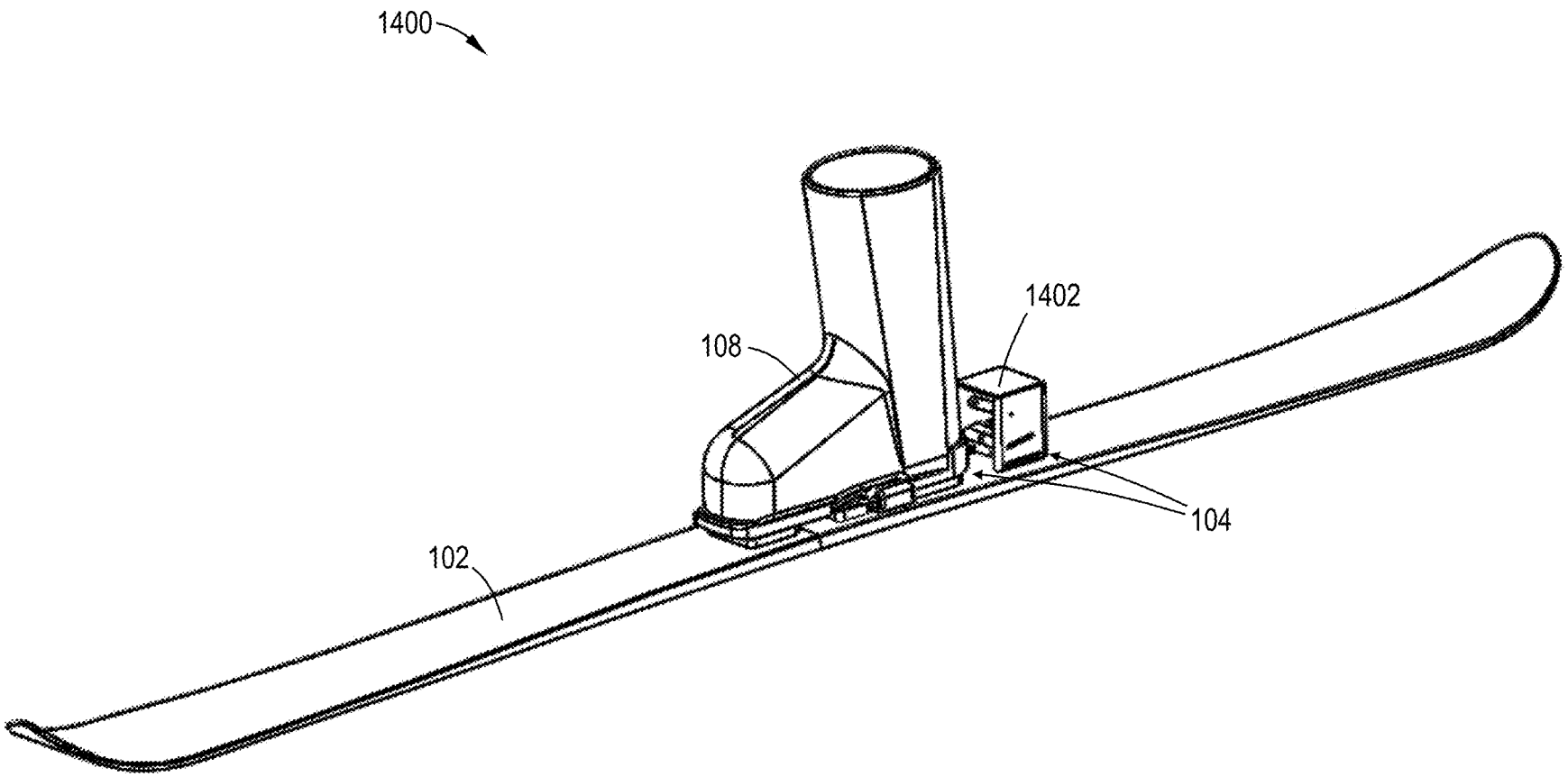
FIG. 14 is a perspective view of a system that includes a binding system, in a first state, in accordance with at least some embodiments.

FIG. 14 is a perspective view of a system 1400 that includes a binding system 104 having a step-in closure 1402, in a first state, in accordance with at least some embodiments.

Figure 15:
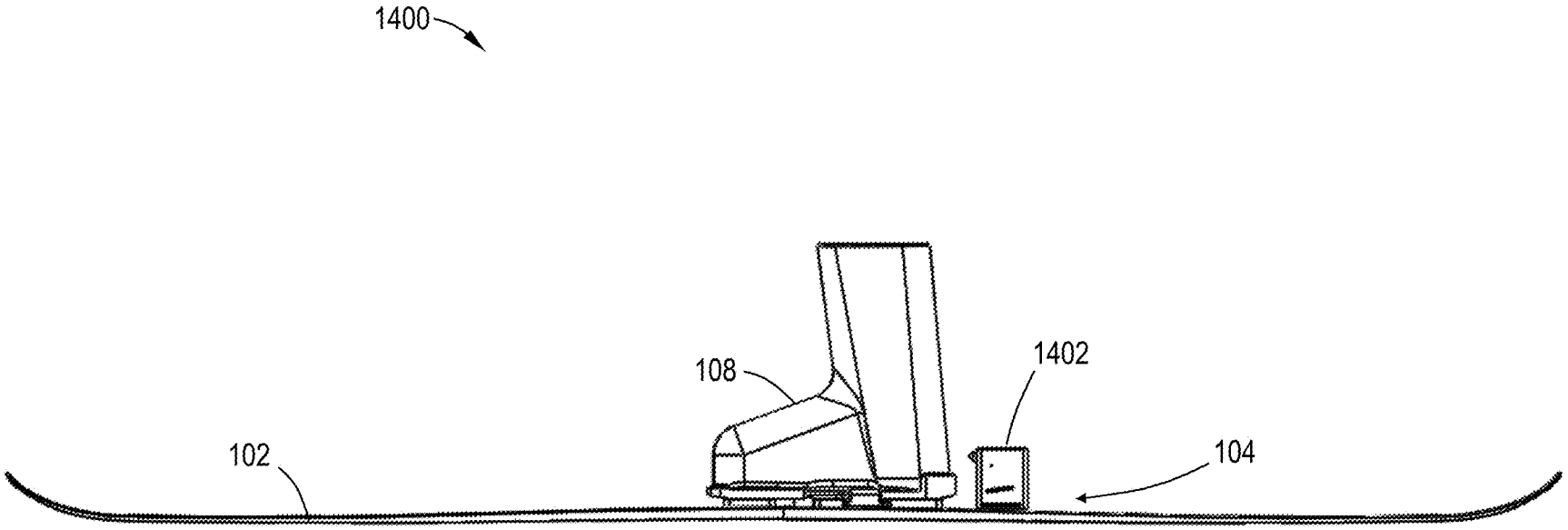
FIG. 15 is a side view of the system illustrated in FIG. 14, in accordance with at least some embodiments.

FIG. 15 is a side view of the system 1400 illustrated in FIG. 14, in accordance with at least some embodiments.

Figure 16:
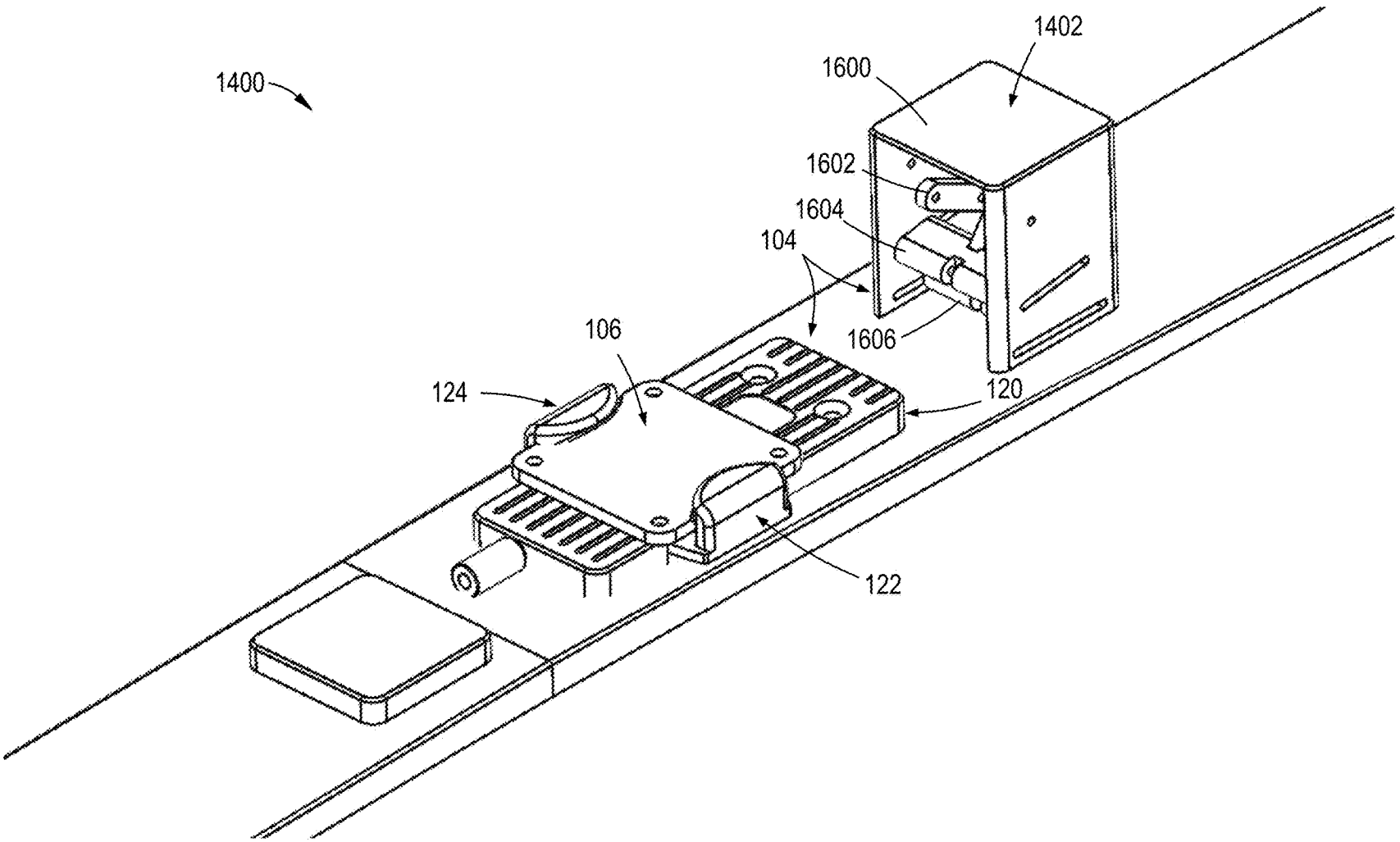
FIG. 16 is a perspective view of a portion of the system illustrated in FIG. 14, in accordance with at least some embodiments.

FIG. 16 is a perspective view of a portion of the system illustrated in FIG. 14, in accordance with at least some embodiments.

Figure 17:
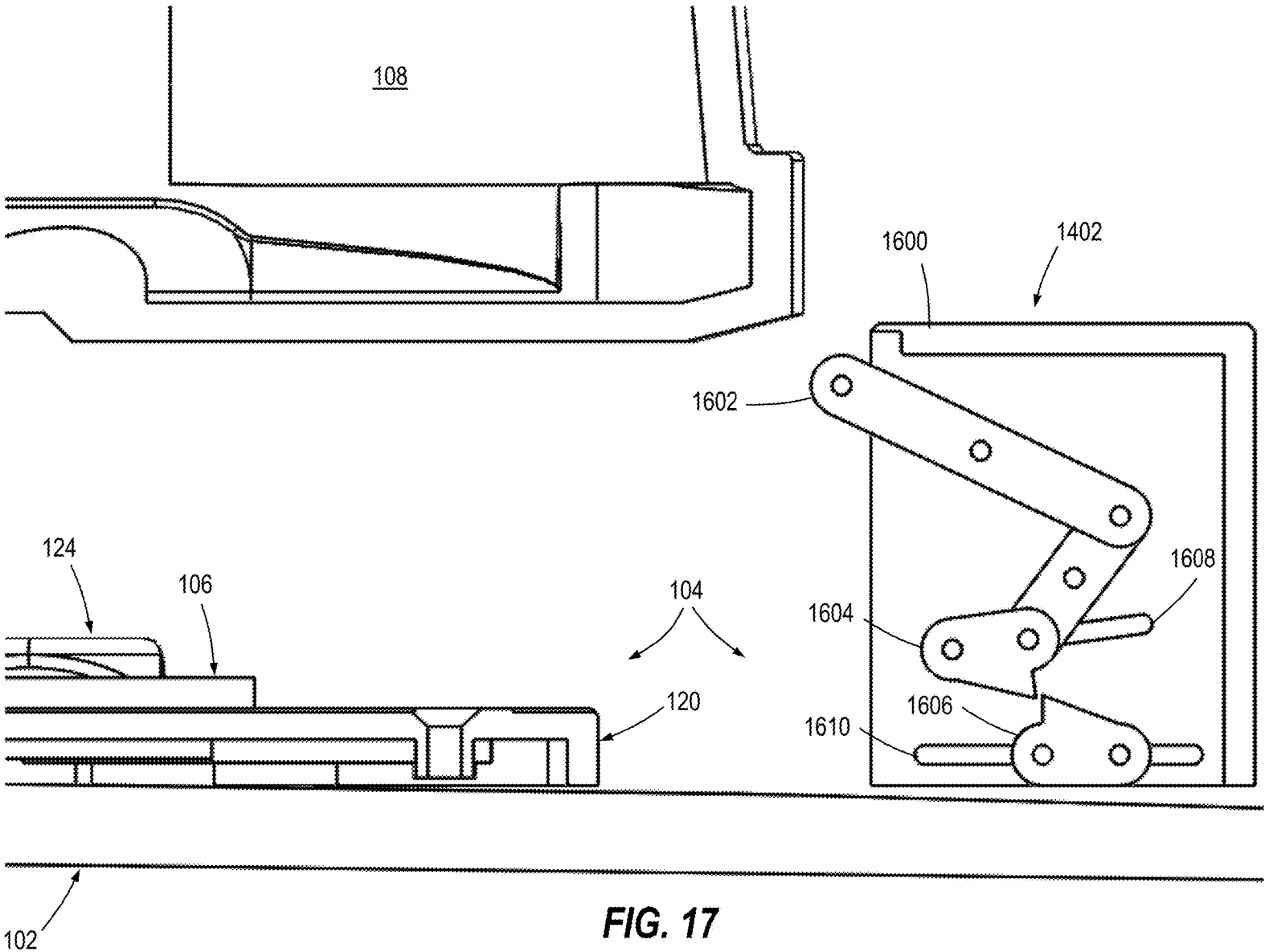
FIG. 17 is an enlarged side view of a portion of the system illustrated in FIG. 14, in a second state, in accordance with at least some embodiments.

FIG. 17 is an enlarged side view of a portion of the system illustrated in FIG. 14, in a second state, in accordance with at least some embodiments.

Figure 18:
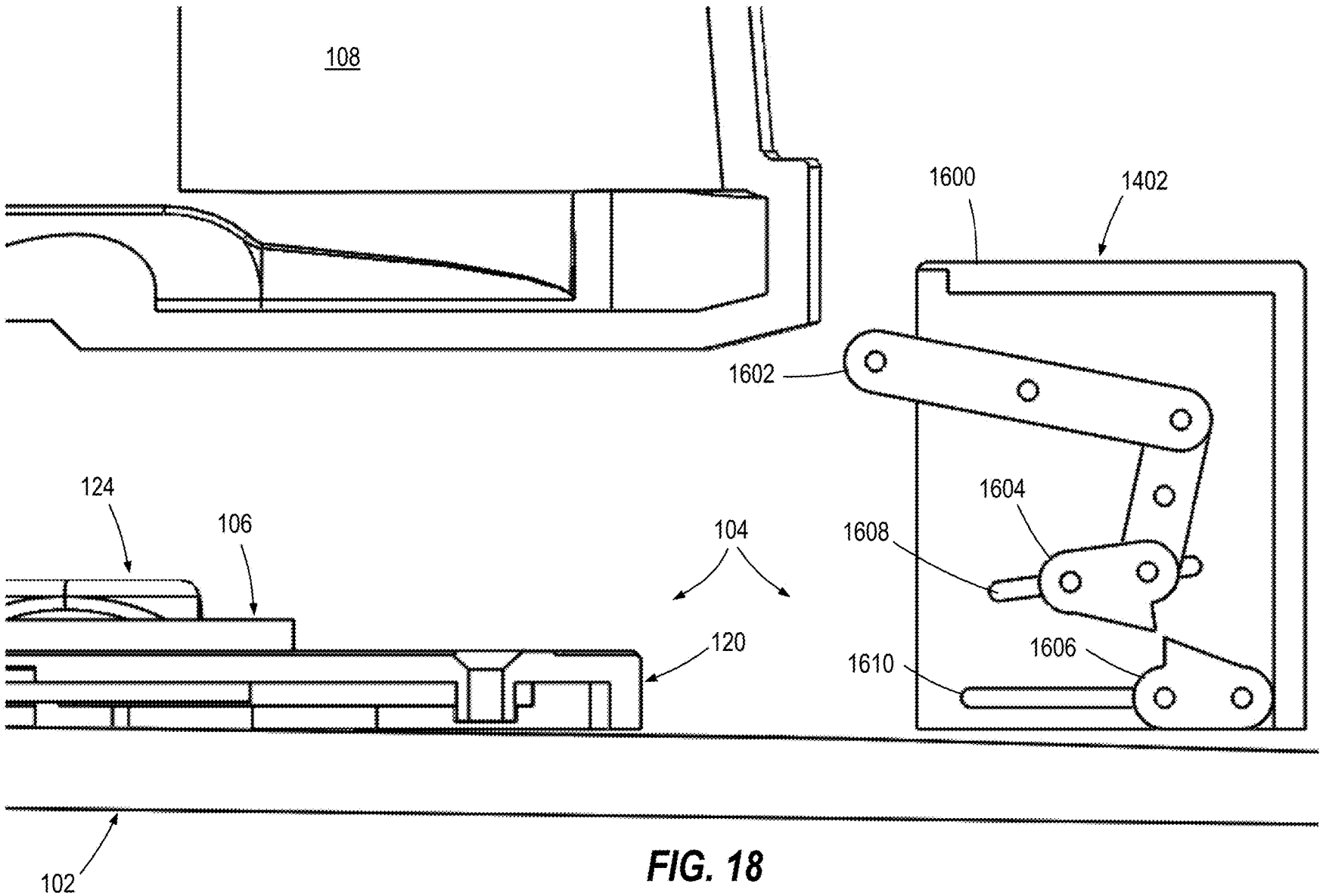
FIG. 18 is another enlarged side view of the portion of the system illustrated in FIG. 17, in accordance with at least some embodiments.

FIG. 18 is another enlarged side view of the portion of the system illustrated in FIG. 17, in accordance with at least some embodiments.

Figure 19:
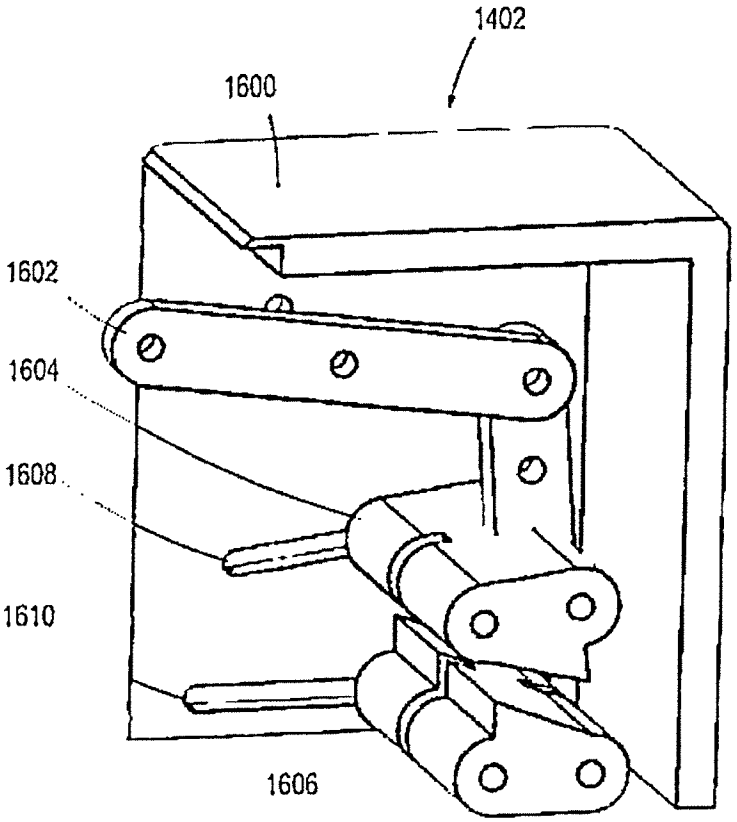
FIG. 19 is an enlarged perspective view of a step-in closure of the portion of the system illustrated in FIG. 17, in accordance with at least some embodiments.

FIG. 19 is an enlarged perspective view of a heel retainer of the portion of the system illustrated in FIG. 17, in accordance with at least some embodiments.

Figure 20:
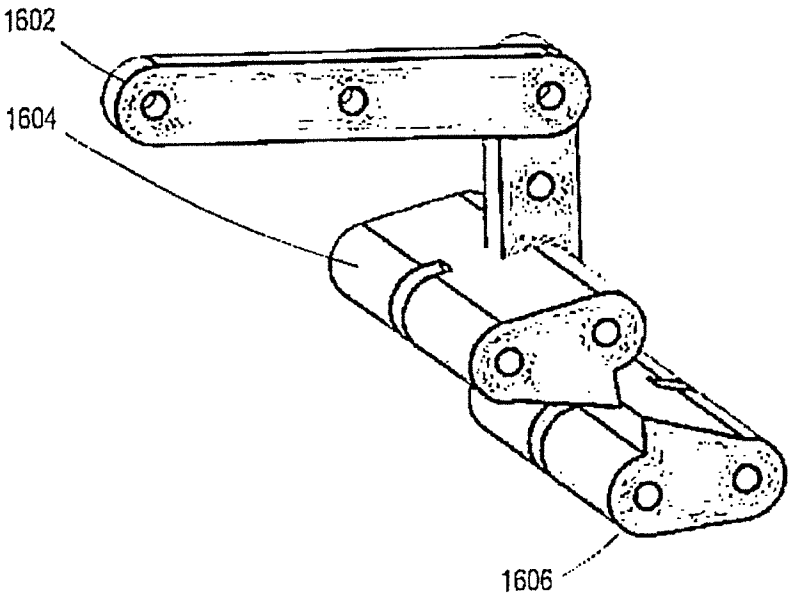
FIG. 20 is an enlarged perspective view of a portion of the step-in closure illustrated in FIG. 19, in accordance with at least some embodiments.

FIG. 20 is an enlarged perspective view of a portion of the heel lock illustrated in FIG. 19, in accordance with at least some embodiments.

Referring now to FIGS. 14-20, in accordance with at least some embodiments, a step-in closure 1402 is provided. The step-in closure may include an optional heel lock. The step-in closure generally may use the weight (downward force) of the skier to mechanically activate the illustrated set of linkages and seer assemblies (e.g., 1604, 1606, 1608, 1610) so as to retract a slidable fore-aft linkage 164 as shown, e.g., in FIG. 13. The result is that the side-locking jaws 142, 152 will then close upon the ski boot plate to secure the same in place (i.e., going from the open configuration of FIG. 13 to the closed configuration of FIG. 12). Those skilled in the art will appreciate that these exemplary embodiments can be modified to suit other configurations without departing from the scope of this invention.

In an aspect, a servo motor can be used to retract the slide 164 of FIGS. 12 and 13 instead of the mechanical step-in means described above. For example, a sensor or pressure switch or other actuator can determine a skier's proper step into the apparatus, which would electrically cause the retraction of slide 164 so as to engage and close the binding about the boot.

Some of the following embodiments are directed to a type of ski binding system, for affixing a skier's boot to a ski during use, that primarily uses controllable electromagnets and/or permanent magnets to hold the boot in place and negating electromagnets (operating counter to the permanent magnet's force) to release when appropriate. In a typical embodiment, the system consists of a binding, or one or more binding plates, that is/are mounted on the top of a ski, and a metal boot plate or plates that is/are mounted on the bottom of a ski boot. In an embodiment, the binding comprises a piece of somewhat stiff rubber or other similar material with a plurality of permanent electromagnets embedded therein. The permanent magnets turn off or turn on depending on whether a current is passed through them. The binding also comprises an electrical power source and microprocessor that are in electrical communication with the electromagnets, and that allow the electromagnets to be enabled or disabled. The binding system is intended to be used in lieu of conventional, mechanical ski binding systems, but in some embodiments may be used in conjunction with such systems.

Figure 21:
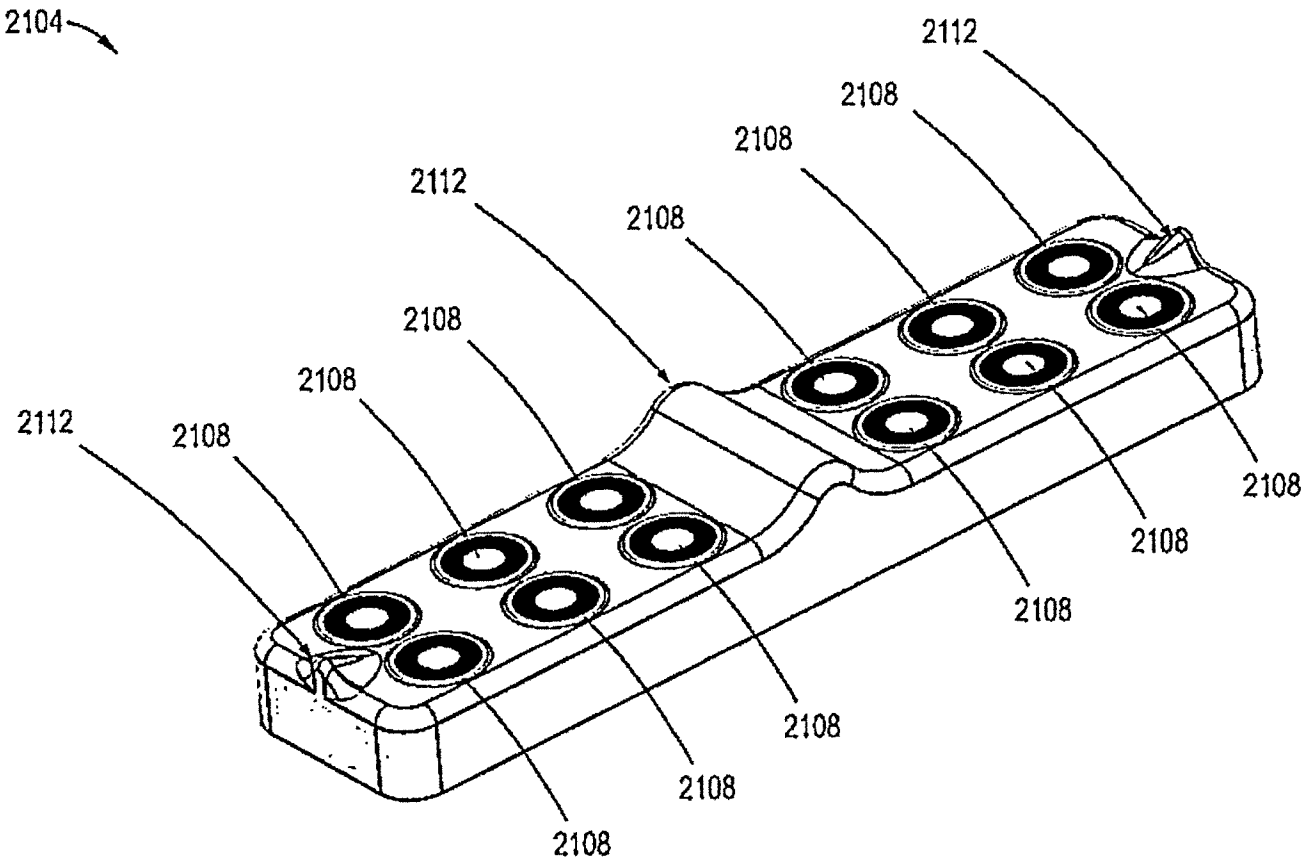
FIG. 21 is a perspective view of an exemplary binding embodying the invention disclosed herein.
Figure 22:
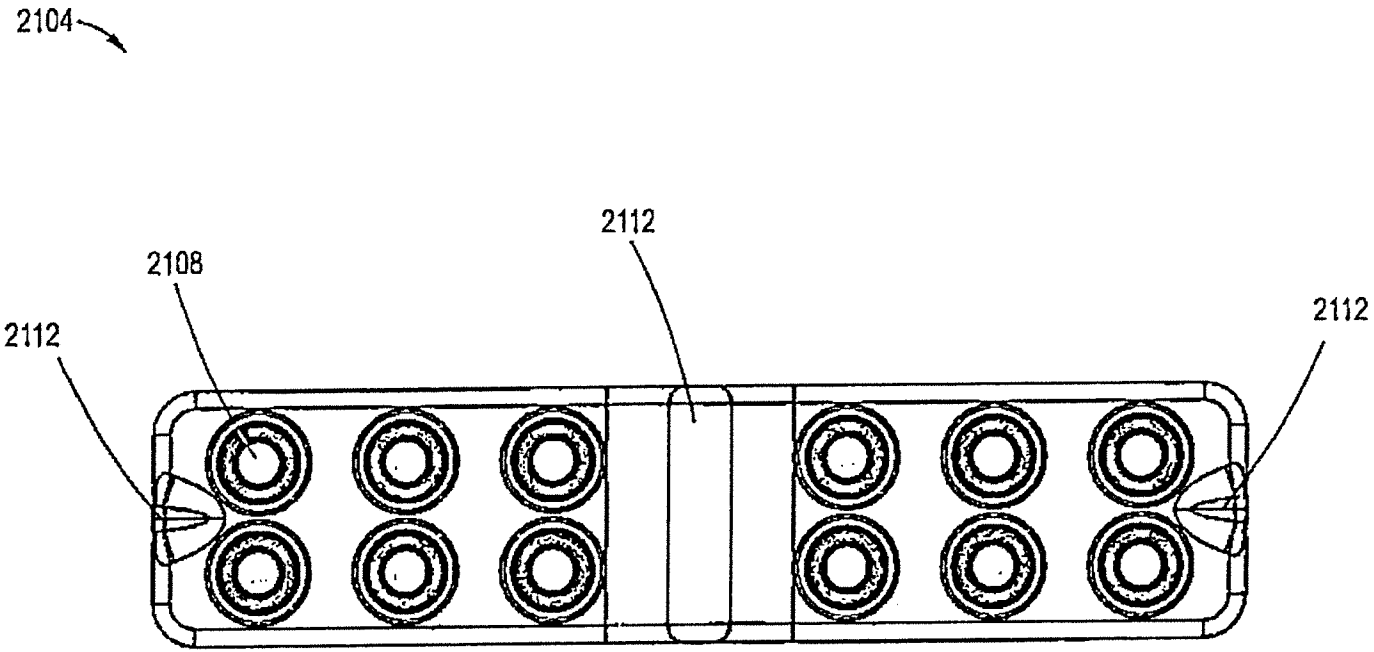
FIGS. 22 and 23 are top and side views of the binding illustrated in FIG. 21.
Figure 23:
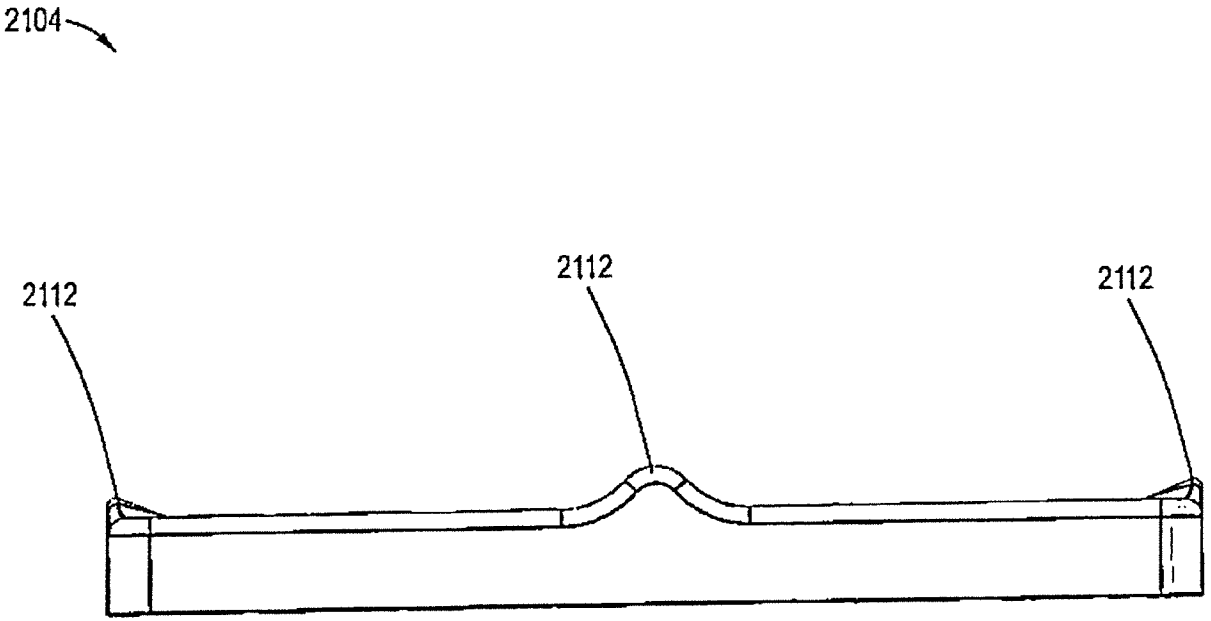

FIG. 21 illustrates, in perspective view, another binding 2104 according to at least some embodiments, with top and side views of the binding 2104 being shown in FIGS. 22 and 23, respectively. Note that drawings herein are for the purpose of illustrating the features of the technology disclosed herein, and are not necessarily drawn to scale. Twelve round electromagnets 2108 are visible on the top surface of the binding 2104. There are raised portions 2112 of the top surface at each end of the binding 2104 and at the center of the binding 2104. These surfaces (raised portions 2112) fit into equivalent negative surfaces, or indentations, on a metal plate (FIG. 26) that is attached to the bottom of a ski boot (e.g., FIG. 30) so as to locate the boot on the binding 2104 (and a ski (e.g., FIG. 24) on which the binding 2104 may be mounted) in a fore/aft direction, and prevent the boot from rotating on the binding 2104 (and a ski (e.g., FIG. 24) on which the binding 2104 may be mounted). These surfaces also combine with the tensile/attractive forces of the magnets to provide shear strength between the boot and the ski, allowing the skier to operate and steer the ski.

Although twelve round electromagnets 2108 are shown, in at least some embodiments, other quantities, shapes and/or sizes of electromagnets may be used. Additionally, although the electromagnets 2108 are shown in an array (2×6), in at least some embodiments, other arrangements of electromagnets may be used.

Figure 24:
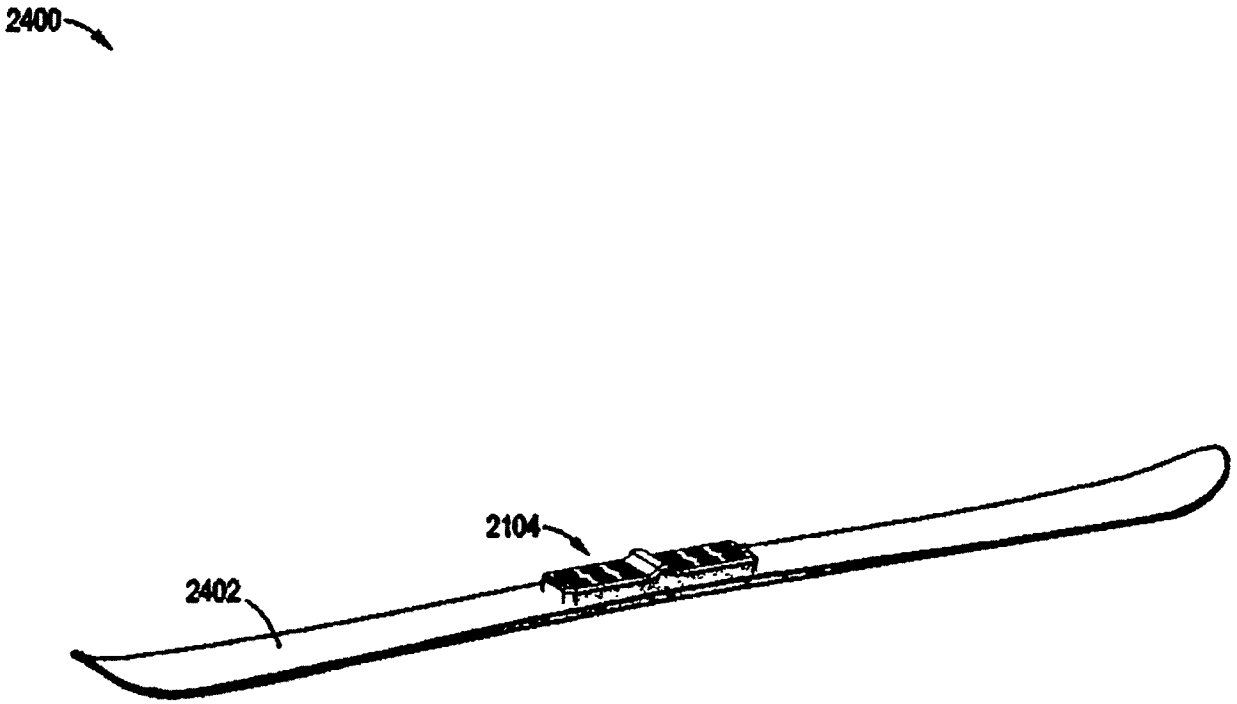
FIGS. 24 and 25 are perspective and top views, respectively, of a ski to which is affixed an exemplary binding embodying the invention disclosed herein.
Figure 25:
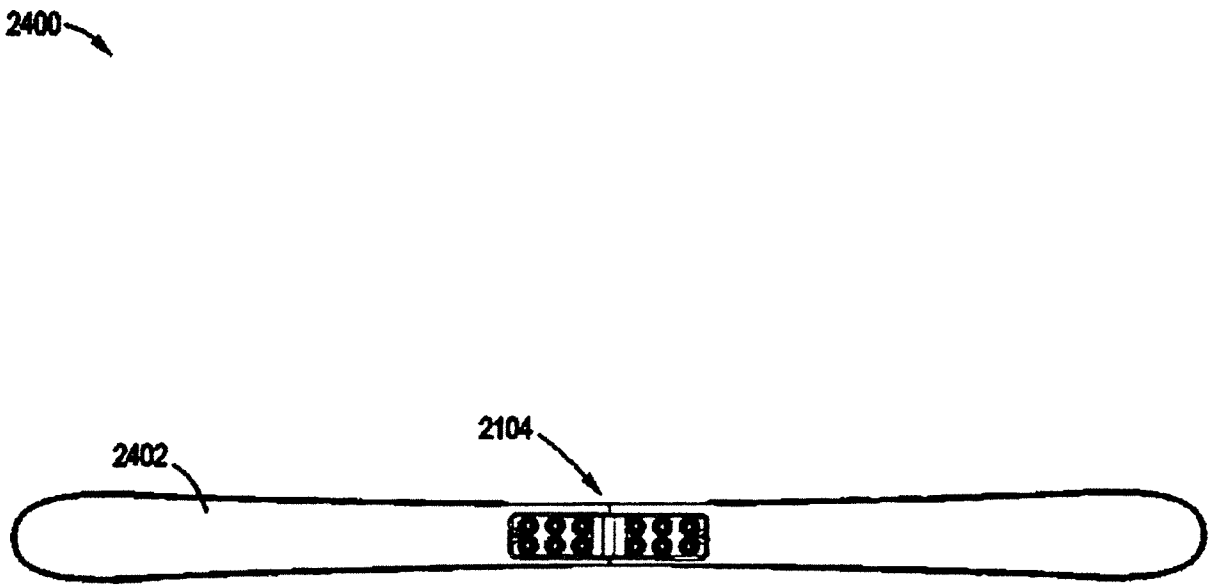
Figure 26:
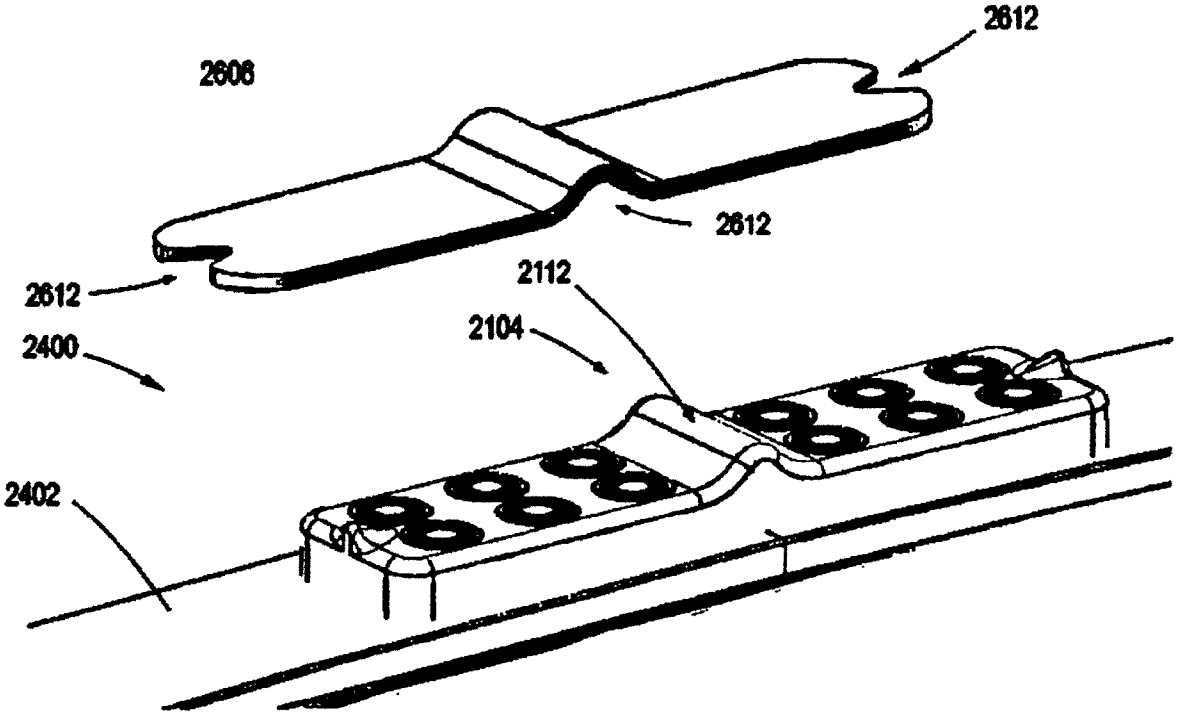
FIG. 26 is a detail view of the ski and binding illustrated in perspective view in FIG. 24, also showing, separately from the binding, an exemplary boot plate used as part of the binding system disclosed herein.

FIGS. 24 and 25 illustrate, in perspective and top views, respectively, a system 2400 that includes the exemplary binding 2104 of FIGS. 21-23 mounted in place on a ski 2402, in accordance with at least some embodiments. The binding 2104 can be mounted on the ski 2402 by screws or other permanent or non-permanent means of attachment. FIG. 26 shows an exploded view of a close-up of the mounted binding 2104 of FIG. 24 along with an exemplary boot plate 2606, to be attached to a ski boot (e.g., FIG. 30), in accordance with at least some embodiments. One can see the indentations 2612 at the ends of the boot plate 2606 and at the center of the boot plate 2606 which mate with the raised surfaces 2112 of the binding 2104.

Figure 27:
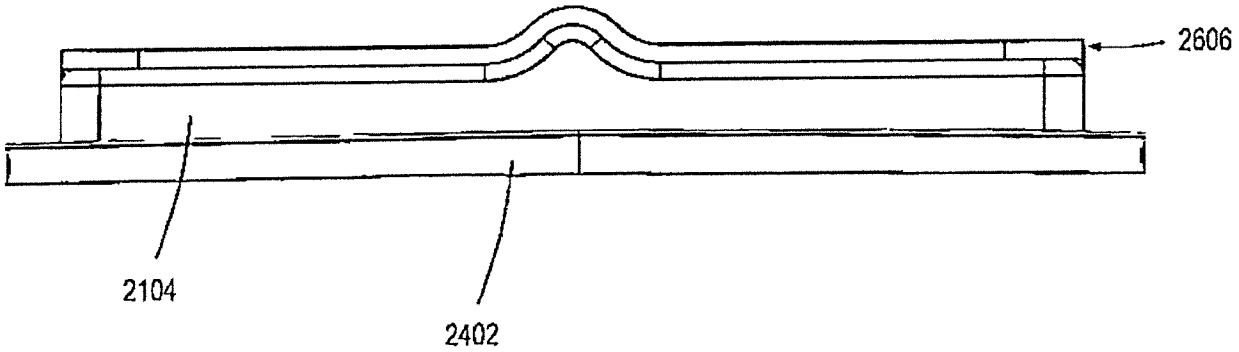
FIG. 27 is a side view of the binding and the part of the ski to which it is attached of FIG. 26, along with the boot plate of FIG. 26, with the boot plate positioned as it would be during use.
Figure 28:
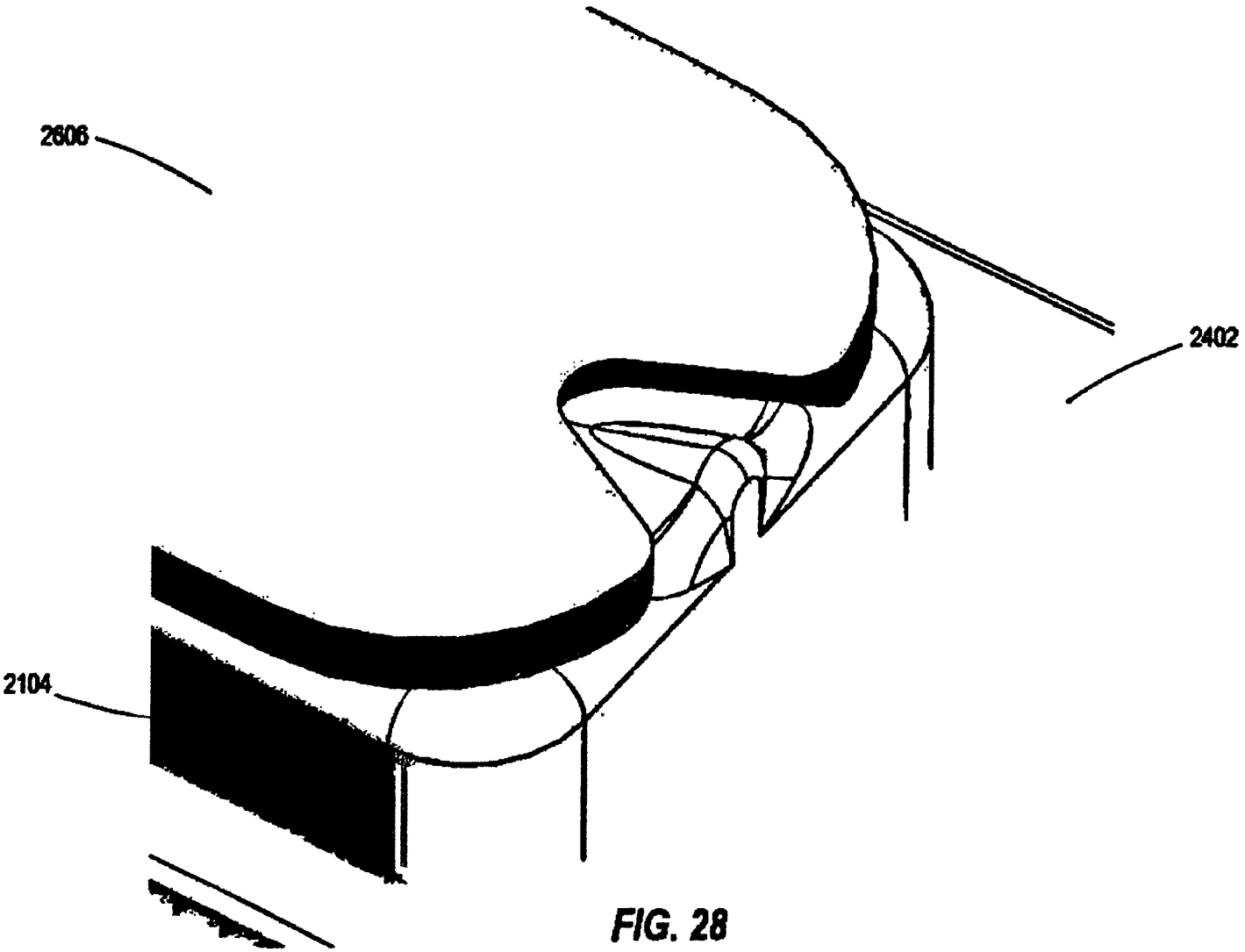
FIG. 28 is a close-up perspective view of one end of the binding and boot plate, positioned as it would be during use, of FIGS. 26-27.
Figure 29:
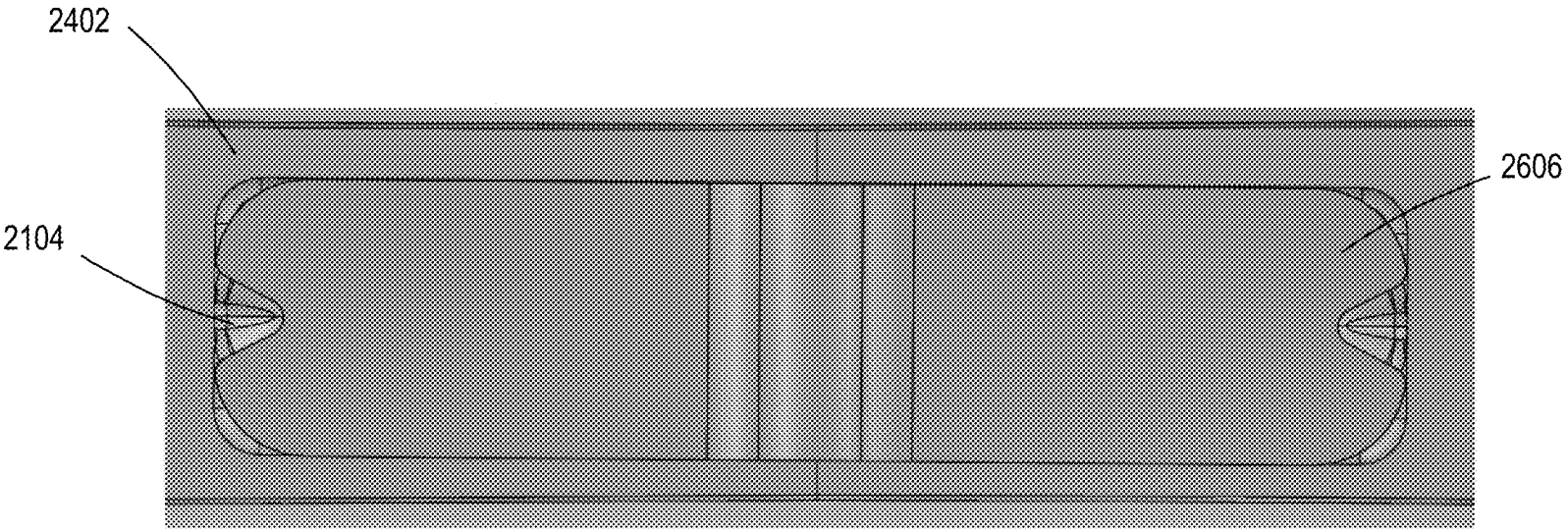
FIG. 29 is a top view of the boot plate of FIGS. 26-28, positioned in place on the binding.

FIG. 27 shows a side view of the binding 2104 and boot plate 2606 of FIG. 26, with the boot plate 2606 in place as it would be during use, in accordance with at least some embodiments. FIG. 28 shows in perspective view a close-up of one end of the binding 2104 and boot plate 2606 of FIG. 27, in which the raised surface and indentation at this end can be seen more clearly. FIG. 29 shows a top view of the binding and boot plate of FIG. 27.

The boot plate 2606 can be constructed of any ferromagnetic material of sufficient strength, preferably stamped steel. The boot plate 2602 can be attached to the bottom of a ski boot (e.g., FIG. 30) by screws or other similar means. The multiple magnets 2108 and raised surfaces 2112 are designed in such a way as to locate and hold the boot plate 2602 (and thus a ski boot attached thereto) in place during significant bending and unbending of the ski 2402 during use.

Figure 30:
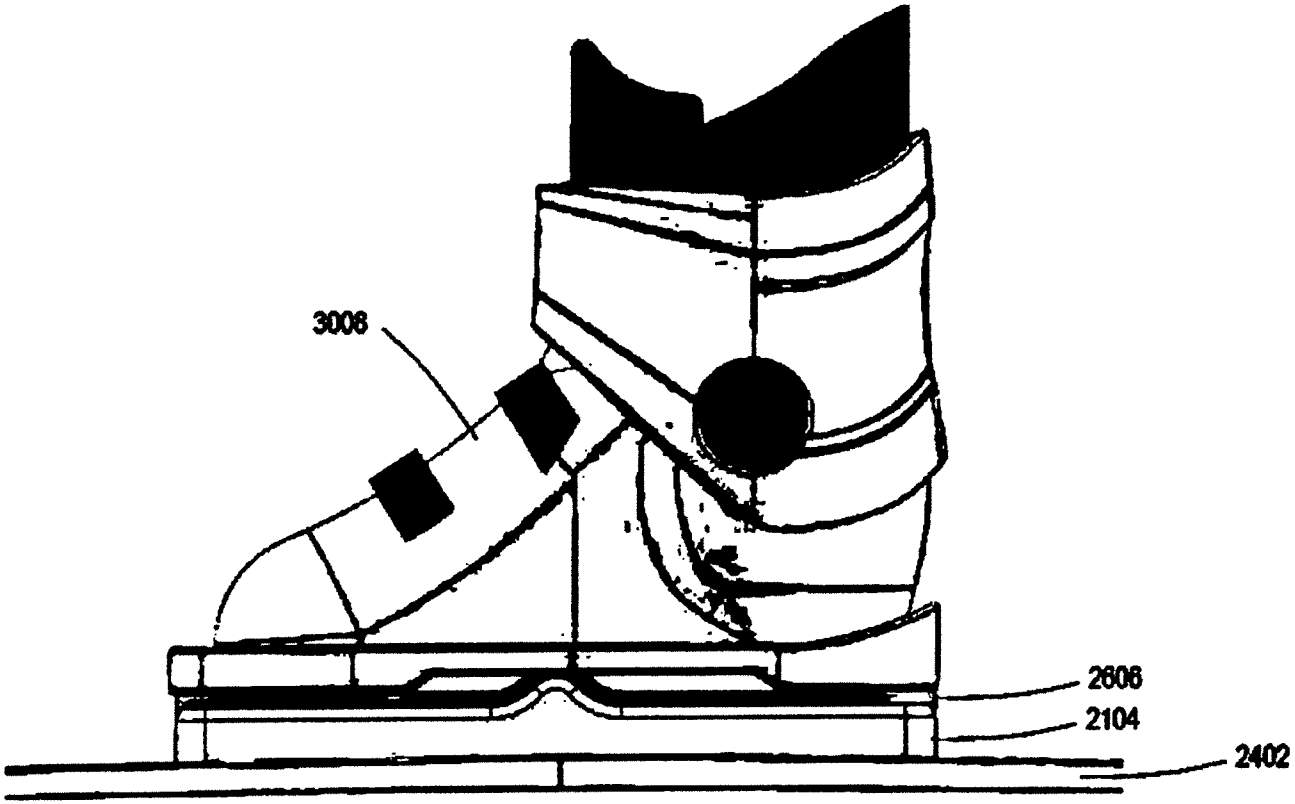
FIGS. 30-31 are side and perspective views, respectively, of a ski boot connected to a ski using a binding system in accordance with some embodiments of the invention disclosed herein.
Figure 31:
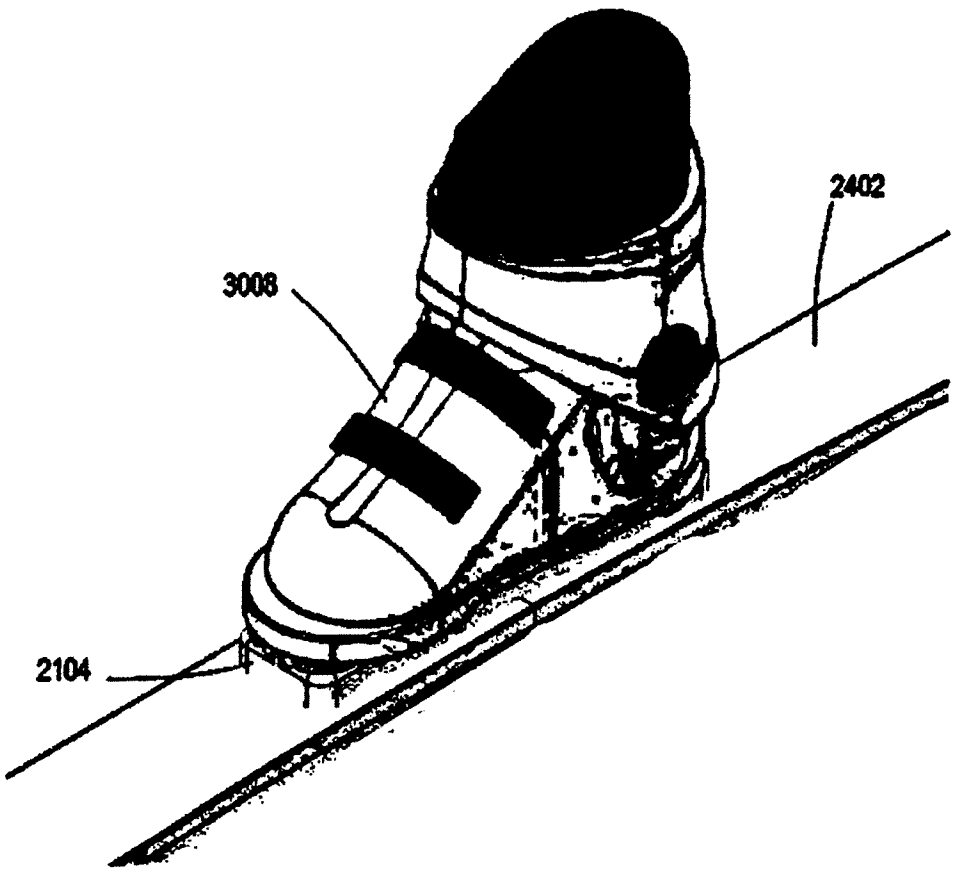
Figure 32:
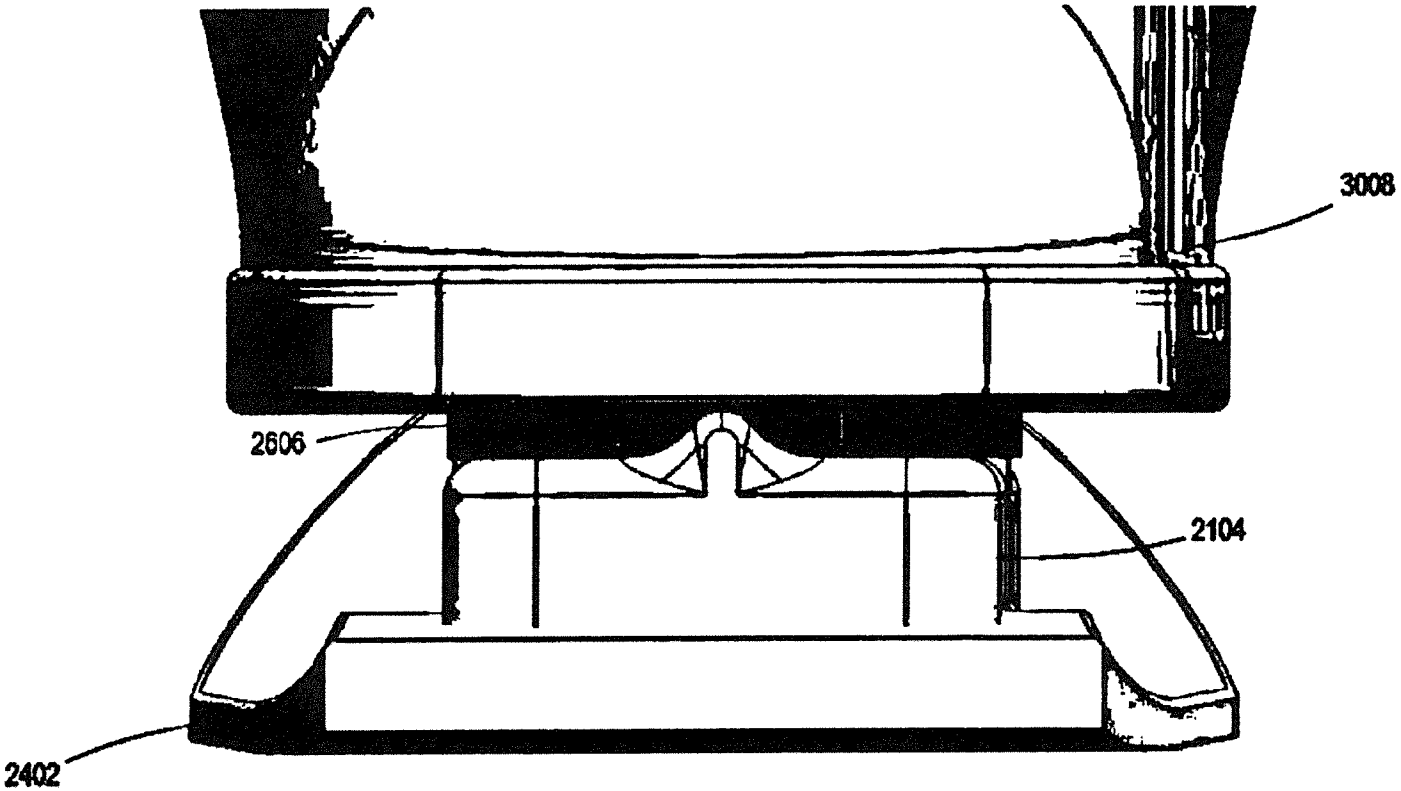
FIG. 32 is a close-up view, viewed from one end of the boot, of the boot and ski and binding system illustrated in FIGS. 30-31.
Figure 33:
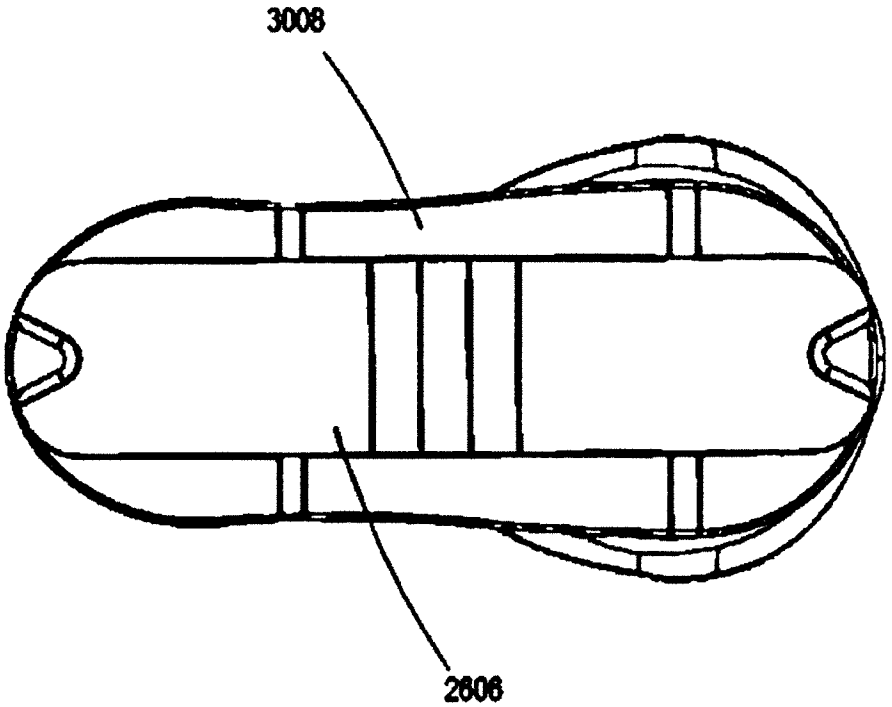
FIGS. 33-34 are bottom and perspective views, respectively, of a ski boot to which a boot plate has been affixed, in in accordance with some embodiments of the invention disclosed herein.
Figure 34:
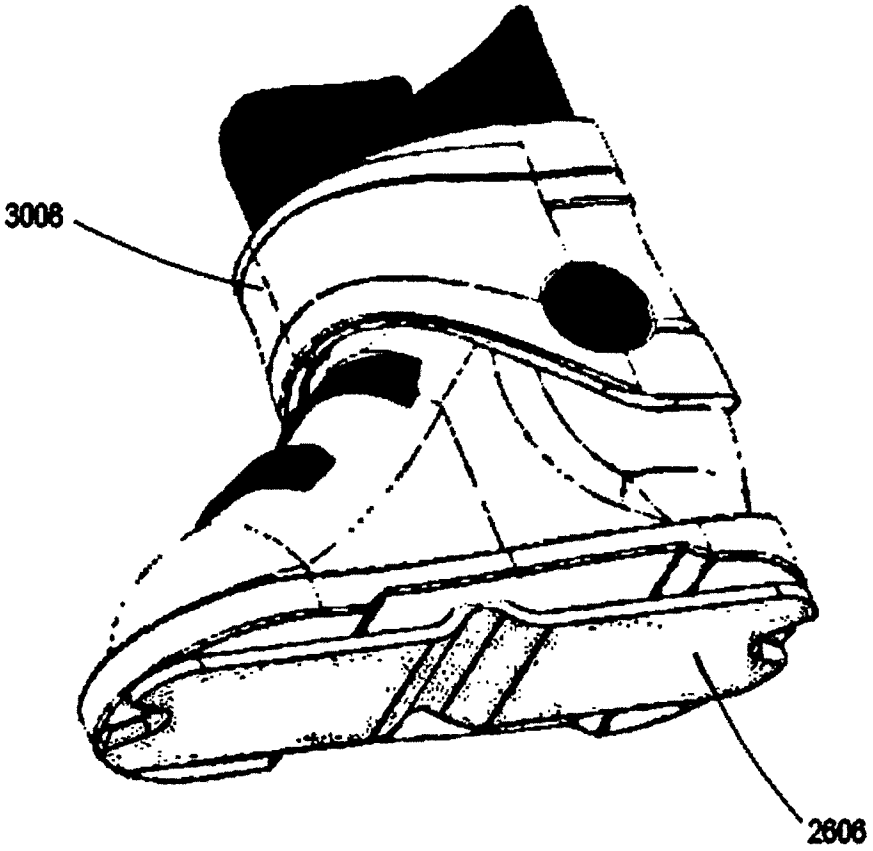

FIGS. 30 and 31 illustrate, in side and perspective views, respectively, an exemplary binding 2104 and boot plate 2606 according to at least some embodiments of the invention, with the boot plate 2606 mounted to the bottom of a ski boot 3008, with the boot 3008 and boot plate 2606 mounted on the binding 2104, and with the binding 2104 affixed to a ski, e.g., the ski 2402. FIG. 32 shows a close-up perspective view of the boot 3008, the boot plate 2606, the binding 2104 and the ski 2402 (shown in cutaway view) of FIGS. 30-31, viewed from the rear. FIGS. 33 and 34 illustrate, in bottom and perspective views respectively, a ski boot 3008 with an exemplary boot plate 2606, according to at least some embodiments of the invention, mounted to the bottom of the boot 3008.

Figure 35:
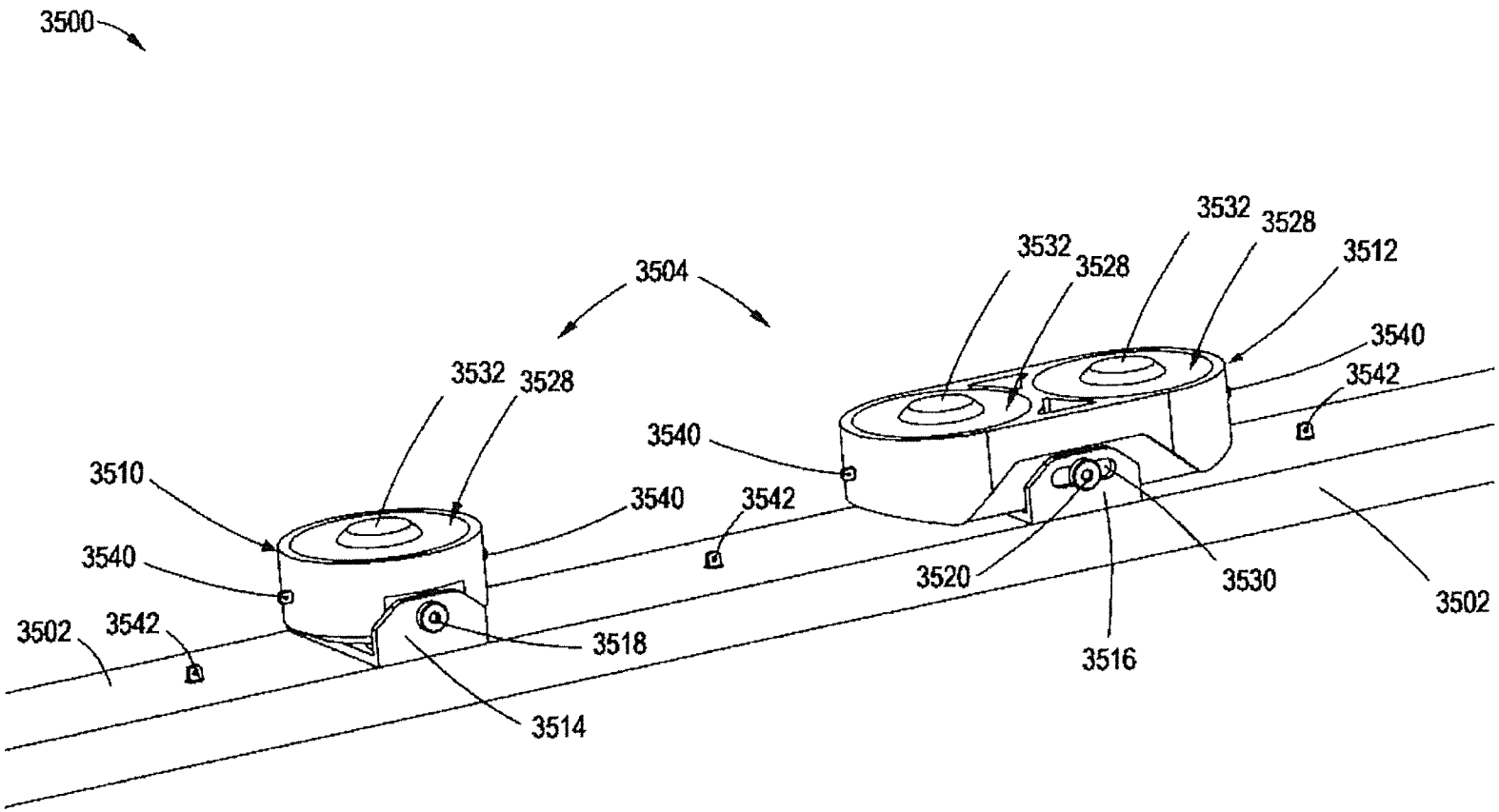
FIGS. 35-36 are two photographs of a prototype binding and boot plate embodying the technology disclosed herein.
Figure 36:
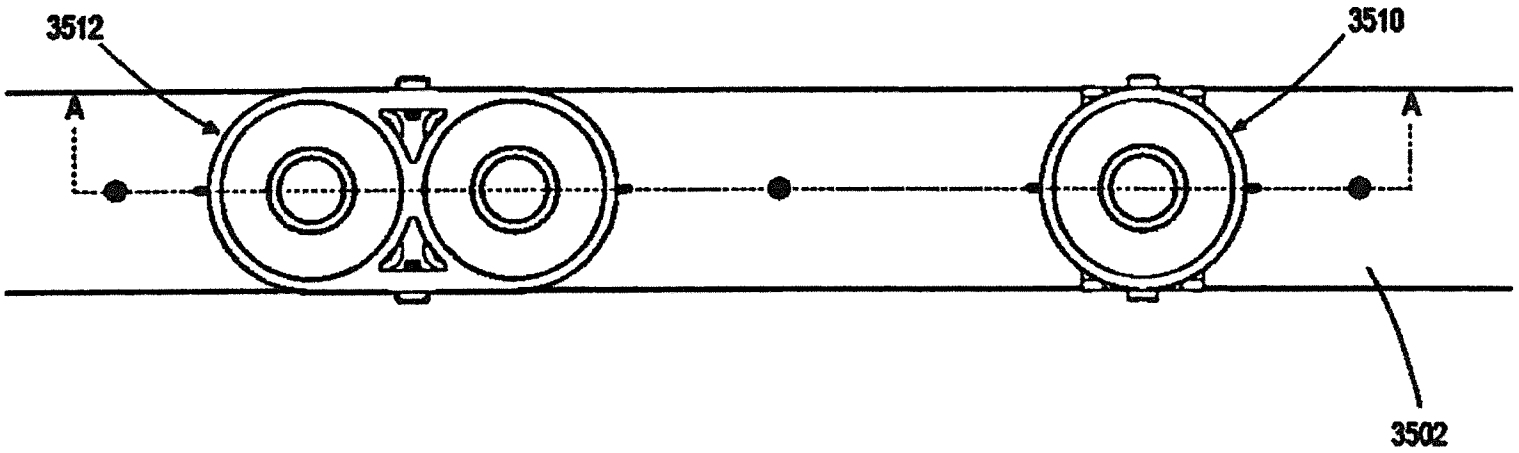
Figure 37:
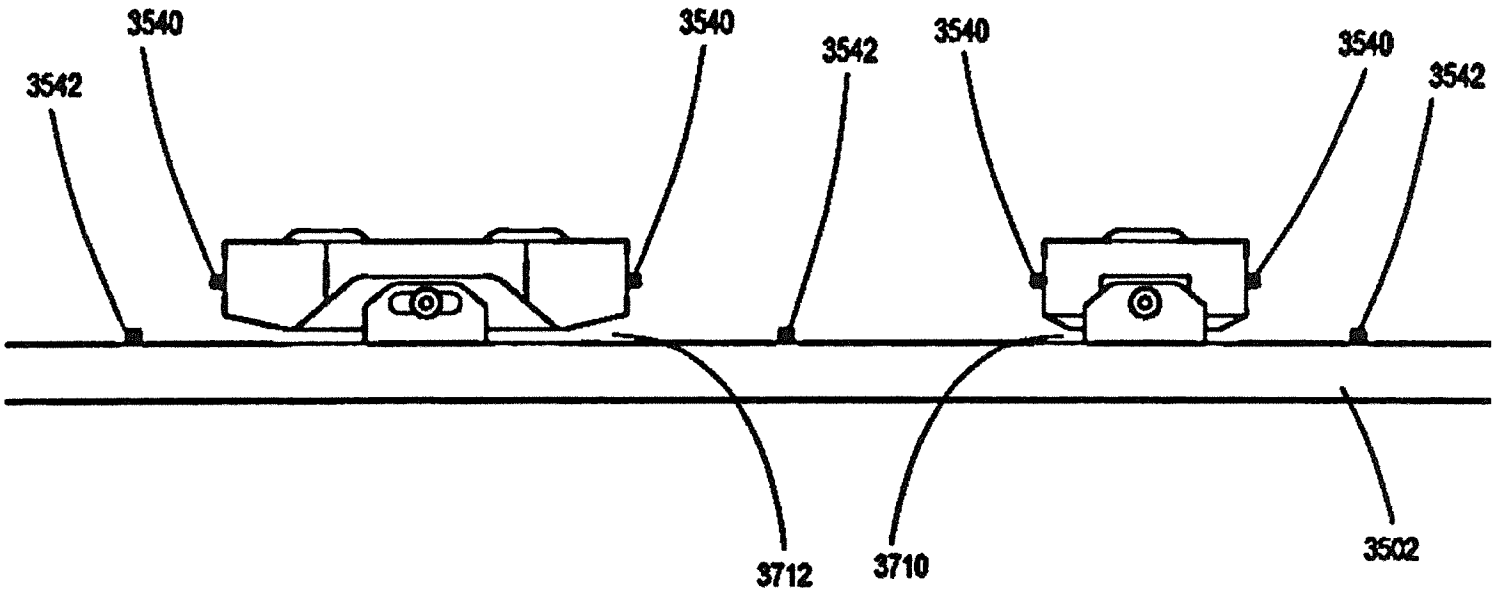
FIGS. 37-54 illustrate yet other embodiments and features of some embodiments of the present invention.
Figure 38:
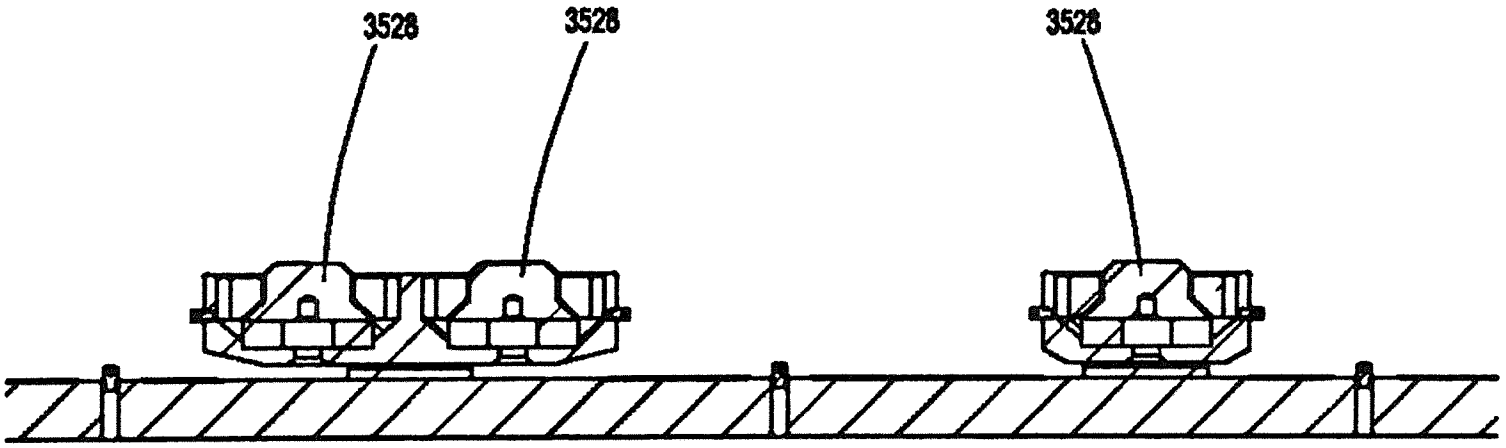

FIGS. 35-38, in perspective, top, side and sectional views, respectively, show a system 3500 that includes another exemplary binding 3504 mounted on a ski 3502 according to at least some further embodiments of the invention. As indicated in FIG. 35, the binding 3504 consists of two parts, a toe plate 3510 and a heel plate 3512 (each, a type of binding plate), each of which is attached to the ski 3502 via a rigid mounting bracket 3514, 3516, respectively, and a mounting bolt 3518, 3520 that passes through the binding plate. The toe plate 3510 contains a controllable electromagnet 3528, and the heel plate 3512 contains two controllable electromagnets 3528; in some embodiments, the electromagnets 3528 may be permanent electromagnets; in some embodiments, the electromagnets may be accompanied by permanent magnets.

Although three round electromagnets 3528 are shown and described, in at least some embodiments, other quantities, shapes and/or sizes of electromagnets may be used. Additionally, although the electromagnets 3528 are shown in an array (1×3), in at least some embodiments, other arrangements of electromagnets may be used.

Only one sided of the binding plates 3510, 3512 can be seen in FIG. 35, but the binding plates 3510, 3512 and their mounting hardware are essentially symmetric with respect to the center plane of the skis. Each binding plate 3510, 3512 is mounted to its mounting bracket 3514, 3516, respectively, so as to leave a space 3710, 3712 (FIG. 37) between the plate 3510, 3512 and the bracket 3514, 3516, respectively, allowing the binding plate 3510, 3512 to pivot about its mounting bolt 3518, 3520, respectively, within the range of motion permitted by the distance between the bottom of the binding plate 3510, 3512 and its mounting bracket 3514, 3516, respectively. The toe plate's 3510 mounting bolt 3518 extends through circular holes (not shown) on either side of its mounting bracket 3514, while the heel plate's 3512 mounting bolt 3520 extends through oblong slots 3530 on either side of its mounting bracket 3516, allowing the heel plate 3512, along with its mounting bolt 3520, to translate forward and backward within the range of motion permitted by the length of the slots 3530, in addition to pivoting about the mounting bolt 3520.

The ability of the binding plates 3510, 3512 to pivot and translate permits the binding plates 3510, 3512 to maintain good contact with a ski boot while the ski 3502 flexes during use. Such flexing changes the distance between the mounting brackets 3516, 3518 for the toe plate 3510 and the heel plate 3512, as well as the angle between them. A conventional, mechanical ski binding system typically has a forward pressure spring that keeps the toe of the boot pressed forward into front toe latch. Since the toe and heel mechanisms in such systems are rigidly attached to the ski, the ski's flexing during use pushes these mechanisms together and pulls them apart, which can result in premature release, particularly during conditions of high flexing, such as bumpy terrain, or racing conditions, and so forth. In the present ski binding system 3504, by allowing the binding plates 3510, 3512 to pivot and the heel plate 3512 to translate, the binding plates 3510, 3512 can maintain full contact with the underside of the boot (which is much more rigid than the ski) at all times while the ski 3502 flexes.

Figure 39:
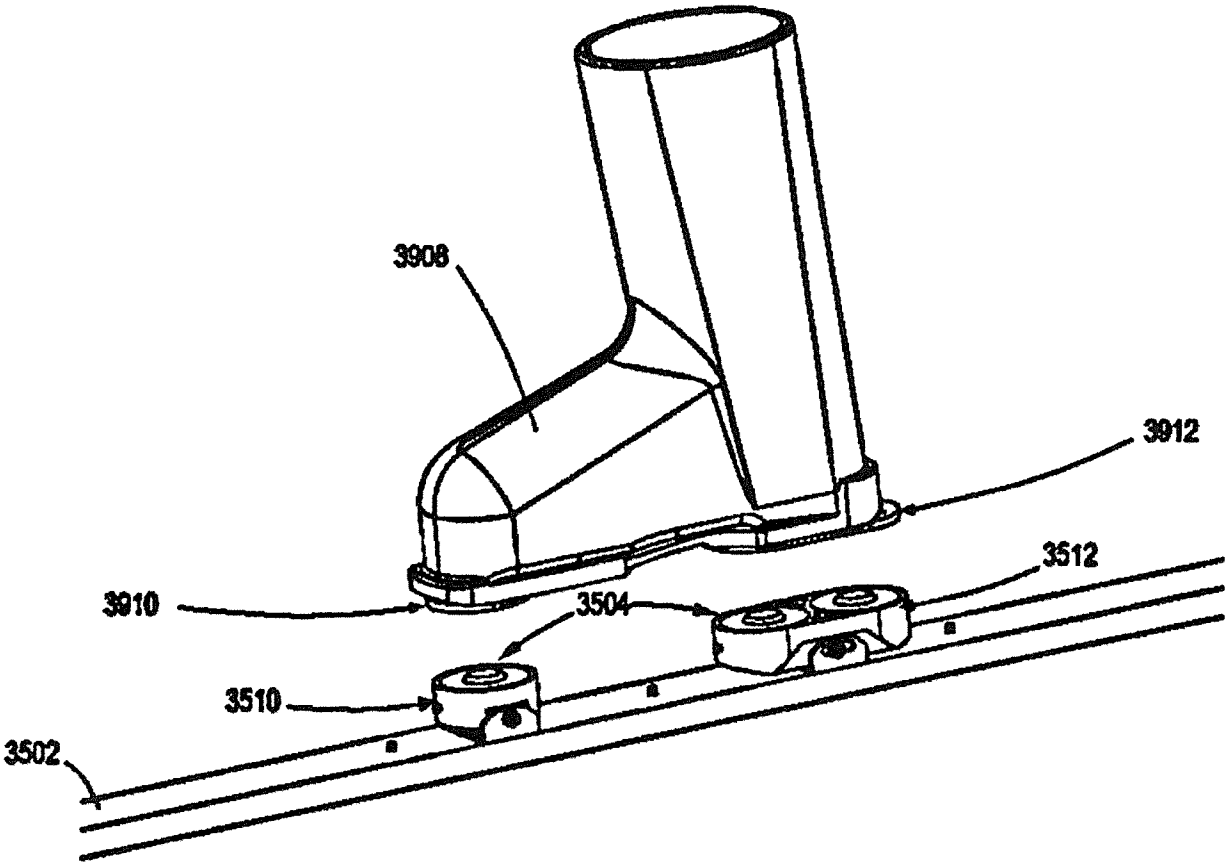

The top surfaces of the binding plates 3510, 3512 depicted in FIGS. 35-38 have raised portions 3532 in the center, which mate with similarly-sized cutouts or indentations (e.g., indentations similar in one or more respects to indentations 5422 (FIG. 54)), in metal boot plates 3910, 3912 (FIG. 39), respectfully, that are mounted to the underside of the ski boot 3908 (FIG. 39). Each binding plate 3510, 3512 has mounted to it two spring attachment points 3540, on each of the front and rear surfaces, and the top surface of the ski also has spring attachment points 3542 mounted thereto, fore and aft of each of the binding plates 3510, 3512.

Figure 40:
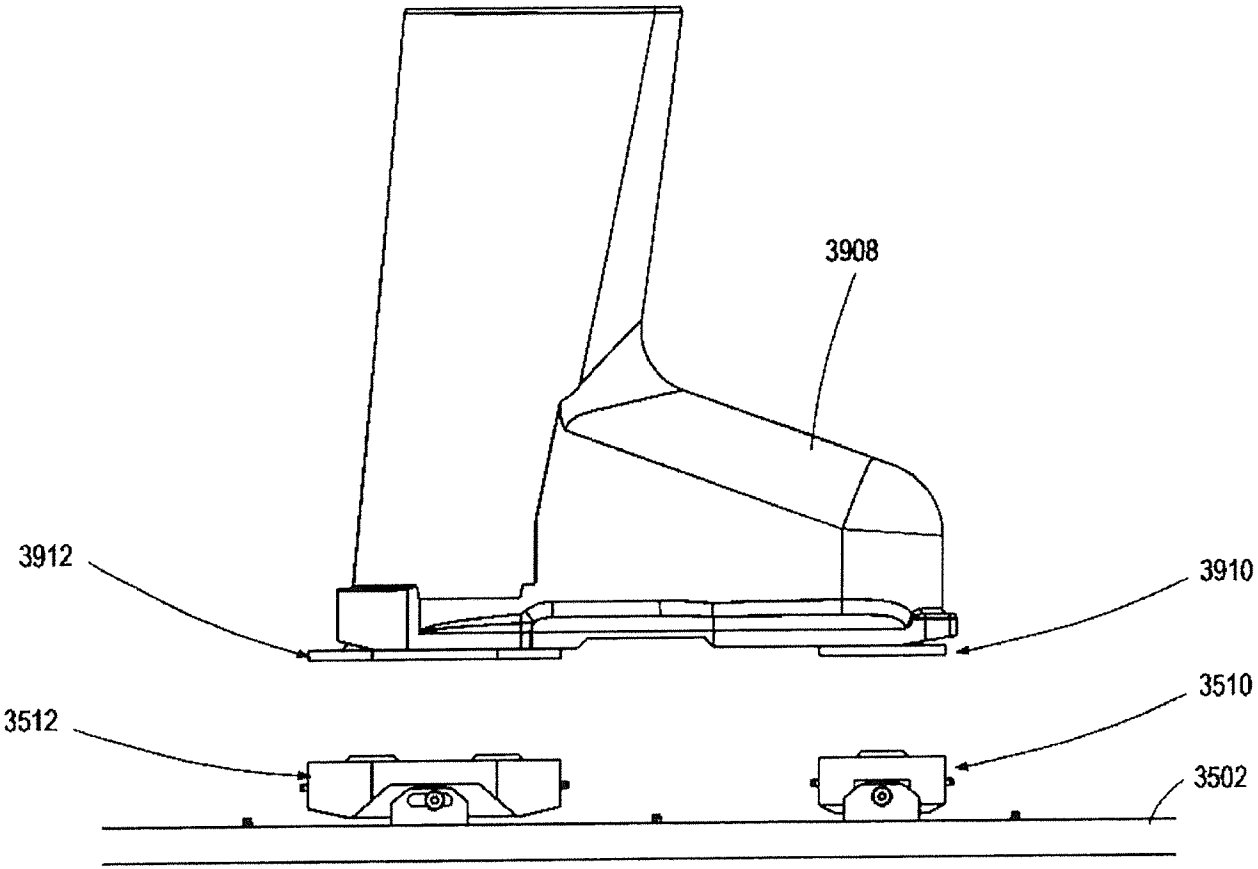
Figure 41:
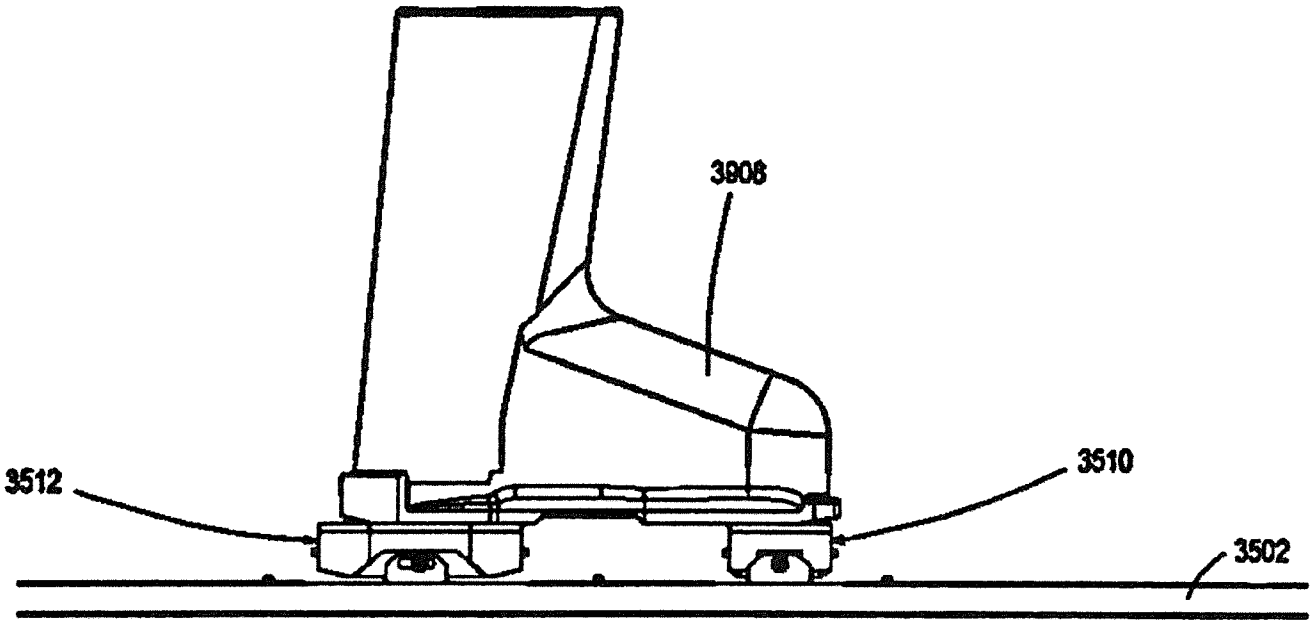
Figure 42:
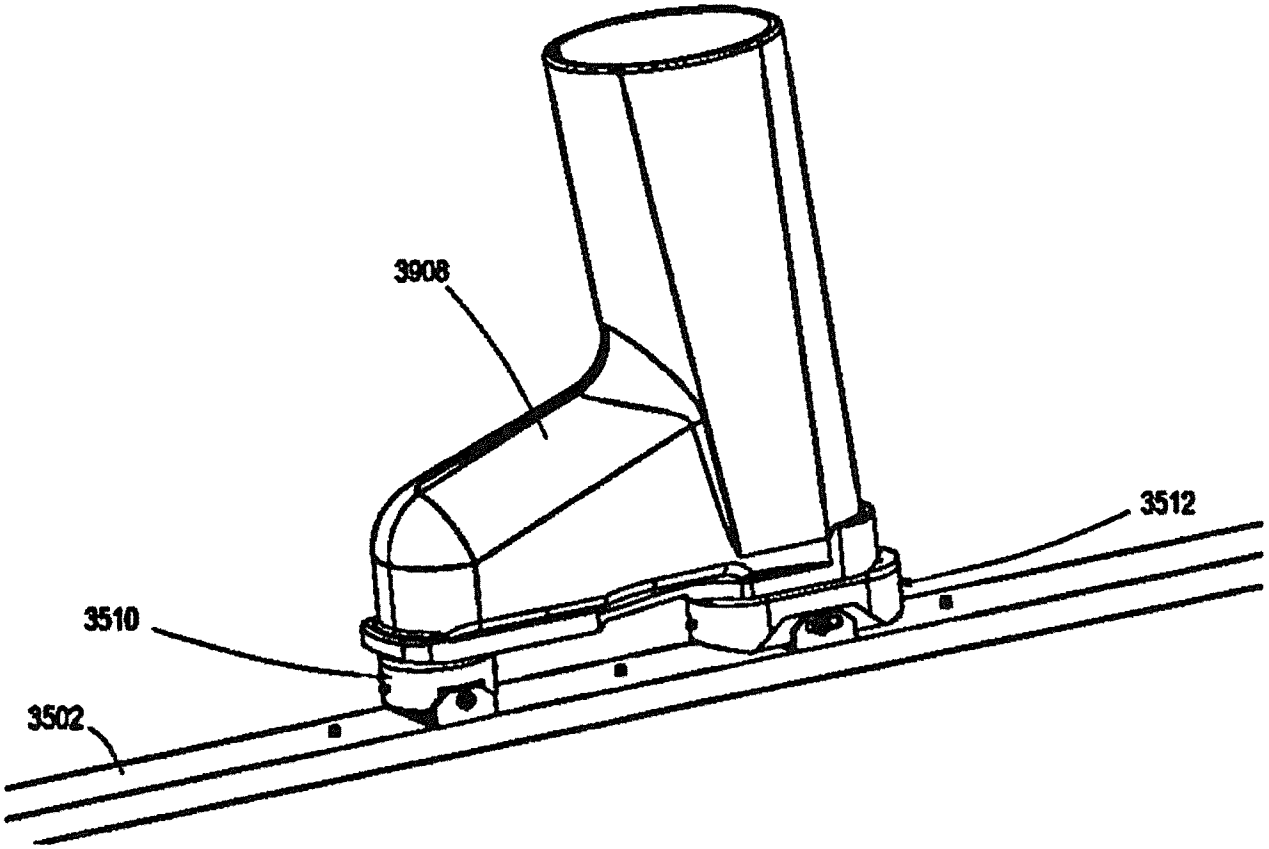

FIGS. 39 and 40 illustrate, in perspective and side views, respectively, the binding system of FIGS. 35-38, along with a ski boot 3908 positioned above the binding system 3504, as it would be positioned just before engaging with or just after disengaging with the binding system 3504. As indicated in FIGS. 39-40, attached to the bottom of the boot 3908, in front and in back, are metal boot plates 3910, 3912 that are designed to engage with the top surfaces of the toe plate 3510 and heel plate 3512, respectively, of the binding system. FIGS. 41 and 42 illustrate, in side and perspective views, respectively, the boot and binder system of FIGS. 39-40 with the boot 3908 engaged with the binding 3504 as it would be during use.

Figure 43:
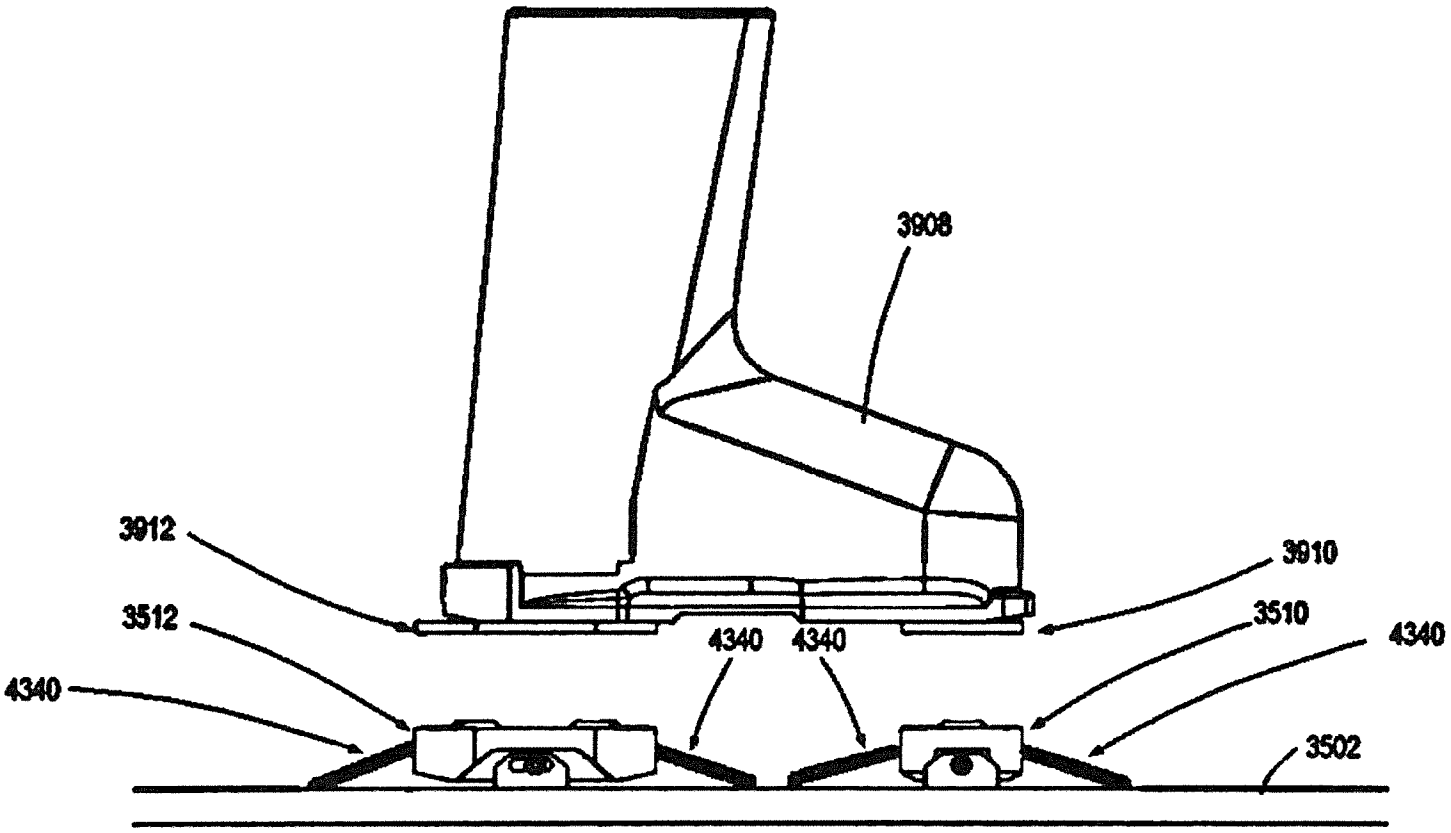
Figure 44:
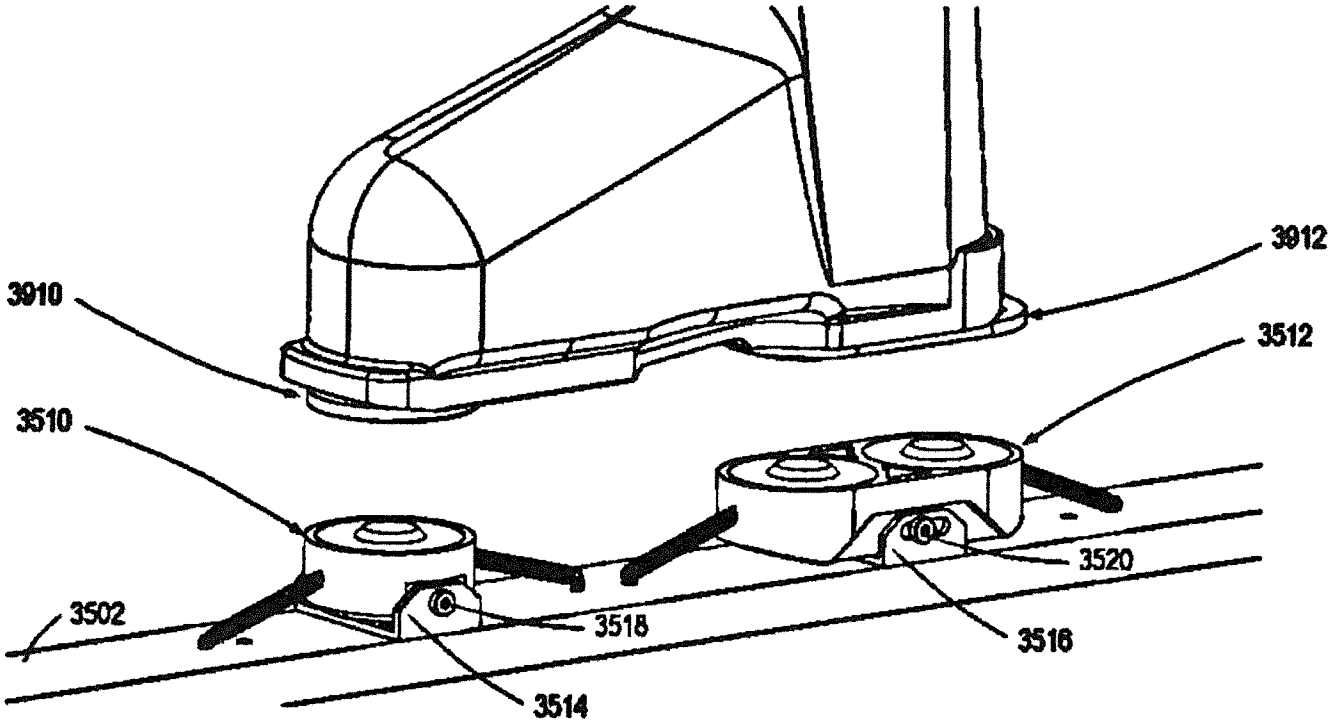
Figure 45:
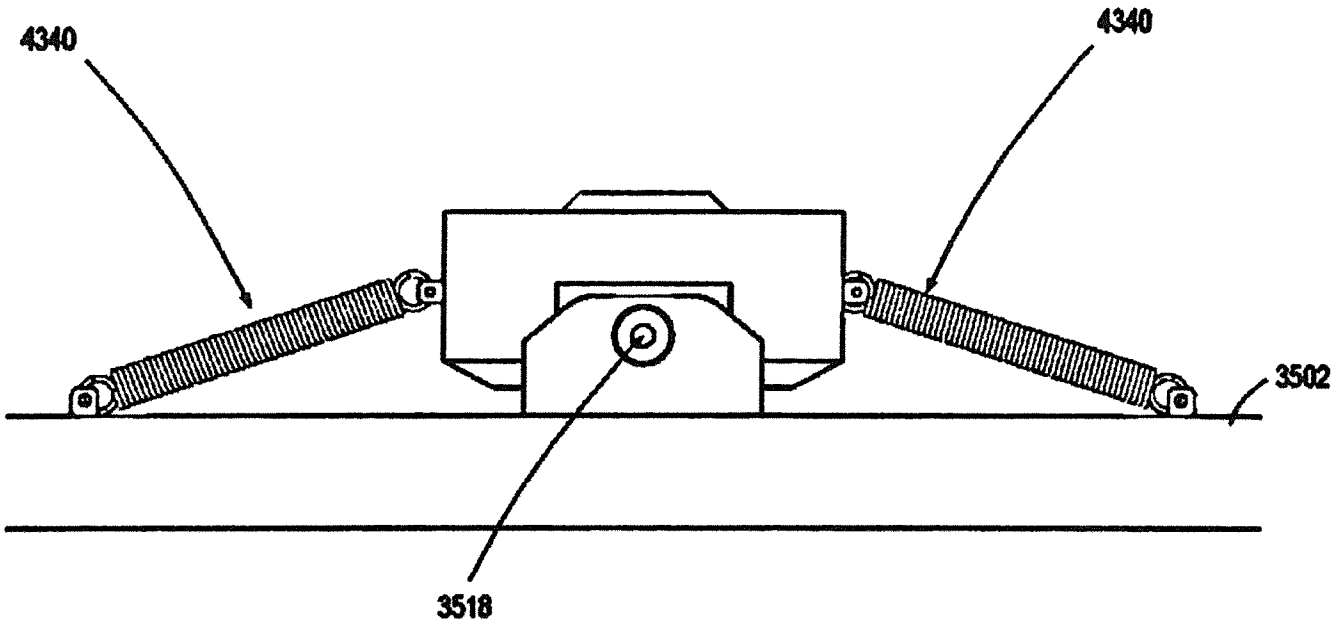
Figure 46:
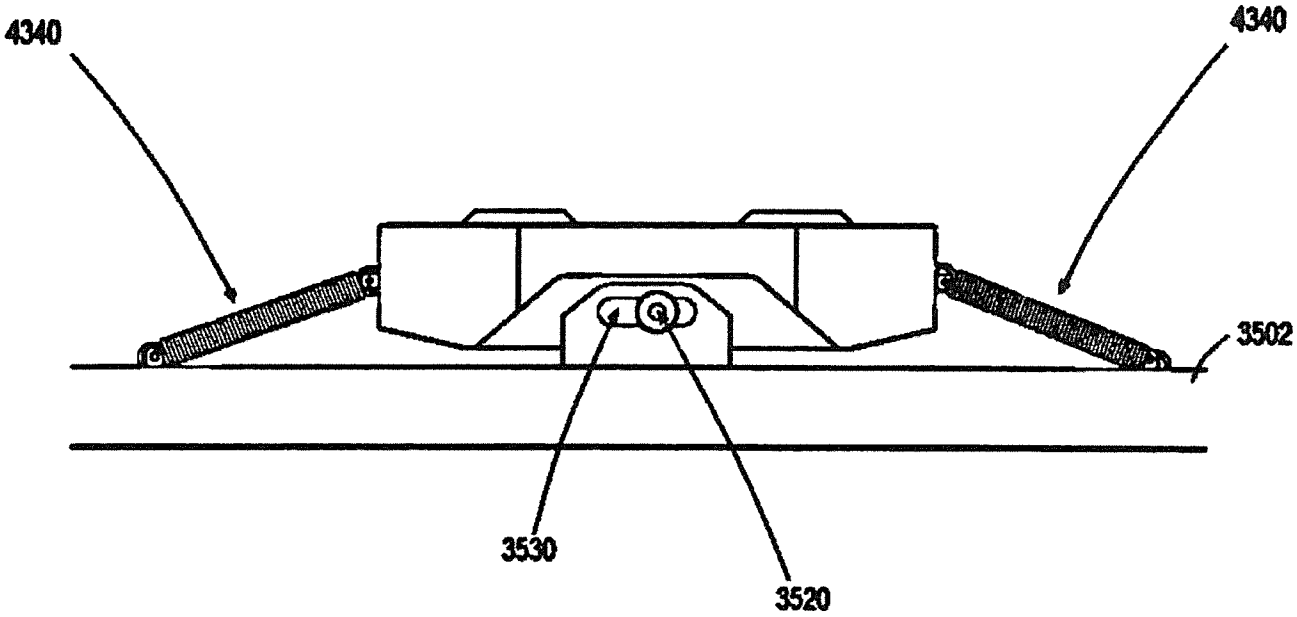
Figure 47:
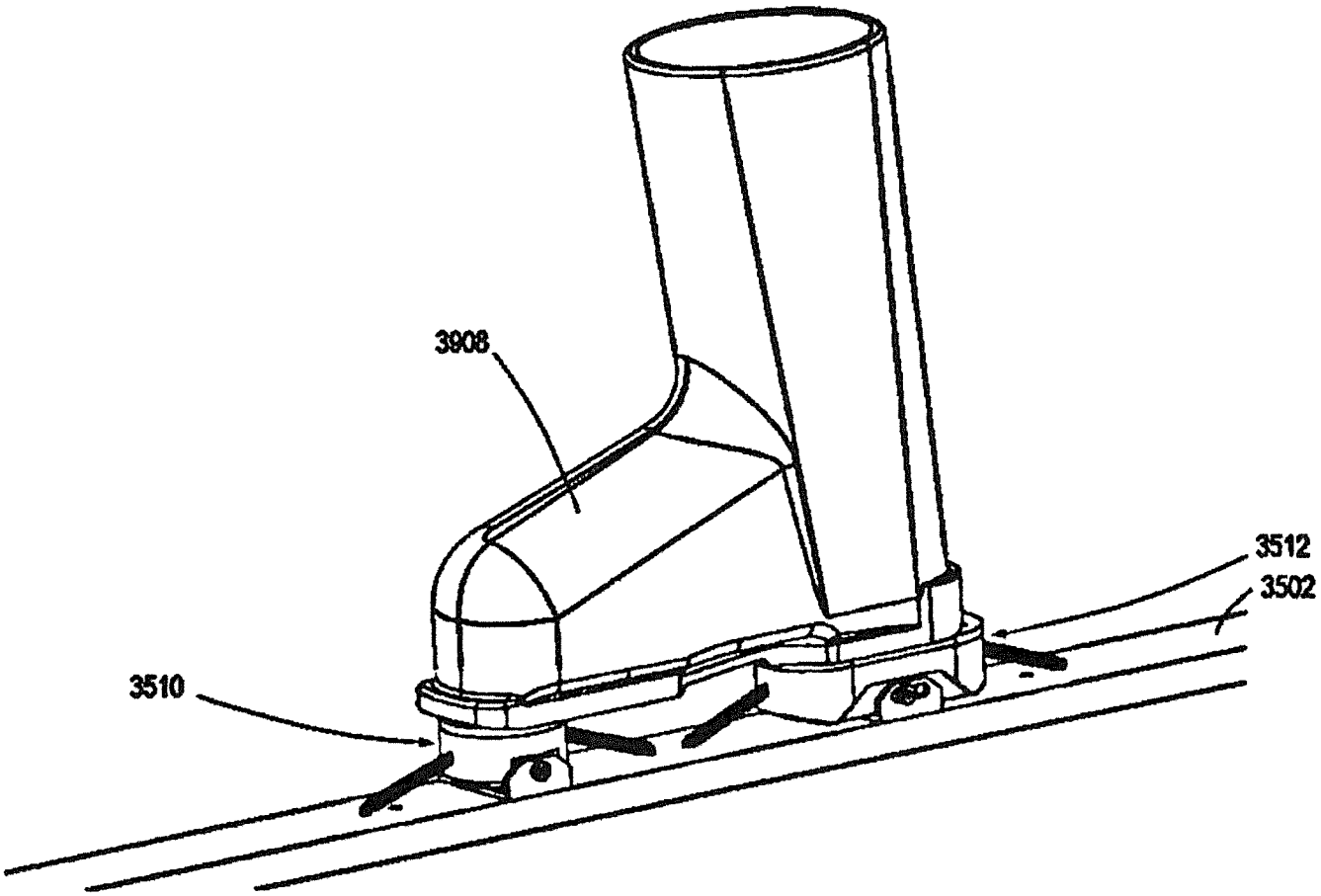
Figure 48:
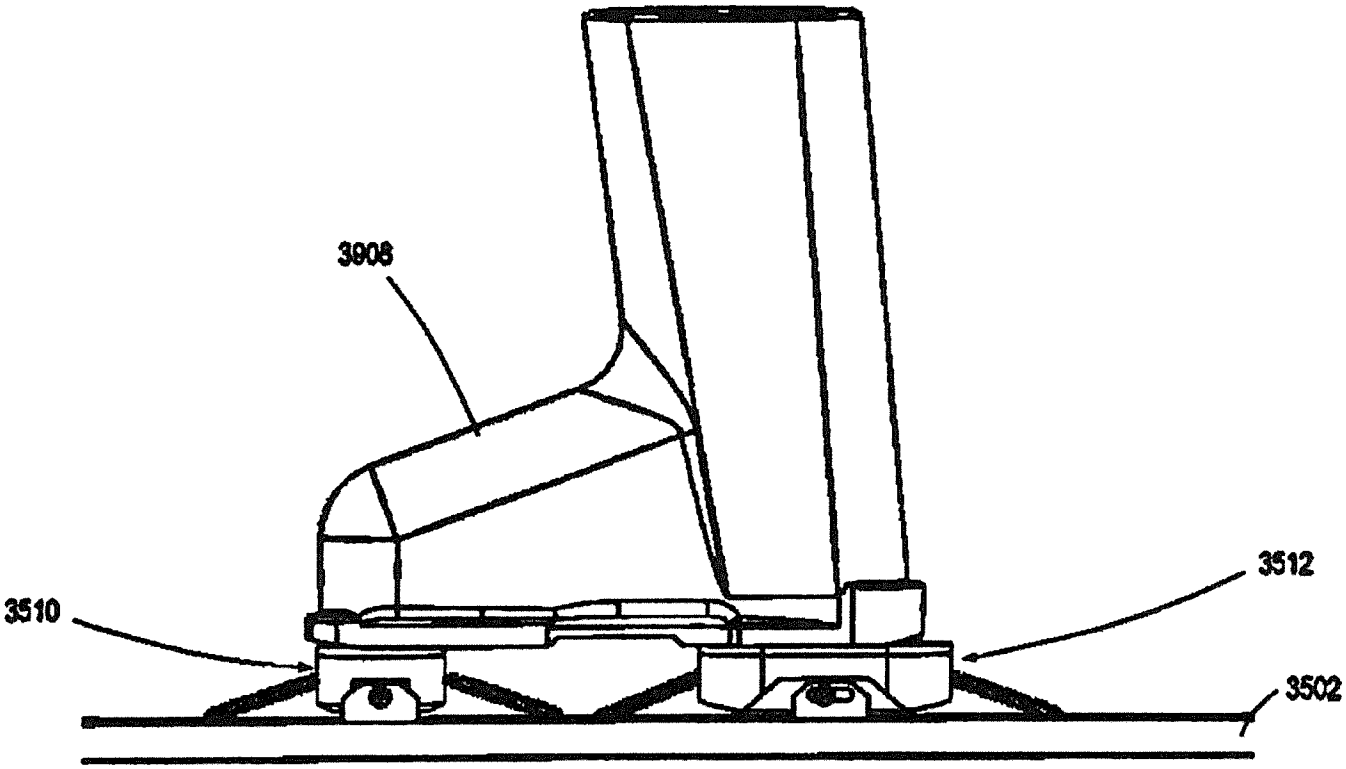

In FIGS. 43-44 the boot and binding system of FIGS. 39-40 is illustrated, in side and perspective views, respectively, in which each binding plate has a coil spring 4340 attached to each of its front and rear sides, with the other end of the spring 4340 attached to the top surface of the ski 3502, using the spring attachments points 3540, 3542 on the binding plates and the skis 3502, respectively. These springs 4340 can also be seen in FIGS. 47 and 48, which illustrate the boot and binding system, with the boot 3908 engaged with the binding 3504, in perspective and side views, respectively, of FIGS. 41-42, with the coil springs 4340 shown attached to the binding plates 3510, 3512 and to the top surface of the ski 3502 as in FIGS. 43-44. FIGS. 45 and 46 illustrate in more detail, in side view, the toe plate 3510 and the heel plate, 3512 respectively, mounted to the ski 3502, with coil springs 4340 attached to the top surface of the ski 3502 and to the front and rear of each binding plate 3510, 3512. These coil springs 4340 are attached so as to be under tension, i.e. they are stretched between the binding plate 3510, 3512 and the ski surface 3502, and are designed to facilitate a skier's mounting his/her boots 3908 into binding 3504 by holding the pivoting binding plates 3510, 3512 in a horizontal position, parallel to the ski 3902 surface. The springs 4340 are designed and configured so that they are in an equilibrium position, i.e. with the springs 4340 exerting equal and opposite torques on the binding plate 3510, 3512 about the mounting bolt, when the binding plate 3510, 3512 is parallel to the ski 3502 surface. In the case of the heel plate 3512, the springs 4340 are also designed and configured so that in the equilibrium position the heel plate 3512, which can translate in the fore and aft directions, is in the proper fore-aft position for mounting a boot 3908 into the binding, i.e. the heel plate 3512 is positioned at a distance from the toe plate 3510 corresponding to the distance between the corresponding boot plates 3910, 3912 that are attached to the bottom of the boot 3908. In some embodiments the binding plates 3510, 3512 are equipped with adjusting screws or other means to adjust and optimize the equilibrium position of the binding plates 3510, 3512.

Figure 49:
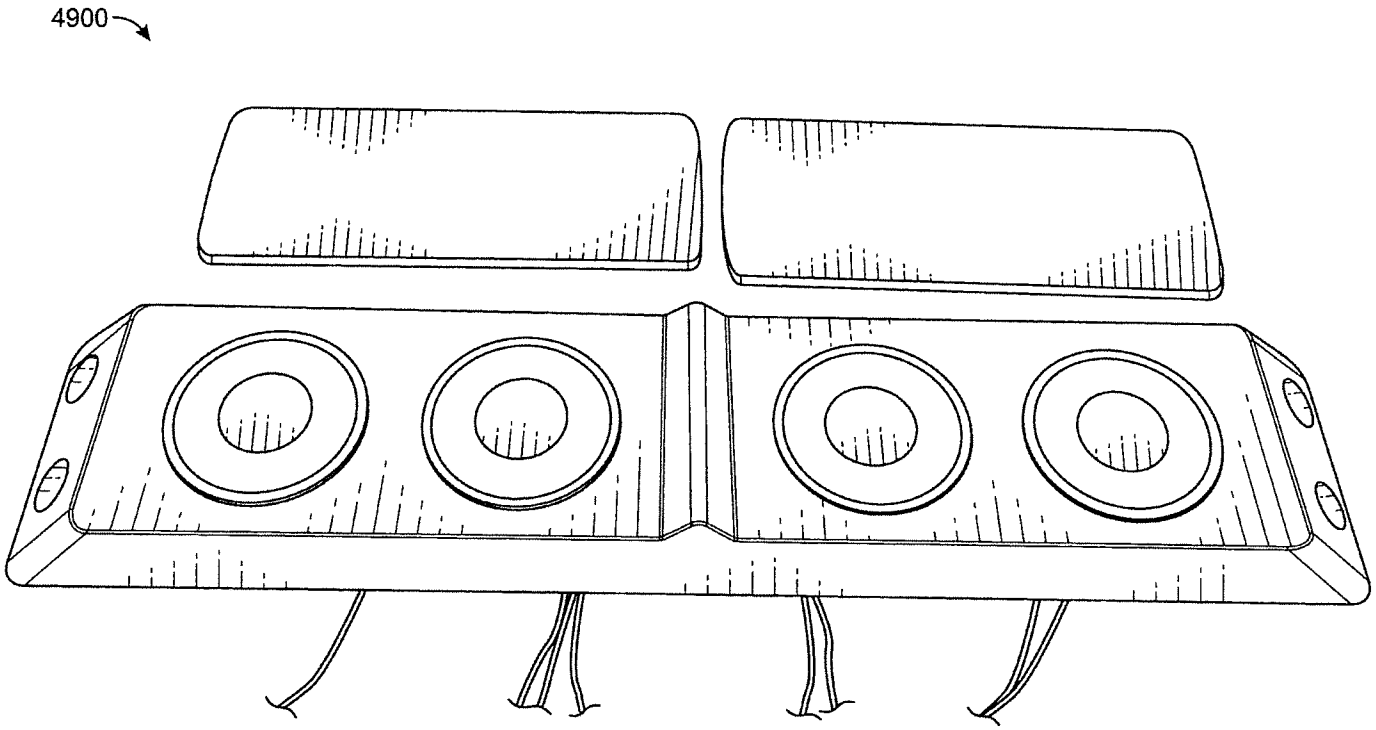
Figure 50:
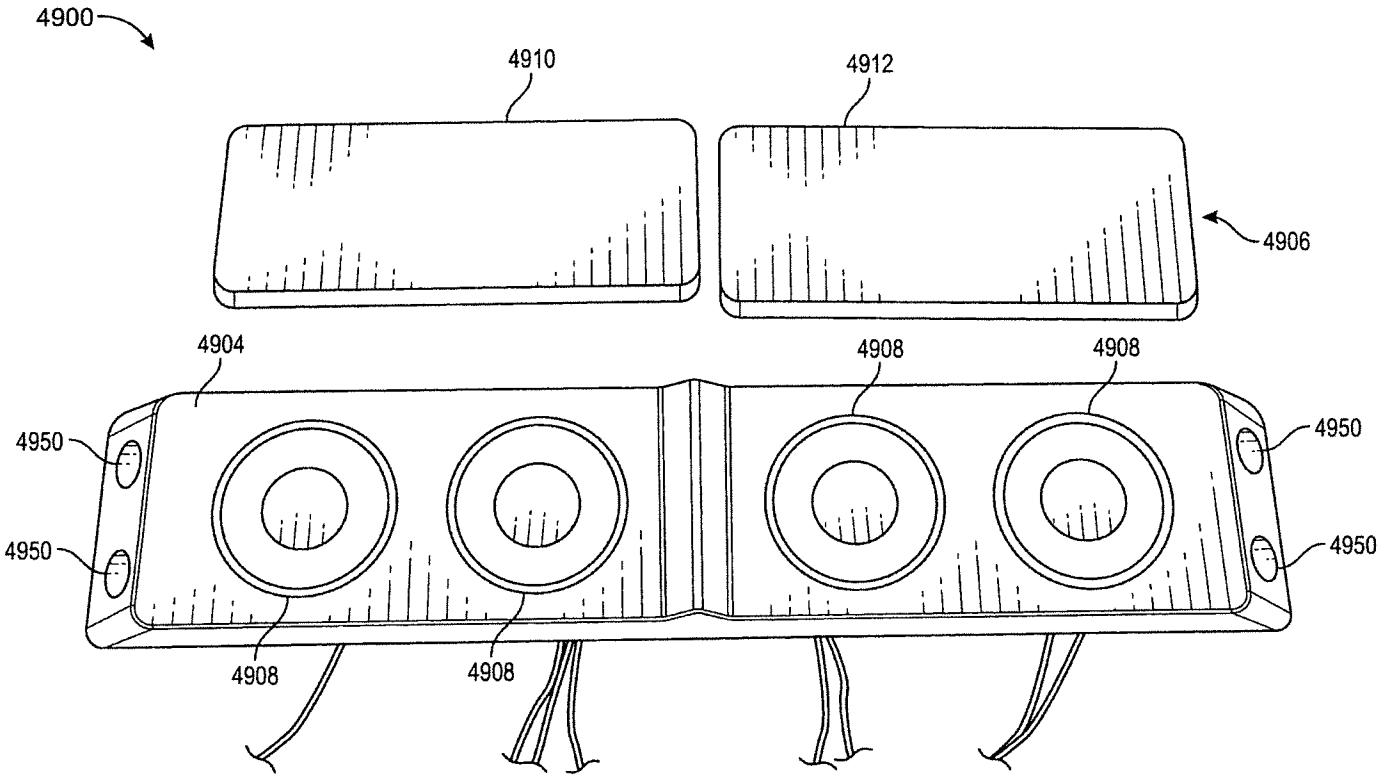

FIGS. 49 and 50 are photographs of a prototype 4900 of an embodiment of the binding, e.g., binding 2104, and boot plate, e.g., boot plate 2606, that are part of one or more of the systems disclosed herein. The prototype binding 4904 includes 4 large electromagnets 4908 embedded in a rubber body, which comprise holes 4950 to allow mounting the prototype binding 4904 to a ski, e.g., ski 2402. The prototype boot plate 4906 includes prototype boot plates 4910, 4912.

Figure 51:
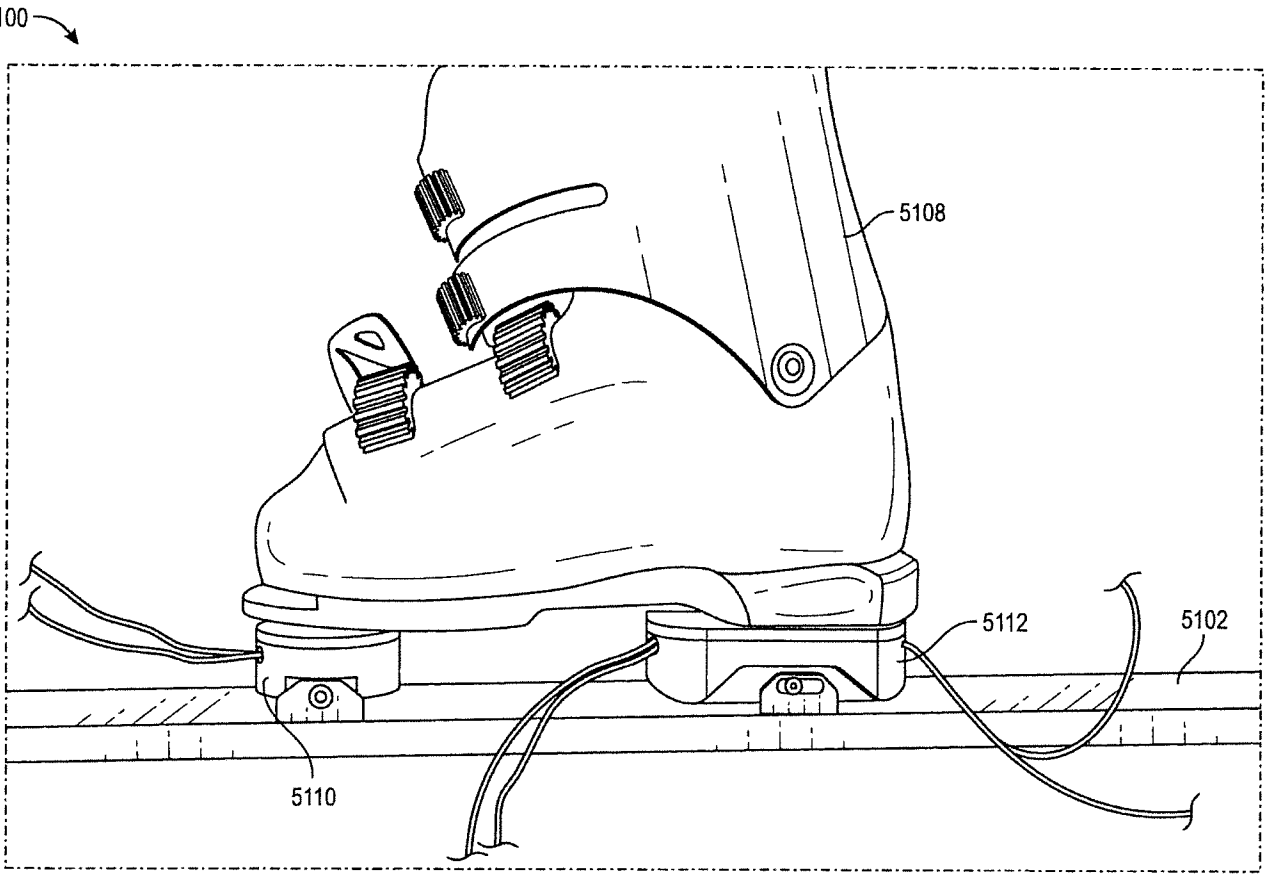
Figure 52:
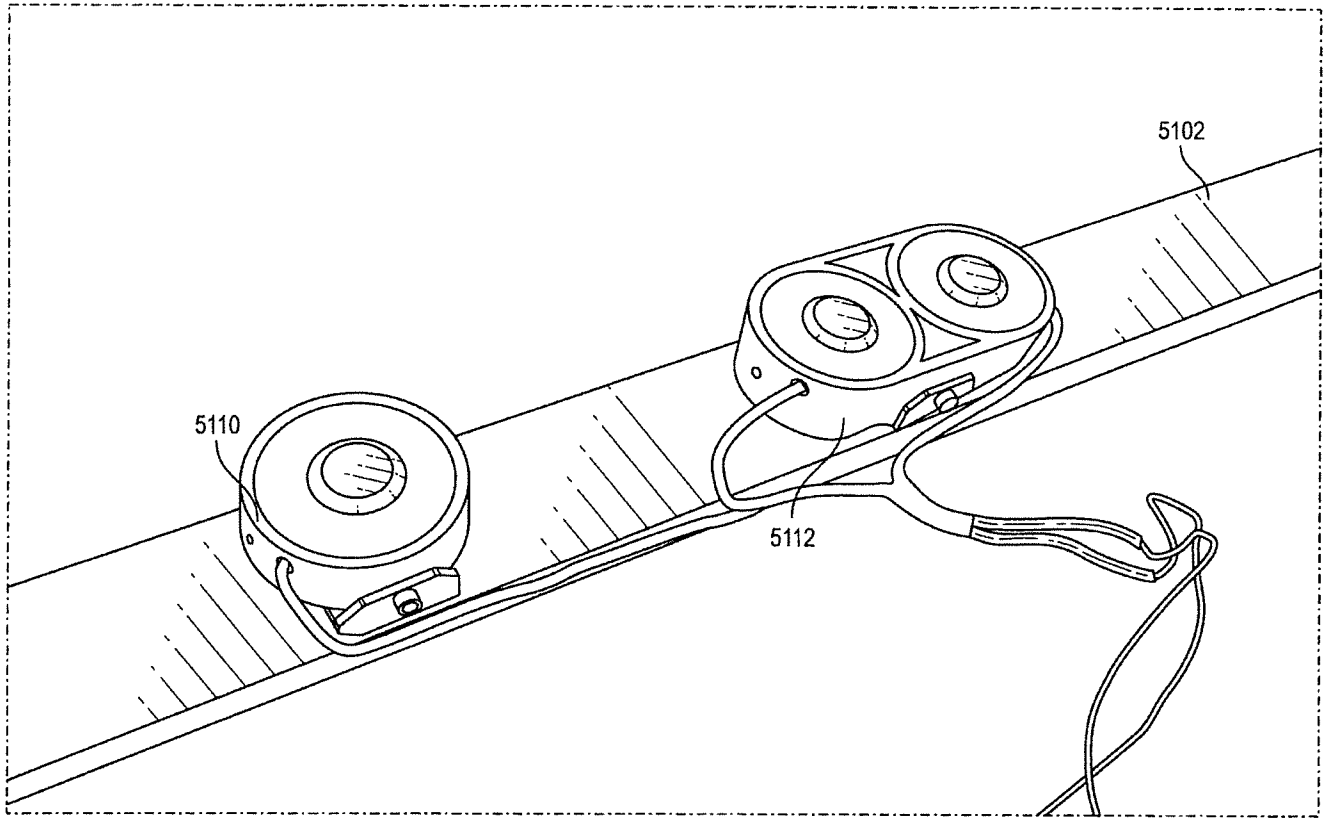
Figure 53:
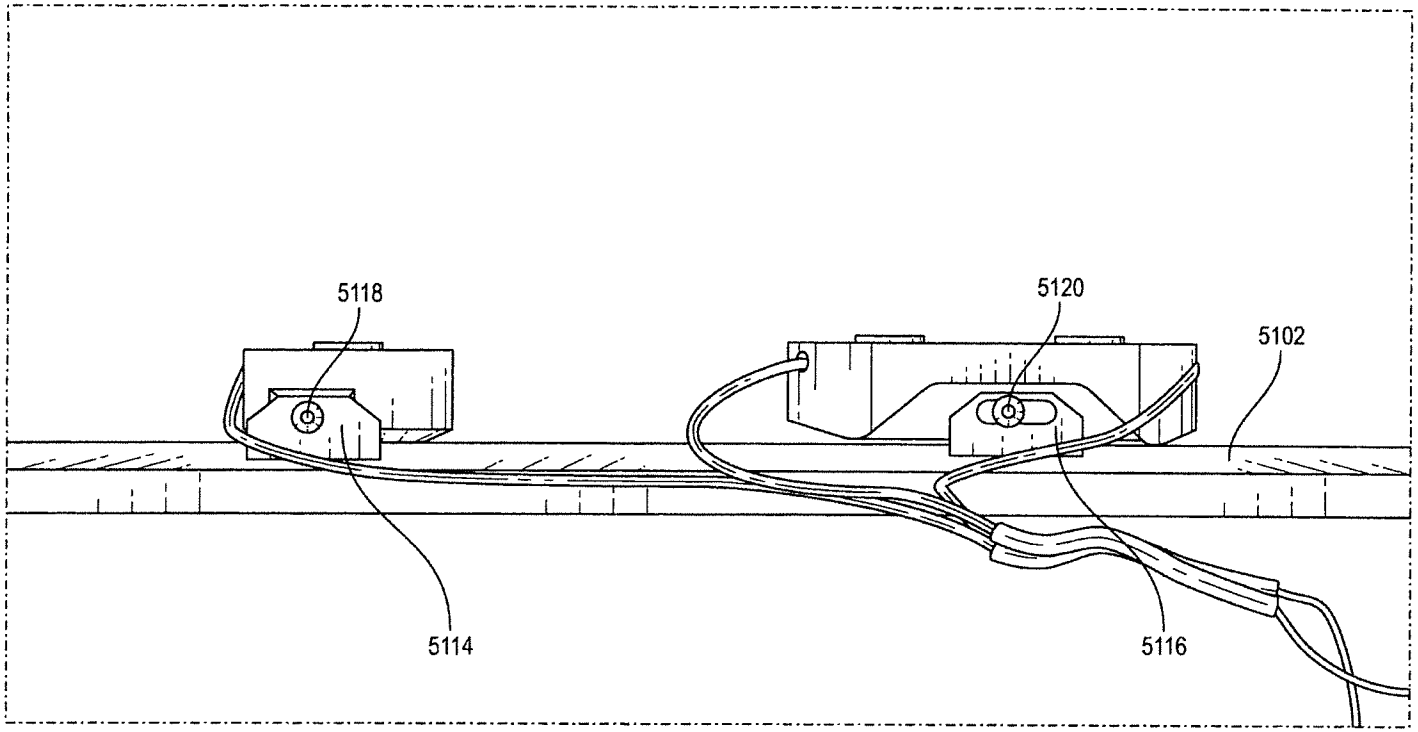
Figure 54:
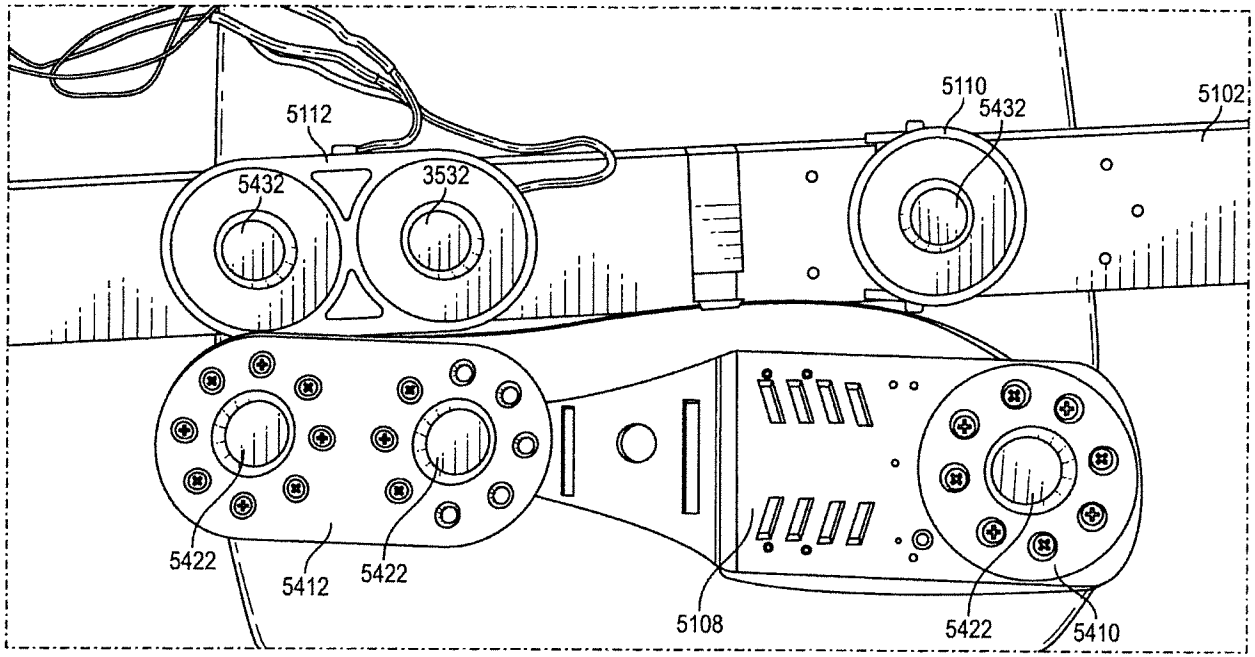

FIGS. 51-54 are photographs of a further prototype 5100 of an embodiment of the binding plates, e.g., binding plates 3510, 3512, and boot plates, e.g., boot plates 3910, 3912, that are part of one or more of the binding systems disclosed herein. The prototype binding system 5100 includes a prototype toe plate 5110 and a prototype heel plate 5112, each mounted to the top surface of a ski 5102 by means of a mounting bracket 5114, 5116, respectively, and mounting bolt 5118, 5120, respectively, around which each of the binding plates is allowed to pivot, and with the mounting bolt 5120 for the heel plate 5112 permitted to translate fore-and-aft in its slot in the mounting bracket 5116. Prototypes of coil springs 4340 are not shown in these photographs. FIG. 51 shows the binding system attached to a ski 5102, with a boot 5108 mounted to it. FIGS. 52 and 53 show, from different views, the binding system attached to a ski 5102, without a boot shown. FIG. 54 shows, alongside the binding system attached to a ski 5102, the underside of a boot 5108, to which prototype front and rear boot plates 5410, 5412 (e.g., prototypes of front and rear boot plates 3910, 3912, respectively), have been attached; in the boot plates 5410, 5412 can been seen circular indentations 5422, corresponding with the raised portions 5432 (e.g., prototypes of raised portions 3532), of the prototype toe plate and heel plate 5110, 5112 of the binding with which they engage.

The electrical power source and microprocessor (not shown in the illustrations) allow the magnets, e.g., magnets 2108 and/or magnets 3528, to be switched on and off as appropriate, such as when a user is putting on or taking off his/her skis, e.g., ski 2402 and/or ski 3502, or when a release is appropriate to prevent injury to the user. The power source can comprise a rechargeable battery, such as a lithium ion battery, a lithium polymer battery, and/or a capacitor. The capacitor may in some embodiments comprise part of the laminate of the ski, e.g., ski 2402 and/or ski 3502. In some embodiments, the invention comprises piezoelectric transducers that harvest energy from vibrations of the ski, e.g., ski 2402 and/or ski 3502, during use and use such energy to recharge the battery and/or capacitor that is used to power the magnets, e.g., magnets 2108 and/or magnets 3528, in the binder, e.g., binding 2104 and/or binding 3504 and/or the processor and/or the solenoid.

The microprocessor is in electrical communication, by either wired or wireless means, with one or more strain gauges, pressure transducers, accelerometers and/or other mechanical sensors (collectively, sensors). Such sensors can be attached to the ski 3502, the boot 3908 and/or the skier and/or other equipment or clothing worn by him/her. In some embodiments sensors, e.g. pressure sensors, are located inside the boot 3908, such as between the plastic shell and the soft liner of the boot 3908. The microprocessor continuously receives signals from these sensors and determines, based on such signals, when to transmit a signal to disable the magnets 3528, or enable magnets that will counteract other magnets in the binding, and thereby release boot from the binding. In some embodiments the boot plates are held to the binding plates by permanent magnets, which are active in the absence of any electrical current or signal, embedded in the binding plates, and the boot plates are released from the binding plates by means of electromagnets embedded in the binding plates, activated by the microprocessor, that create a magnetic field in the opposite direction from that created by the permanent magnets, such that the magnetic fields superpose and largely cancel each other, to a degree sufficient to weaken the resulting magnetic force holding the boot plates and binding plates together, and thus release them from each other. In some embodiments, the electromagnets may be configured so that they reinforce the magnetic fields created by permanent magnets during use, thus providing a strong magnetic attractive force between the boots and the bindings, and so that the electromagnets reverse polarity in the case of a release event, allowing them to create a magnetic field that will offset the field created by the permanent magnets.

In some embodiments, the binding system operates by creating magnetic attractive forces, or "clamping" forces, between binding plates and boot plates, that are designed to be of magnitudes such that the clamping forces will not hold them together if there is sufficient external force pulling or twisting them apart, such as could be experienced during use if the skier loses control. In other words, the bindings are designed to create a mechanical threshold, whereby the bindings would no longer hold the skier if this threshold is overcome, even in the absence of any signal from the microprocessor to reduce the magnetic force holding the boot plates to the binding plates, thus providing an additional layer of safety.

The magnitudes of the clamping forces during use, as well as the parameters used by the microprocessor in determining when to send a release signal, are adjustable, by mechanical means such as adjustment screws and/or electronic means such as commands transmitted to the microprocessor. In this way adjustments can be made to accommodate the mass and height of the skier, the terrain, the intended skiing style, and so forth.

Although reference has been made to a microprocessor, the systems disclosed herein are not limited to use of a microprocessor. In at least some embodiments, the systems disclosed herein may include a processor of any type.

Figure 55A:
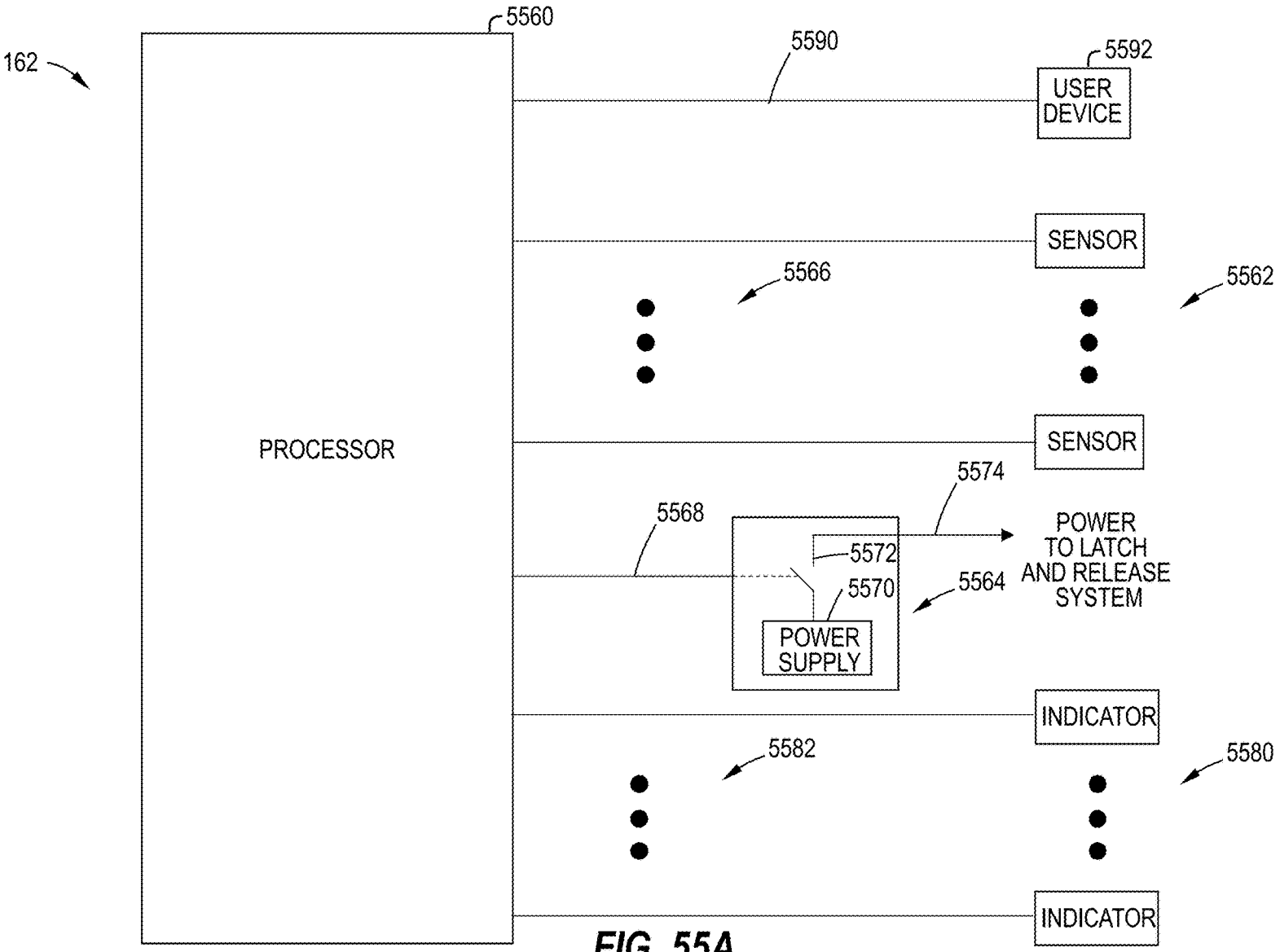
FIG. 55A is a schematic block diagram of a control system, in accordance with some embodiments.

FIG. 55A is a schematic block diagram of one embodiment of the control system 162 (FIGS. 12-13) in the binding system 104 (FIGS. 1-18).

Referring to FIG. 55A, in accordance with at least some embodiments, the control system 162 may include a processor 5560, a plurality of sensors (sometimes referred to herein as a sensor system) 5562 and one or more power circuit 5564. The processor 5560 may comprise any type(s) of processor(s). The plurality of sensors 5562 may comprise any type(s) of sensors. The one or more power circuit 5564 may comprise any type(s) of power circuit(s).

In at least some embodiments, the one or more power circuit 5564 may comprise one or more power supply 5570 and one or more power switch 5572. The one or more power supply 5570 may comprise one or more battery (rechargeable or otherwise) and/or any other type of power source(s). The one or more power switch 5572 may comprise one or more power semiconductor devices and/or any other type(s) of power switch(es).

The control system 162 may further include a plurality of signal lines or other communication links 5566 that couple the processor 5560 to the plurality of sensors 5562 and one or more control line or other communication link(s) 5568 that couple the processor 5560 to the one or more power circuit 5564.

The control system 162 may further comprise one or more power line or other power link(s) 5574 from the one or more power circuit 5564 to the solenoid 168 and/or other portion(s) of the binding system 104.

The control system 162 may further include a plurality of status indicators 5580 and a plurality of signal lines or other communication links 5582 that couple the processor 5560 to the plurality of status indicators 5580. The plurality of status indicators 5580 may indicate one or more status of the control system 162 and/or the binding system 104.

The control system 162 may further include one or more communication link 5590 to one or more user device 5592.

Unless stated otherwise, a "user device" may comprise a smart phone, a tablet and/or any other type of computing device (mobile or otherwise).

In at least some embodiments, one or more of the one or more user device 5592 may comprise a computing device (mobile or otherwise) of a user that is using and/or will use the binding system 104.

In operation, in at least some embodiments, the processor 5560 receives one or more signals, from one or more of the plurality of sensors 5562 or otherwise, indicative of one or more conditions of the skier and/or system 100 (or portion(s) thereof), and determines, based at least in part thereon, whether (and/or when) to power the solenoid 168 to initiate release of the boot plate 106 (and boot 108 to which the boot plate 106 is mounted). In at least some embodiments, if the processor 5560 determines to initiate release, the processor 5560 generates one or more control signal to initiate release, which may be supplied to the one or more power circuit 5564 via the one or more control line or other communication link(s) 5568. The one or more power circuit 5564 receives the one or more control signal from the processor 5560 and in response at least thereto, provides power to the solenoid 168 and/or other portion(s) of the binding system 104 via one or more of the one or more power line or other power link(s) 5574.

In at least some embodiments, the one or more power supply 5570 may comprise one or more rechargeable battery, such as a lithium ion battery, a lithium polymer battery, and/or a capacitor. The capacitor may in some embodiments comprise part of the laminate of the ski, e.g., ski 102. In some embodiments, the system 100 may include piezoelectric transducers that harvest energy from vibrations of the ski, e.g., ski 102, during use and use such energy to recharge the battery and/or capacitor.

In at least some embodiments, the plurality of sensors 5562 may comprise one or more strain gauges, pressure transducers, accelerometers and/or other mechanical sensors (collectively, sensors). Such sensors can be attached to the ski 102, the boot 108 and/or the skier and/or other equipment or clothing worn by the skier. In some embodiments one or more sensors, e.g. pressure sensors, may be located inside the boot 108, such as between the plastic shell and the soft liner of the boot 108.

In at least some embodiments, the processor 5560 may continuously receive signals from the plurality of sensors 5562 and determine, based at least in part on such signals, whether (and/or when) to initiate release of the boot plate 106 and/or boot 108.

In at least some embodiments, any of the binding systems disclosed herein may include a control system having one or more portions that are the same as and/or similar to one or more portions of the control system 162 of the binding system 104.

Figure 55C:
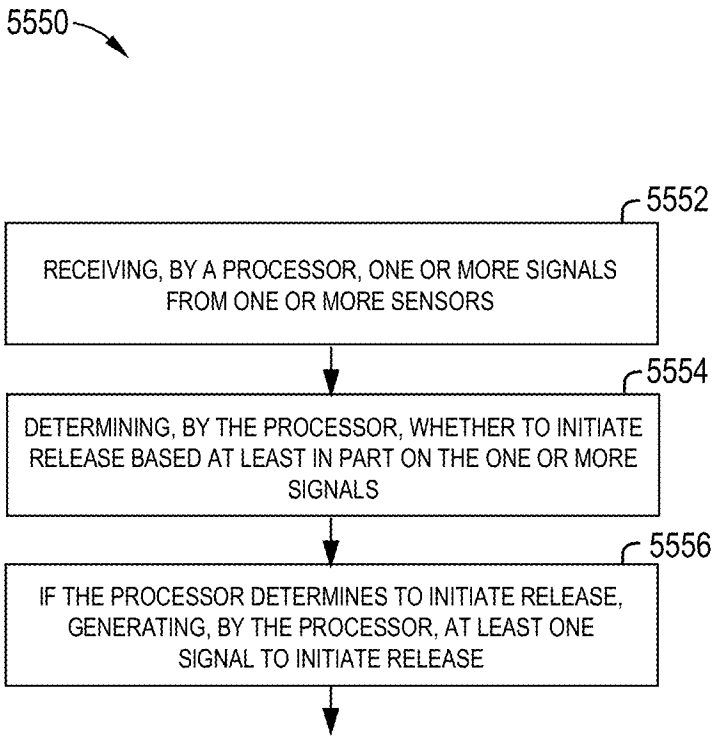
FIG. 55C is a flowchart of a method, in accordance with some embodiments.
Figure 55B:
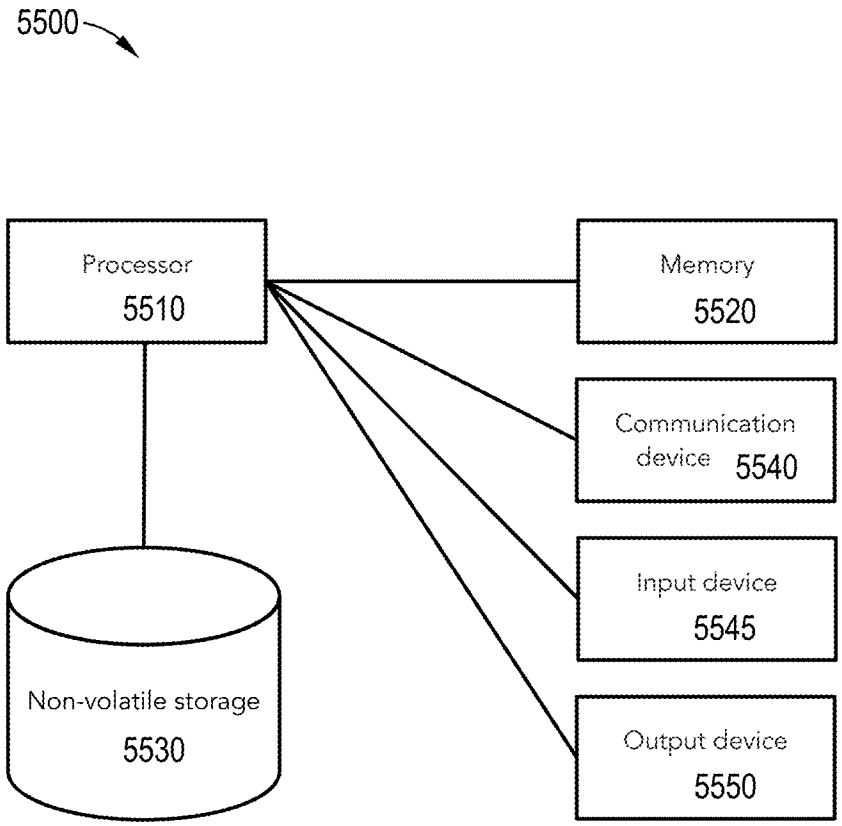
FIG. 55B is a schematic block diagram of an architecture, in accordance with some embodiments.

FIG. 55B is a block diagram of an architecture 5500 according to some embodiments. In some embodiments, one or more of the systems (or portion(s) thereof), apparatus (or portion(s) thereof) and/or devices (or portion(s) thereof)

disclosed herein may have an architecture that is the same as and/or similar to one or more portions of the architecture 5500.

In some embodiments, one or more of the methods (or portion(s) thereof) disclosed herein may be performed by a system, apparatus and/or device having an architecture that is the same as or similar to the architecture 5500 (or portion(s) thereof). The architecture may be implemented as a distributed architecture or a non-distributed architecture.

Referring to FIG. 55B, in accordance with at least some embodiments, the architecture 5500 may include one or more processors 5510 and one or more non-transitory computer-readable storage media (e.g., memory 5520 and/or one or more non-volatile storage media 5530). The processor 5510 may control writing data to and reading data from the memory 5520 and the non-volatile storage device 5530 in any suitable manner. The storage media may store one or more programs and/or other information for operation of the architecture 5500. In at least some embodiments, the one or more programs include one or more instructions to be executed by the processor 5510 to perform one or more portions of one or more tasks and/or one or more portions of one or more methods disclosed herein. In some embodiments, the other information may include data for one or more portions of one or more tasks and/or one or more portions of one or more methods disclosed herein. To perform any of the functionality described herein, the processor 5510 may execute one or more processor-executable instructions stored in one or more non-transitory computer-readable storage media (e.g., the memory 5520 and/or one or more non-volatile storage media 5530).

In at least some embodiments, the architecture 5500 may include one or more communication devices 5540, which may be used to interconnect the architecture to one or more other devices and/or systems, such as, for example, one or more networks in any suitable form, including a local area network or a wide area network, such as an enterprise network, and intelligent network (IN) or the Internet. Such networks may be based on any suitable technology and may operate according to any suitable protocol and may include wireless networks or wired networks.

In at least some embodiments, the architecture 5500 may have one or more input devices 5545 and/or one or more output devices 5550. These devices can be used, among other things, to present a user interface. Examples of output devices that may be used to provide a user interface include printers or display screens for visual presentation of output and speakers or other sound generating devices for audible presentation of output. Examples of input devices that may be used for a user interface include keyboards, and pointing devices, such as mice, touch pads, and digitizing tablets. As another example, the architecture 5500 may receive input information through speech recognition or in other audible formats.

FIG. 55C is a flowchart of a method, in accordance with some embodiments.

In at least some embodiments, the method (or one or more portion(s) thereof) may be performed by one or more of the systems or portion(s) thereof, described herein.

In at least some embodiments, the method (or one or more portion(s) thereof) may be performed by the processor 5560.

The method is not limited to the order shown, but rather may be performed in any practicable order. For that matter, any method disclosed herein is not limited to any particular order but rather may be performed in any practicable order.

One or more portions of the method may be used without one or more other portions of the method. For that matter, one or more portions of any method (or system) disclosed herein may be used without one or more other portions of such method (or system).

In at least some embodiments, the method (or one or more portion(s) thereof) may be performed using one or more portions of one or more other methods disclosed herein. For that matter, in at least some embodiments, any method (or one or more portions thereof) disclosed herein may be performed using one or more portions of one or more other methods disclosed herein.

In at least some embodiments, the method (or one or more portion(s) thereof) may be performed in performance of one or more portions of one or more other methods disclosed herein. For that matter, in at least some embodiments, any method (or one or more portions thereof) disclosed herein may be performed in performance of one or more portions of one or more other methods disclosed herein.

Referring to FIG. 55C, at 5552, the method may include receiving, by a processor, one or more signals from one or more sensors. The one or more signals may have any form(s) and may be received in any manner(s) (directly and/or indirectly).

In at least some embodiments, the one or more signals may be indicative of a positioning and/or movement of one or more portions of a skier and/or one or more portions of the system.

At 5554, the method may further include determining, by the processor, whether to initiate release (e.g., of a boot plate and/or boot) based at least in part on the one or more signals.

At 5556, the method may further include, if the processor determines to initiate release, generating, by the processor, at one signal to initiate release.

In at least some embodiments, any of the binding systems disclosed herein may be used in conjunction with conventional mechanical ski brake systems, known in the art, by which a ski is preventing from sliding freely on the snow unless a boot pressed onto a spring-loaded plate or other mechanism mounted on the top of the ski surface. Such a mechanism can be disposed over or between binding plates in various embodiments. In some embodiments, a ski brake system could be linked to the processor (e.g., the microprocessor discussed above and/or the processor 5560, which may be a microprocessor or any other type of processor) and activated by means of an electronic signal when there is a release event, and then reset when a skier mounts his/her boots into the bindings.

In some embodiments, any of the systems disclosed herein may comprise storage means, such as a memory card, storage drive, or the like, in electrical communication with the processor (e.g., the microprocessor discussed above and/or the processor 5560, which may be a microprocessor or any other type of processor), by which settings and data from sensors are recorded and stored. In some embodiments, new sensor data will overwrite older, stored sensor data as the storage means becomes full, so that the most recent sensor data is retained. In some embodiments, the system may be in wireless communication, over the internet or otherwise, with storage means located external to the ski and binding system, including so-called "cloud" storage, by which sensor data are recorded. The stored sensor data can be used to analyze the performance of the system, and to improve the system over time by adjusting programming parameters based on such analysis. Such analysis may aid in understanding where a skier's leg is applying pressure to the boot, and in creating or improving models and maps of the boot, skis and/or binding to better understand their behavior during use. Such analysis may focus on the performance of the system when an incident occurs, such as a skier crashing due to an unintended release, or a skier being injured resulting from a failure to release. Such analysis and adjustment can be especially valuable when it takes into account a larger data set, such as may be obtained from many different skiers using the system disclosed herein or similar systems. By using data analysis, the system is an intelligent system that is capable of evolving over time as ski equipment changes and knowledge of industry conditions improves.

Figure 56:
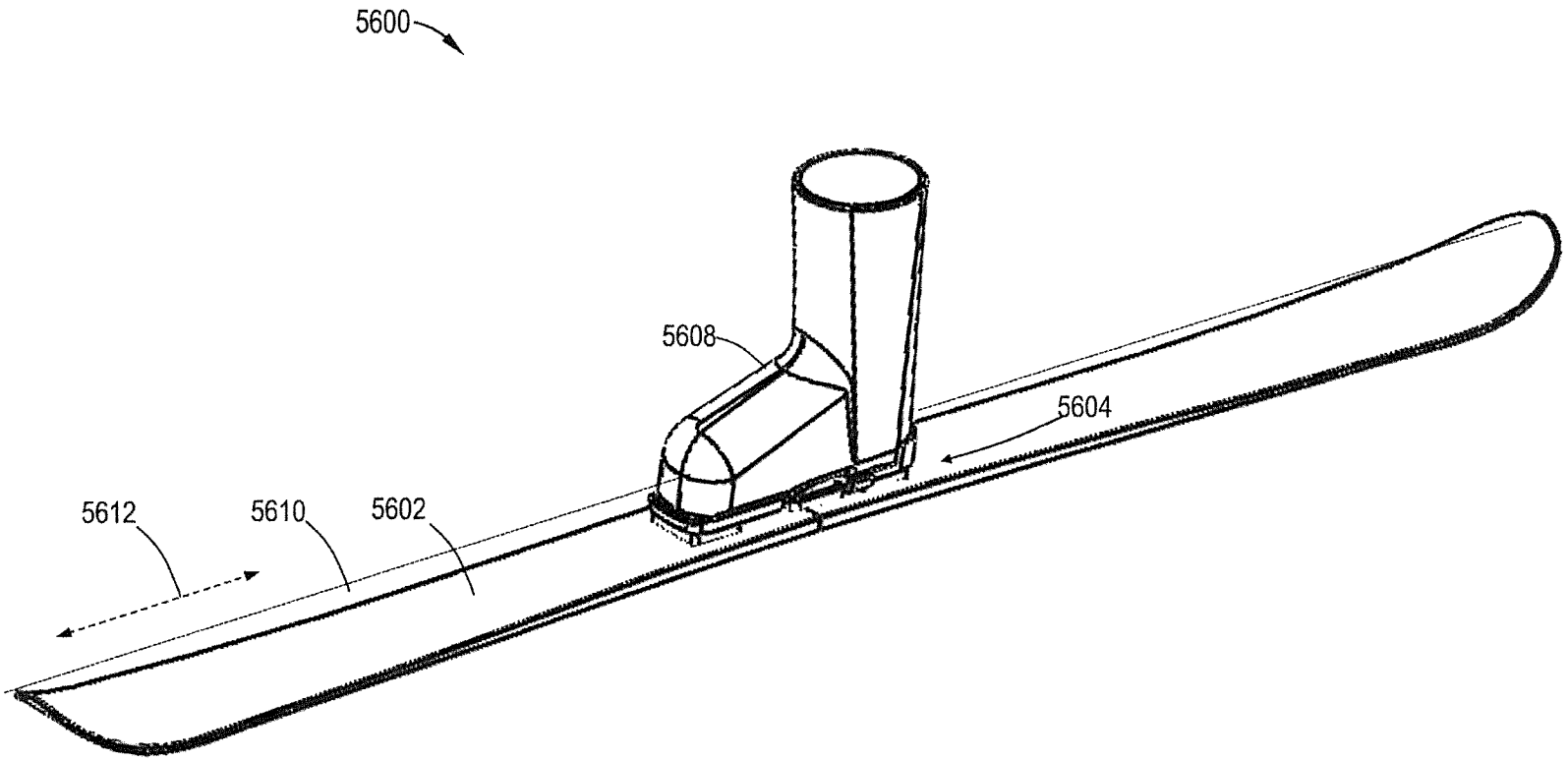
FIG. 56 is a perspective view of another system, in accordance with at least some embodiments.

FIG. 56 is a perspective view of another system 5600 that includes a solenoid to initiate release of a boot from a ski, in accordance with at least some embodiments.

Figure 57:
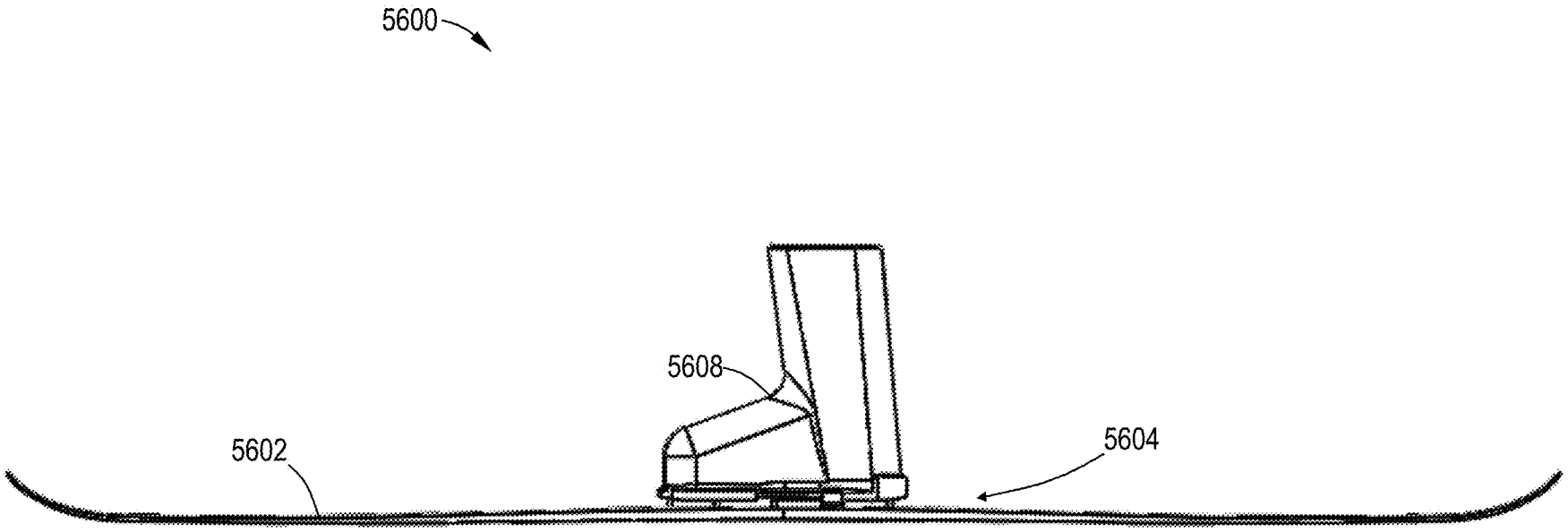
FIG. 57 is a side view of the system of FIG. 56, in accordance with at least some embodiments.

FIG. 57 is a side view of the system 5600, in accordance with at least some embodiments.

Figure 58:
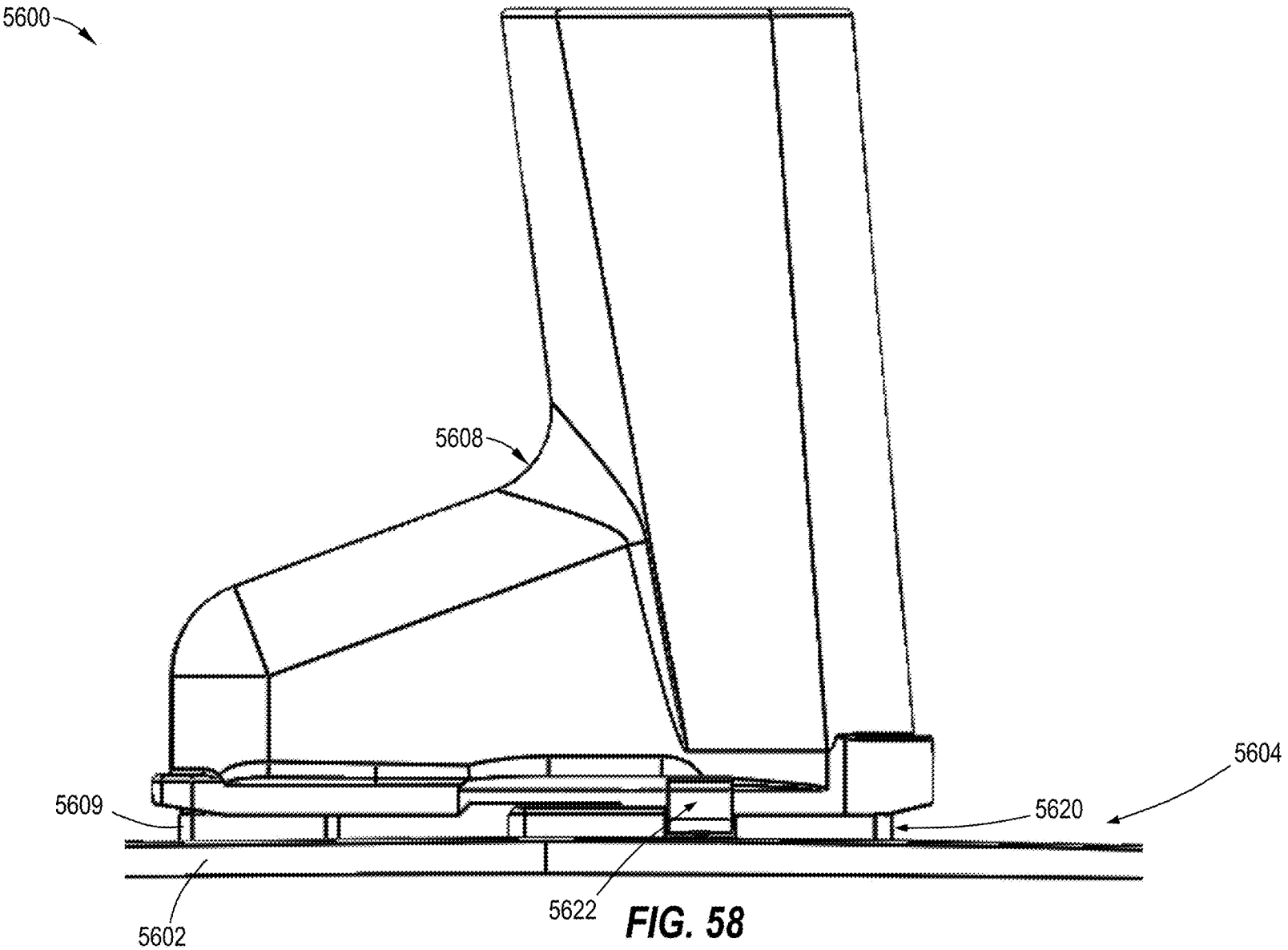
FIG. 58 is an enlarged side view of a portion of the system of FIG. 56, in accordance with at least some embodiments.

FIG. 58 is an enlarged side view of a portion of the system 5600, in accordance with at least some embodiments.

Referring to FIGS. 56-58, in accordance with at least some embodiments, the system 5600 includes a ski 5602, a binding system 5604, a boot plate 5606 (FIG. 61), a boot 5608, and a toe plate 5609 (FIG. 58).

The binding system 5604 may be mounted (directly and/or indirectly) to an upper and/or other surface of the ski 5602. The boot plate 5606 may be attached (directly and/or indirectly) to a sole and/or other portion of the boot 5608 (e.g., using screws (or other fasteners (threaded or otherwise)), claws and/or any other type of fasteners (not shown)). The boot plate 106 may also be releasably attached to the binding system 5604 (thereby releasably attaching the boot 5608 to the binding system 5604), sometimes referred to herein as a first (or releasably attached) state.

The system 5600 may have a longitudinal axis 5610 and/or may extend in longitudinal directions 5612 (FIG. 56).

Figure 59:
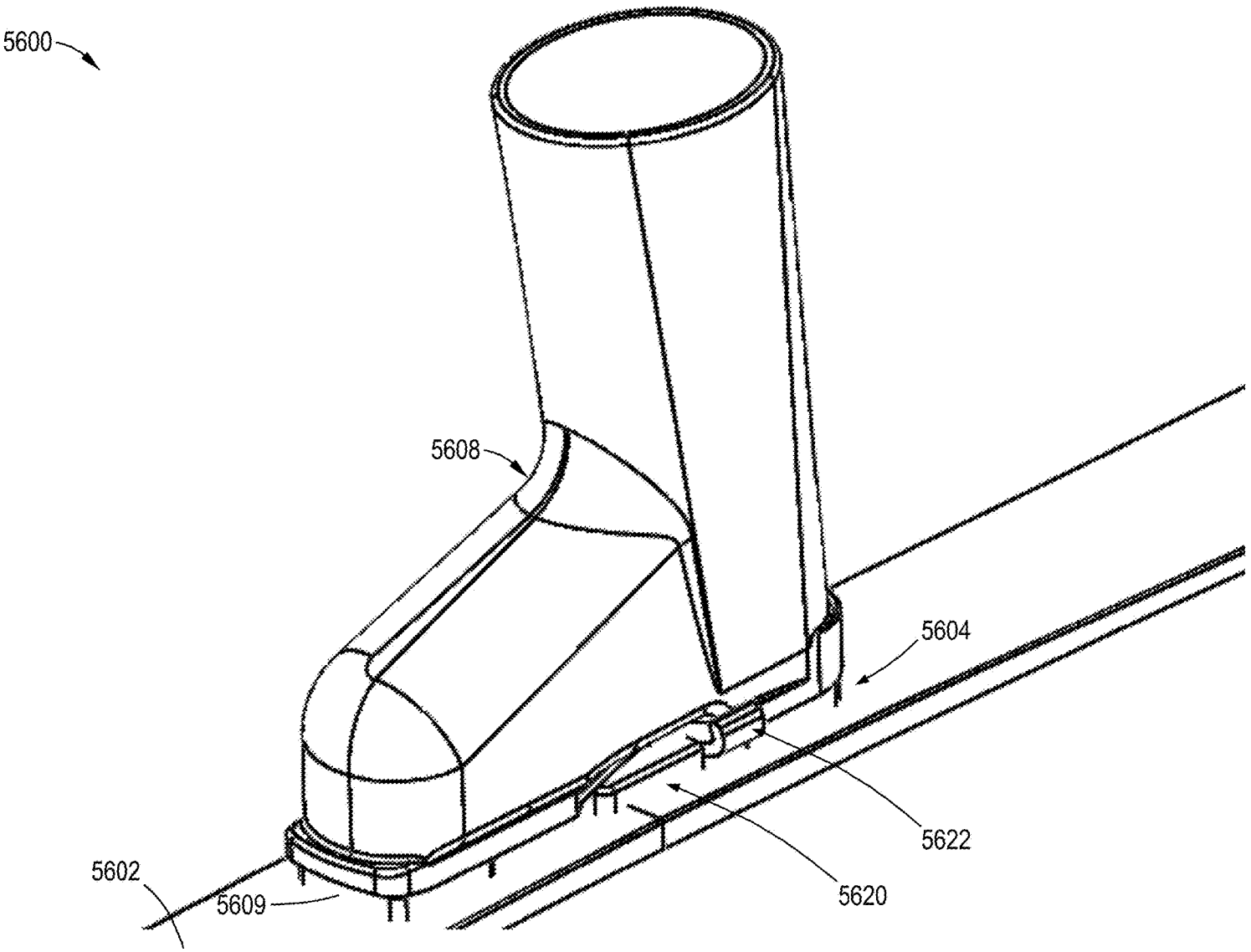
FIG. 59 is an enlarged perspective view of a portion of the system of FIG. 56, in accordance with at least some embodiments.

FIG. 59 is an enlarged perspective view of a portion of the system 5600 with the boot 5608 released from the binding system 5604, sometimes referred to herein as a second (or released or detached) state.

Figure 60:
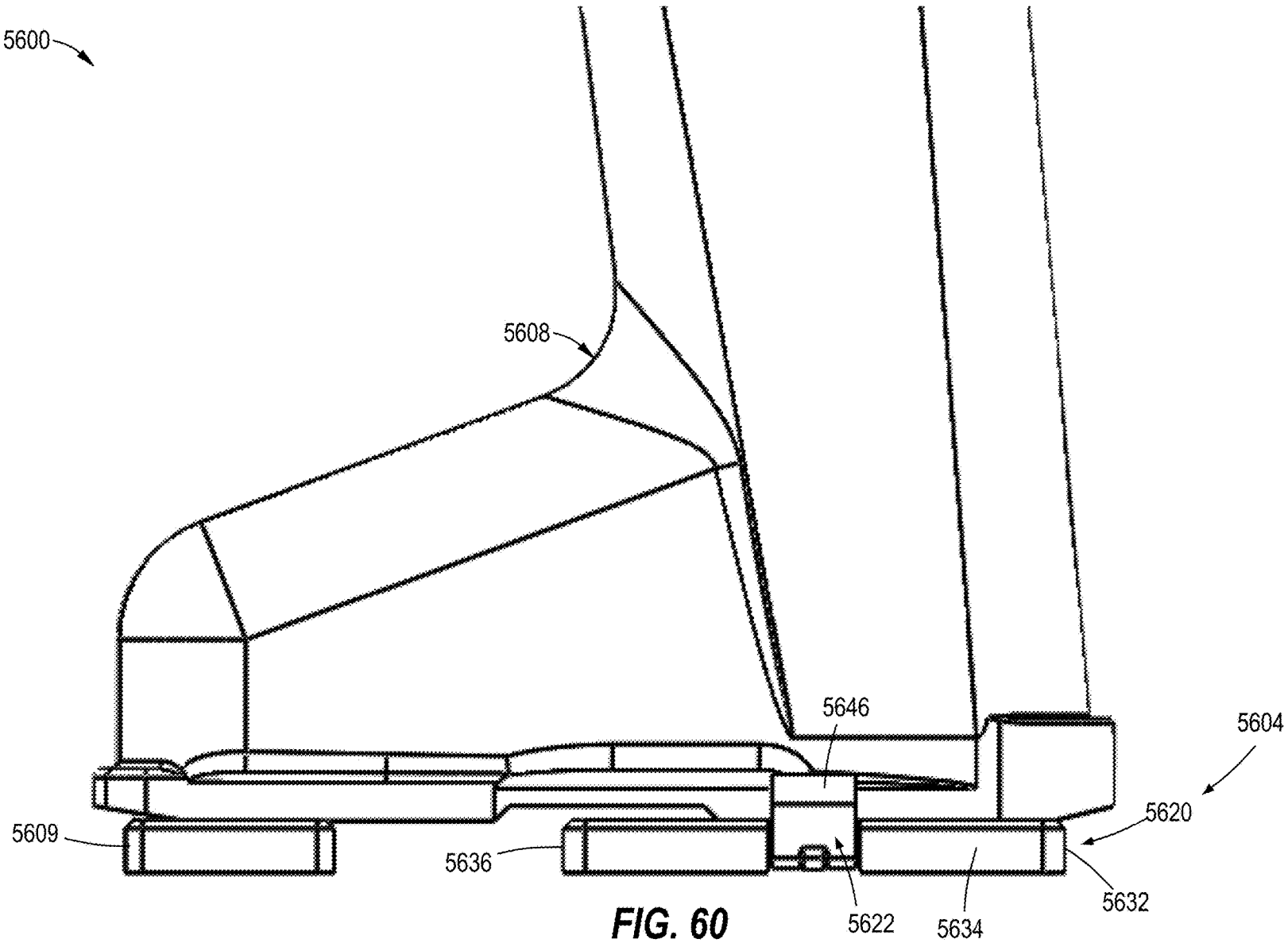
FIG. 60 is an enlarged perspective view of a portion of the system of FIG. 56, in accordance with at least some embodiments.

FIG. 60 is an enlarged side view of a portion of the system 5600, without the ski 5602.

Figure 61:
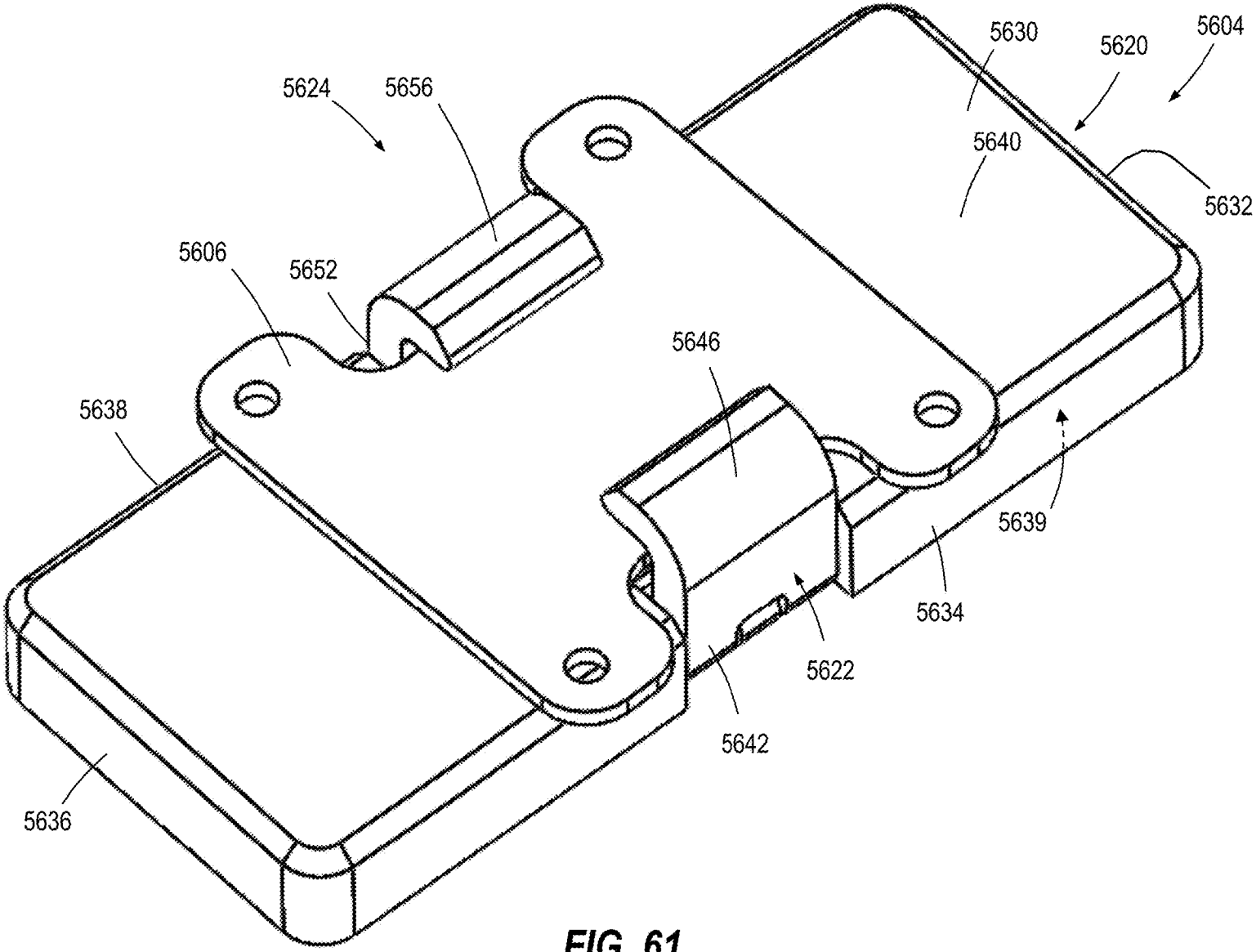
FIG. 61 is an enlarged perspective view of a portion of the system 5600, in accordance with at least some embodiments.

Referring also now to FIGS. 59-60, in accordance with at least some embodiments, the binding system 5604 may include a binding plate 5620 and one or more clamps, e.g., two clamps 5622, 5624 (FIG. 61). The binding plate 5620 may be mounted (directly or indirectly) to the upper or other surface of the ski 5602. The two clamps 5622, 5624 (FIG. 61) may be pivotably or otherwise rotatably coupled (directly and/or indirectly) to the binding plate 5620.

FIG. 61 is an enlarged perspective view of a portion of the system 5600, without the ski 5602 and the boot 5608, showing a relative positioning of the boot plate 5606, the binding plate 5620 and the clamps 5622, 5624, with the binding system 5604 in the first (or releasably attached) state, in accordance with at least some embodiments.

Figure 62:
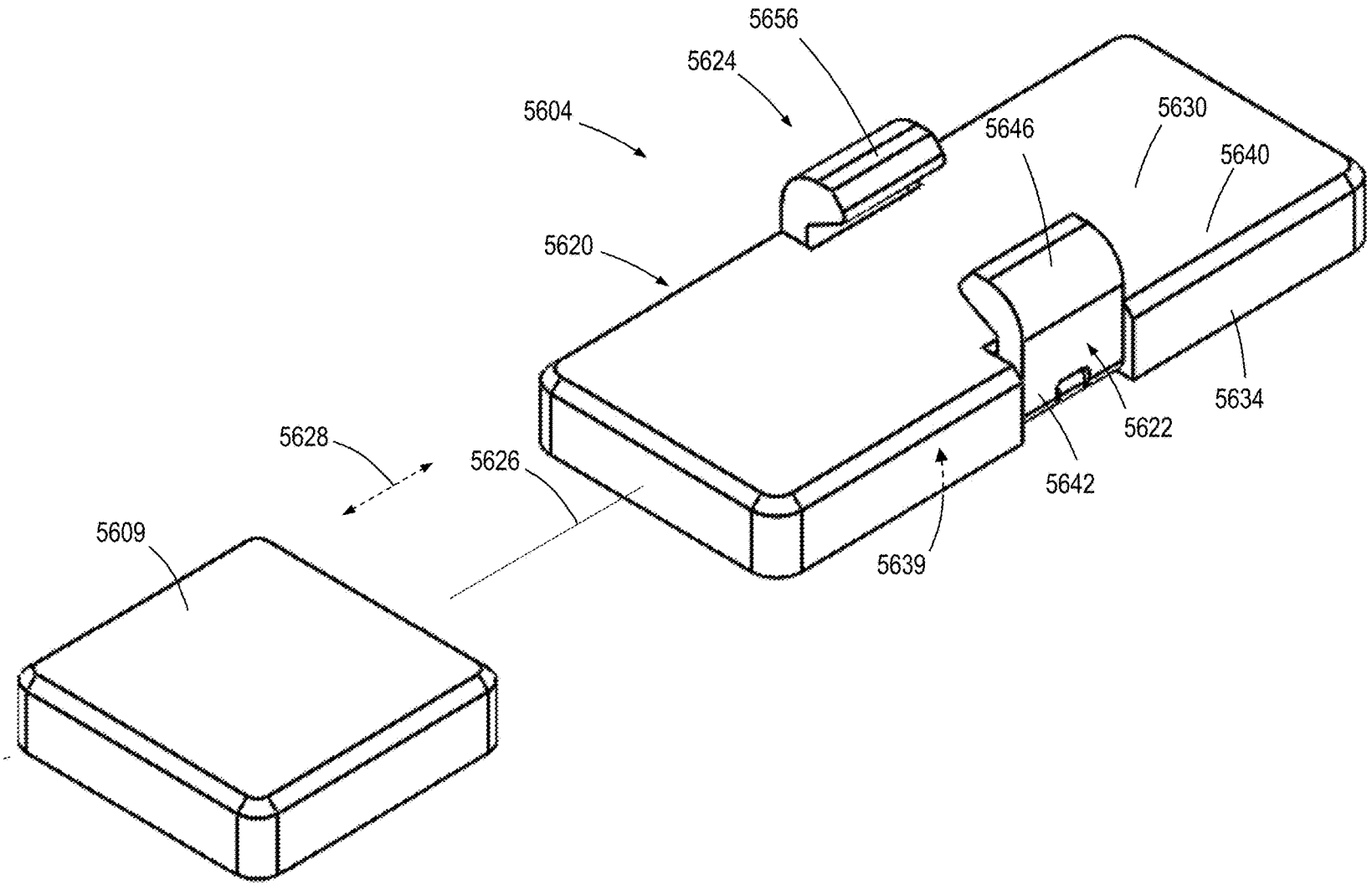
FIG. 62 is an enlarged perspective view of a portion of the system of FIG. 56, in a first state, in accordance with at least some embodiments.

FIG. 62 is an enlarged perspective view of the binding system 5604, with the binding system 5604 in the first (or releasably attached) state, in accordance with at least some embodiments.

Referring also now to FIGS. 61-62, in at least some embodiments, the binding system 5604 and/or binding plate 5620 may have a longitudinal axis 5626 (FIG. 62) and/or may extend in longitudinal directions 5628 (FIG. 62). In at least some embodiments, the longitudinal axis 5626 of the binding system 5604 and/or binding plate 5620 may be co-extensive with the longitudinal axis 5610 of the system 5600. The clamps 5622, 5624 may be disposed on opposite sides of the longitudinal axis 5610 and/or the longitudinal axis 5626.

Figure 63:
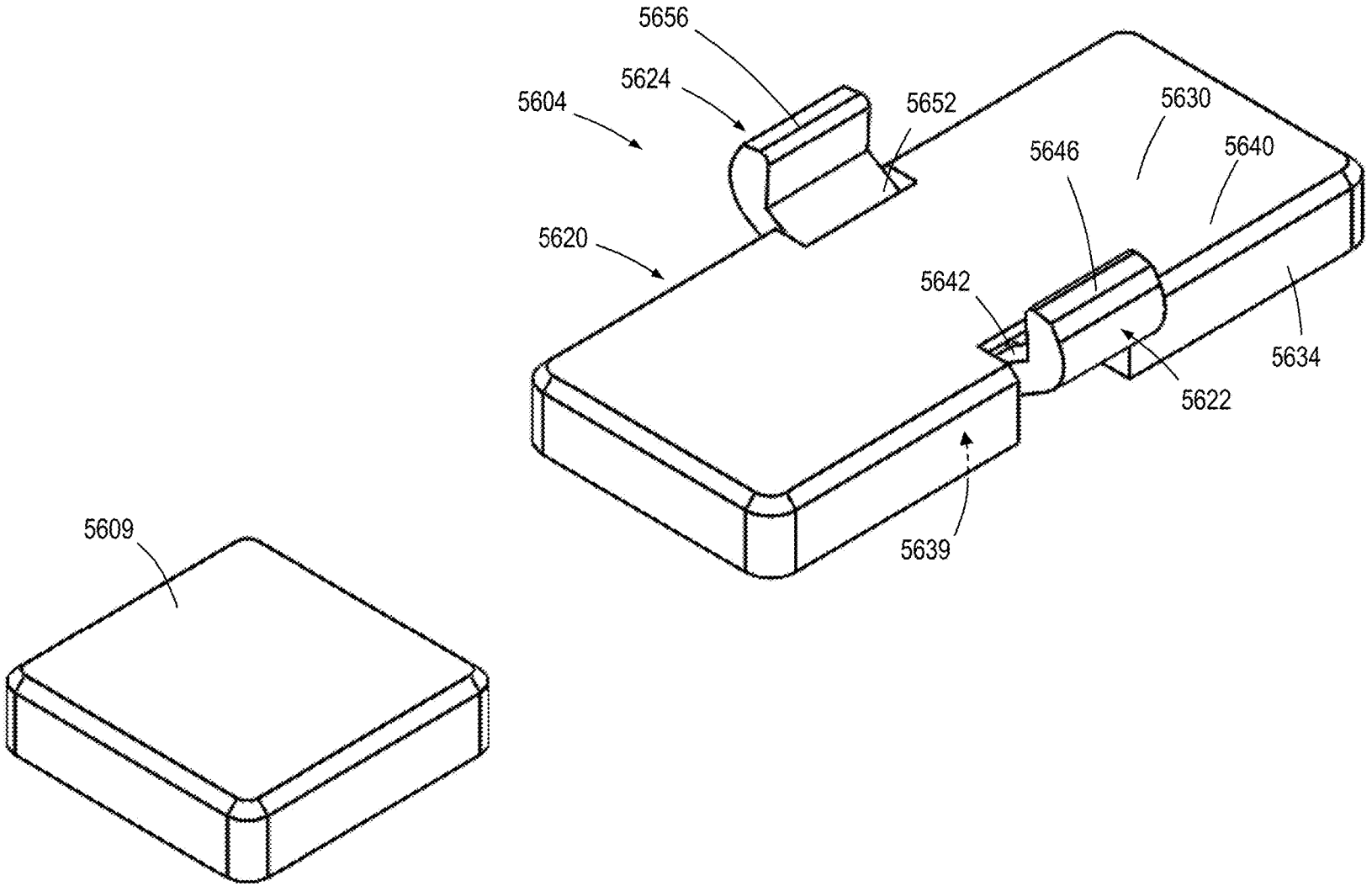
FIG. 63 is an enlarged perspective view of a portion of the system of FIG. 56, in a second state, in accordance with at least some embodiments.

FIG. 63 is an enlarged perspective view of the binding system 5604, with the binding system 5604 in the second (or released or detached) state, in accordance with at least some embodiments.

Figure 64:
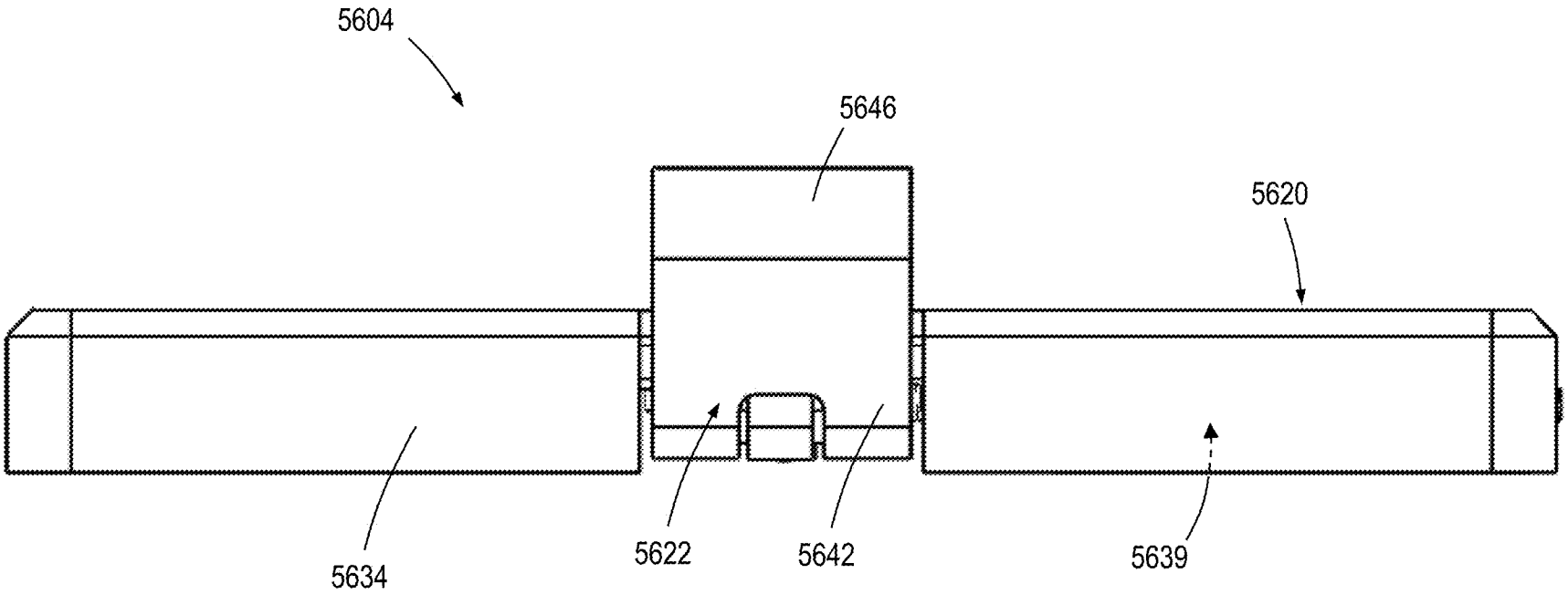
FIG. 64 is an enlarged side view of a portion of the system of FIG. 56, in accordance with at least some embodiments.

FIG. 64 is an enlarged side view of the binding system 5604, with the binding system 5604 in the first (or releasably attached) state, in accordance with at least some embodiments.

Figure 65:
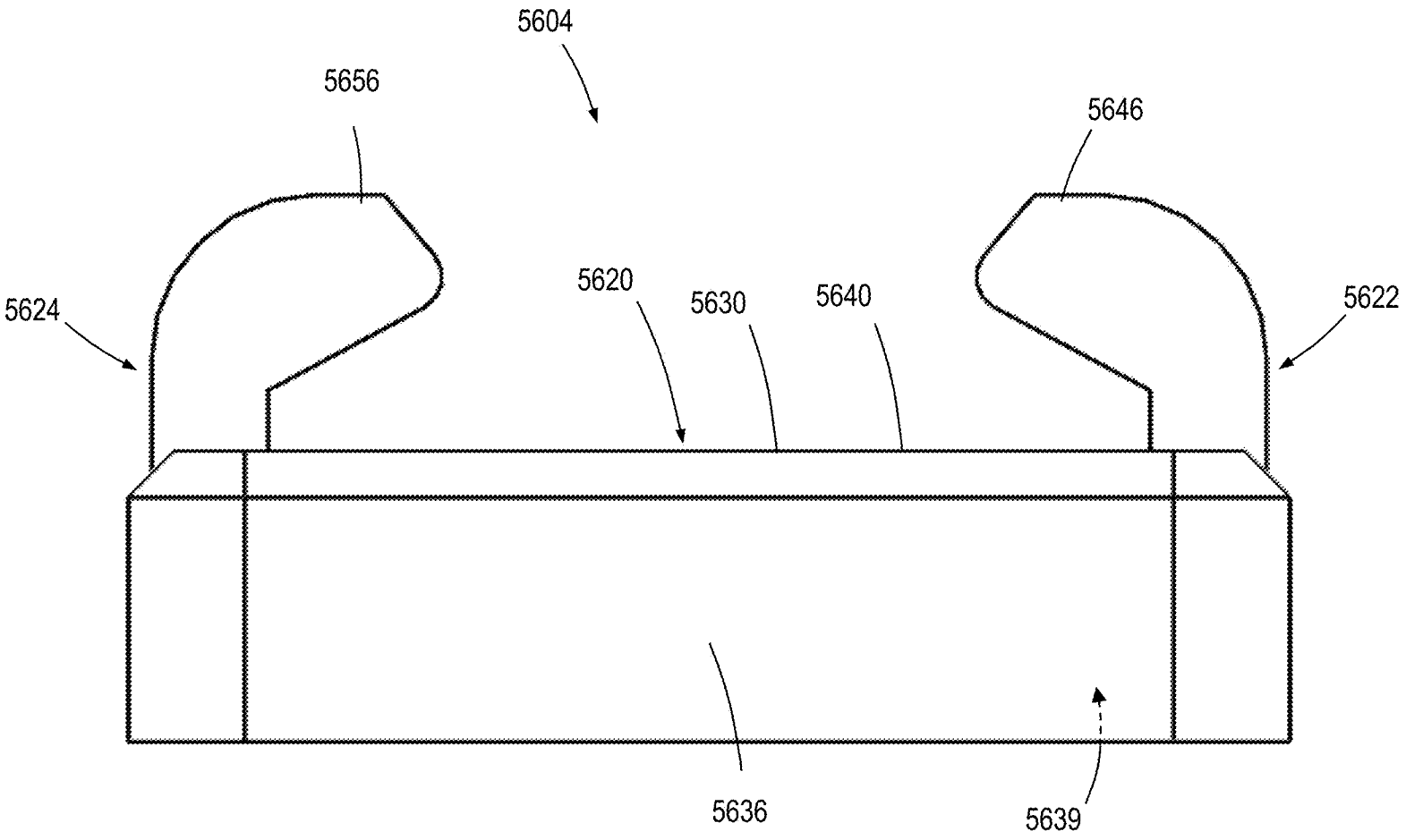
FIG. 65 is an enlarged end view of a portion of the system of FIG. 56, in accordance with at least some embodiments.

FIG. 65 is an enlarged end view of the binding system 5604, with the binding system 5604 in the first (or releasably attached) state, in accordance with at least some embodiments.

Figure 66:
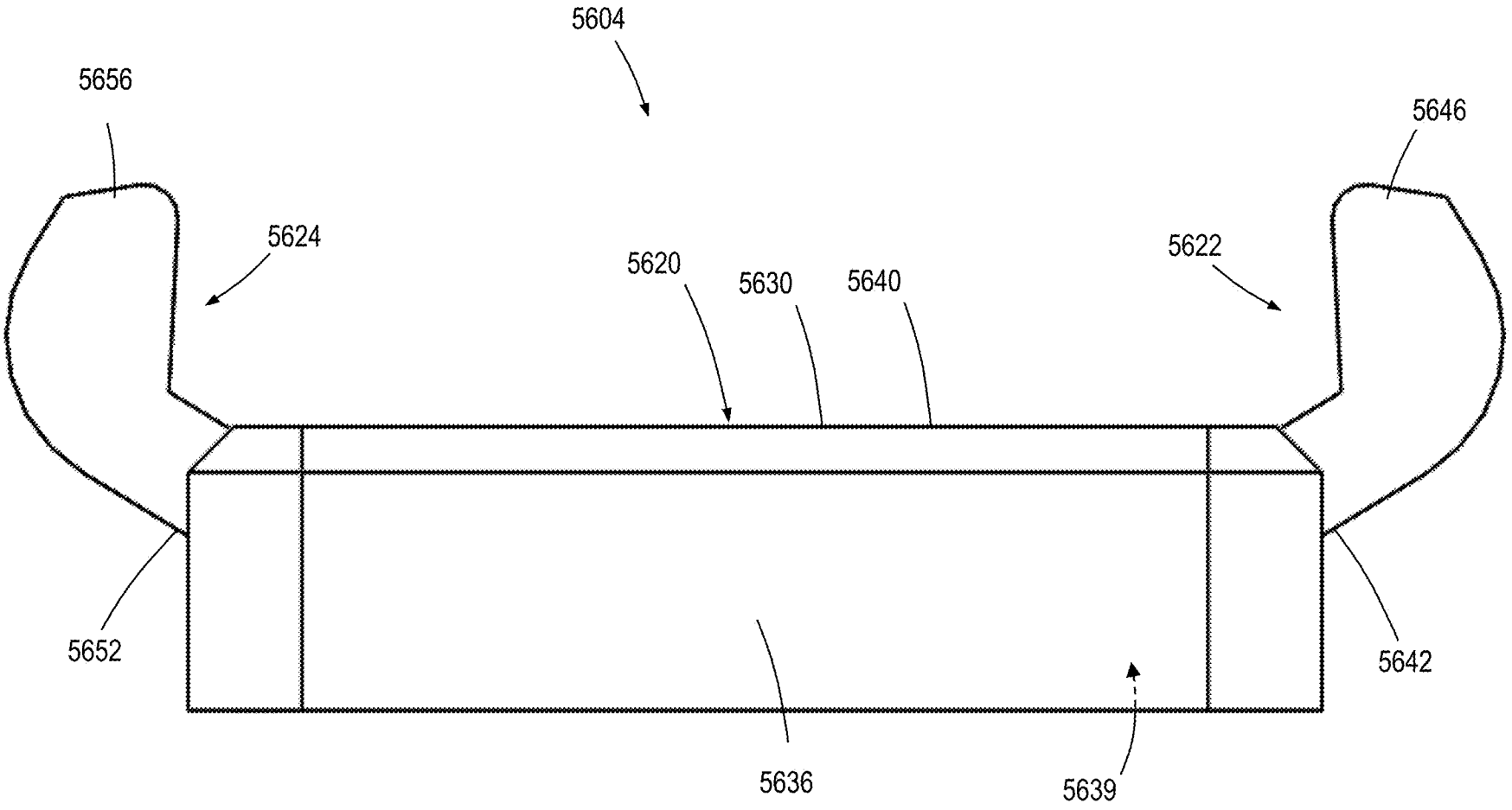
FIG. 66 is an enlarged end view of a portion of the system of FIG. 56, in accordance with at least some embodiments.

FIG. 66 is an enlarged end view of the binding system 5604, with the binding system 5604 in the second (or released or detached) state, in accordance with at least some embodiments.

Figure 67:
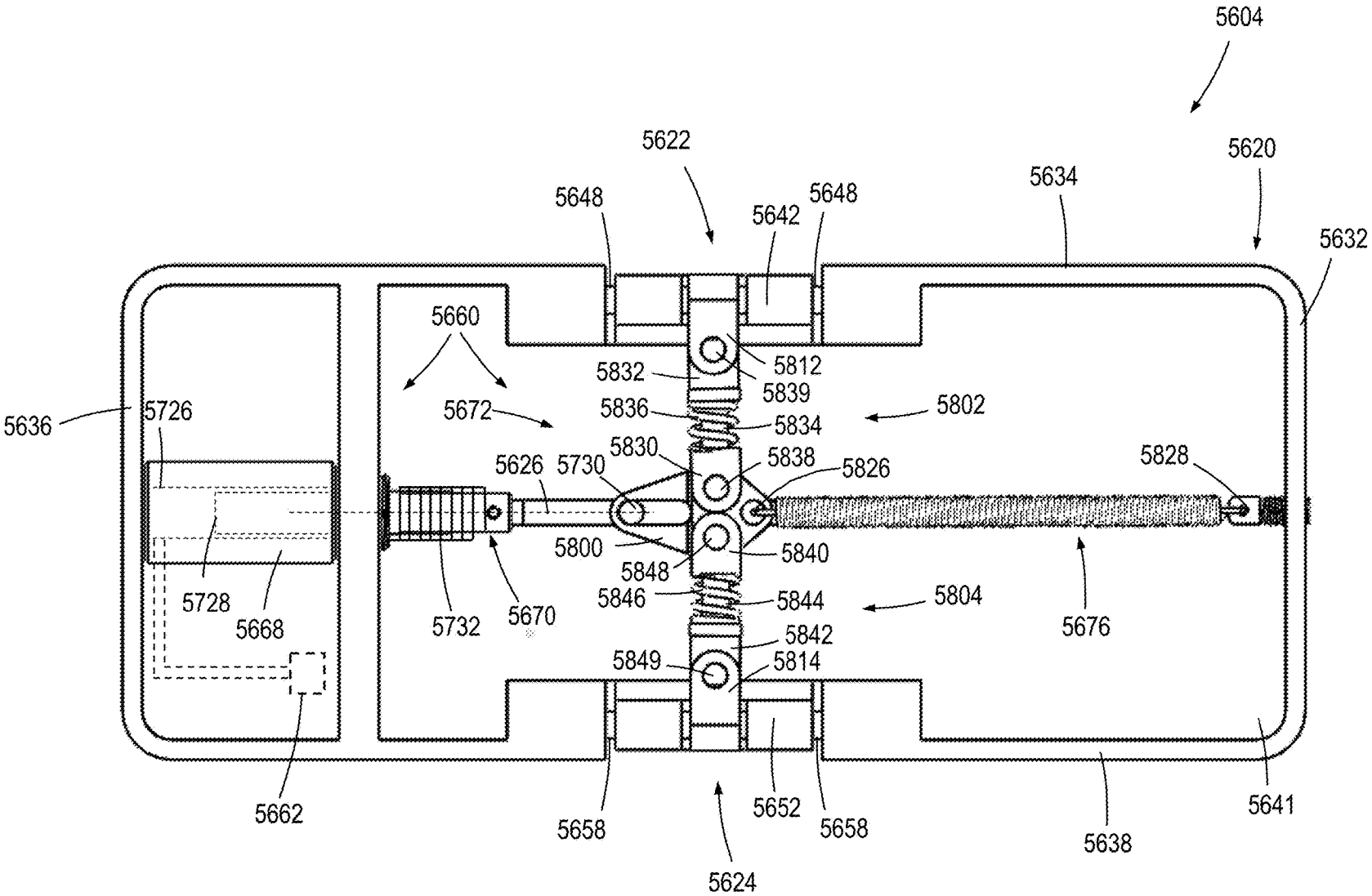
FIG. 67 is an enlarged bottom view of to portion of the system of FIG. 56, in the first state, in accordance with at least some embodiments.

FIG. 67 is an enlarged bottom view of the binding plate 5620 and portions of the binding system 5604 disposed therein, with the binding system 5604 in the first state, in accordance with at least some embodiments.

Figure 68:
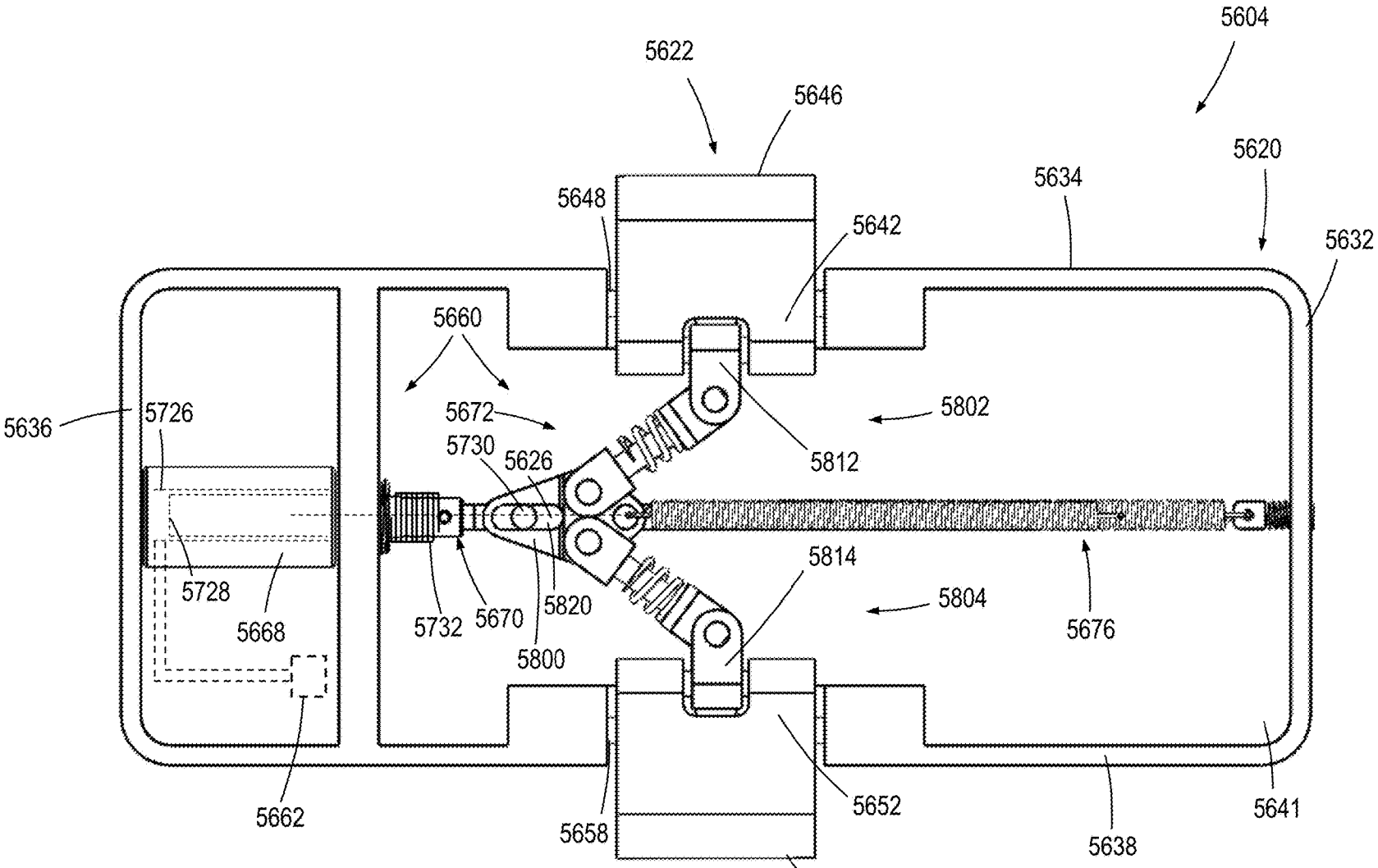
FIG. 68 is an enlarged bottom view of a portion of the system of FIG. 56, in the second state, in accordance with at least some embodiments.

FIG. 68 is an enlarged bottom view of the binding plate 5620 and portions of the binding system 5604 disposed therein, with the binding system in the second state, in accordance with at least some embodiments.

Referring also now to FIGS. 63-68, in at least some embodiments, the binding plate 5620 may include a top 5630, a side 5632 (sometimes referred to herein as rear side 5632), a side 5634, a side 5636 (sometimes referred to herein as front side 5636) and a side 5638. A bottom of the binding plate 5620 may be open at least in part and thereby define an opening 5639 (FIGS. 61-66). The top may have an upper surface 5640 and a lower surface 5641 (FIGS. 67-68).

The two clamps 5622, 5624 may each comprise an arm and a jaw coupled to the arm. In at least some embodiments, including but not limited to the illustrated embodiment, the clamp 5622 may comprise an arm 5642 and a jaw 5646 coupled to the arm 5642. The clamp 5624 may comprise an arm 5652 and a jaw 5656 coupled to the arm 5652.

The arms 5642, 5652 may be laterally spaced from one another, and may be pivotably or otherwise rotatably coupled to the binding plate 5620 by shafts 5648, 5658 (FIGS. 67-68), respectively, or otherwise (e.g., other pivots).

In at least some embodiments, the arms 5642, 5652 are disposed on opposite sides of and/or spaced laterally from the longitudinal axis 5610 and/or the longitudinal axis 5626.

The arms 5642, 5652 may have a first position (e.g., FIGS. 61-62, 65 and 67) in which the jaws, e.g., jaws 5646, 5656, have a first lateral spacing and releasably retain the boot plate 5606 to the binding plate. The arms 5642, 5652 may also have a second position (e.g., FIGS. 63, 66 and 68) in which the jaws 5646, 5656 have a second lateral spacing greater than the first lateral spacing and are spaced apart from the boot plate 5606.

In at least some embodiments, with the arms 5642, 5652 in their first position, the jaws 5646, 5656 contact the boot plate 5606 and force the boot plate 5606 against the binding plate 5620 or otherwise trap the boot plate 5606 relative to the binding plate 5620, to thereby releasably attach the boot plate 5606 (and a boot, e.g., boot 5608, to which the boot plate 5606 is attached) to the binding plate 5620, and in doing so, prevent or otherwise limit movement of the boot plate 5606 relative to the binding plate 5620. In at least some embodiments, movement may be prevented or otherwise limited in three dimensions (e.g., longitudinal, lateral and vertical).

In at least some embodiments, with arms 5642, 5652 in their second position, the jaws 5646, 5656 may be in their position that is most spaced apart from the boot plate 5606 such that the boot plate 5606 (and a boot, e.g., boot 5608, to which the boot plate 5606 is attached) is most easily removed from the binding plate 5620.

The binding system 5604 may further include a processor controlled latch and release system 5660. The latch and release system 5660 may include a processor based control system 5662, a solenoid 5668, a plunger 5670, linkage 5672 and a spring 5676 (or other bias element(s)).

As stated above, ideally, a binding system keeps the boot plate (and thus the boot attached thereto) securely attached to the ski during normal use, and releases the boot plate (and thus the boot attached thereto) from the ski during a fall or other mishap in order to prevent the ski from exerting undue torque, tension or force on the skier's leg and thereby causing injury.

The control system 5662 may be coupled to the solenoid 5668 and configured to receive one or more signals, from one or more sensors or otherwise, indicative of one or more conditions of the skier and/or system 100, and determine, based at least in part thereon, whether (and/or when) to power the solenoid 5668 to initiate release of the boot plate 5606 (and boot 5608 to which the boot plate 5606 is mounted).

The control system 5662 may have a centralized or distributed architecture. In at least some embodiments, one or more portions of the control system 5662 may be disposed on or otherwise coupled to the binding plate 5620. In some at least some embodiments, one or more portions of the control system 5662 may be disposed on or otherwise coupled to the skier and/or an article (e.g., clothing or otherwise) worn by the skier.

In at least some embodiments, the control system 5662 (or one or more portions thereof) may be the same as and/or similar to one or more portions of one or more embodiments of the control system 162.

The solenoid 5668 may have a first state (e.g., unpowered, FIG. 67) and a second state (e.g., powered, FIG. 68) and may define a channel 5726 configured to receive the plunger 5670. The channel 5726 may be elongated and may extend in (or at least substantially in) the longitudinal directions 5612 and/or the longitudinal directions 5628. In at least some embodiments, including but not limited to the illustrated embodiment, the solenoid 5668 and channel 5726 may be disposed on and extend along the longitudinal axis 5610 and/or the longitudinal axis 5626.

The plunger 5670, which may also be elongated and may extend in (or at least substantially in) the longitudinal directions 5612 and/or the longitudinal directions 5628, may include a first (or proximal) end 5728 and a second (or distal) end 5730. The first end 5728 may be slidingly received within the channel 5726 defined by the solenoid 5668. The second end 5730 may be biased away from the solenoid 5668 by a spring 5732 (or other bias element(s)), which may be disposed circumferentially about the plunger 5670. In at least some embodiments, including but not limited to the illustrated embodiment, the plunger 5670 may be centered about (or otherwise disposed on) and extend along the longitudinal axis 5610 and/or the longitudinal axis 5626.

The plunger 5670 may have a first position (e.g., FIG. 67) associated with the first state of the solenoid 5668 and a second position (e.g., FIG. 68), which may be forward of the first position, associated with the second state of the solenoid 5668. In at least some embodiments, including but not limited to the illustrated embodiment, the second end 5730 of the plunger 5670 is displaced in (or at least substantially in) the longitudinal directions 5612 and/or the longitudinal directions 5628 if the plunger 5670 moves from its first position to its second position.

The linkage 5664 may be coupled between the plunger 5670 and the arm 5642 of the first clamp 5622 and between the plunger 5670 and the arm 5652 of the second clamp 5624.

In at least some embodiments, including but not limited to the illustrated embodiment, the linkage 5664 may include a coupler 5800, first and second links 5802, 5804 and first and second cams 5812, 5814 (or other motion converters, e.g., bevel gears).

The coupler 5800 may have a forward end and/or other portion slidably or otherwise coupled to the plunger's second end 5730 (which may comprise a raised portion) or other portion of the plunger 5670. Thus, the coupler 5800 may have a first position (e.g., FIG. 67) associated with the first position of the plunger 5670 and a second position, which may be forward of the first position of the coupler 5800, associated with the second position of the plunger 5670.

In at least some embodiments, including but not limited to the illustrated embodiment, the coupler 5800 may be coupled to a portion of the plunger 5670 that is displaced in (or at least substantially in) the longitudinal directions 5612 and/or the longitudinal directions 5628 if the plunger 5670 moves from its first position to its second position, such that the coupler 5800 will be displaced in (or at least substantially in) the longitudinal directions 5612 and/or the longitudinal directions 5628 if the plunger 5670 moves from its first position to its second position.

The coupler 5800 may define a slot 5820 or other channel, which may be elongated and may extend in (or at least substantially in) longitudinal directions 5612 and/or longitudinal directions 5628. The slot 5820 or other channel may receive the second end 5730 (which may comprise a raised portion) or other portion of the plunger 5670 to guide at least in part any sliding movement between the plunger 5670 and the coupler 5800. In at least some embodiments, including but not limited to the illustrated embodiment, the slot 5820 may be centered about (or otherwise disposed on) and extend along the longitudinal axis 5610 and/or the longitudinal axis 5626.

The coupler 5800 may have a rear end or other portion coupled to a first end 5826 of the spring 5676 (or other bias element), which may have a second end 5828 coupled to the rear side 5632 of the binding plate 5620 to bias the coupler 5800 rearward toward its first position. In at least some embodiments, including but not limited to the illustrated embodiment, the spring 5676 may be centered about (or otherwise disposed on) and extend along the longitudinal axis 5610 and/or the longitudinal axis 5626.

In at least some embodiments, including but not limited to the illustrated embodiment, the coupler 5800 may comprise a plate having a diamond or other shaped perimeter (which may be symmetrical about one or more axis).

The first and second links 5802, 5804 may be disposed on opposite sides of the coupler 5800 and may be coupled between the coupler 5800 and the first and second cams 5812, 5814, respectively (which in turn may be coupled to the arms 5642, 5652, respectively, of the first and second clamps 5622, 5624, respectively).

Thus, the first and second links 5802, 5804 may have a first position (e.g., FIG. 67) associated with a first position of the coupler 5800 and a second position (e.g., FIG. 68) associated with a second position of the coupler 5800.

The first link 5802 may have a first end 5830 (FIG. 67), a second end 5832 (FIG. 67) and a shaft 5834 (FIG. 67) extending therebetween. The shaft 5834 may have first and second ends which may be received (movably or fixedly) by the first and second ends 5830, 5832, respectively, of the first link 5802. One or more of the first and second ends 5830, 5832 of the first link 5802 may define a channel (not shown) to slidingly or otherwise movably receive the respective end of the shaft 5834 to allow the first link 5802 to extend and contract. Thus, the first link 5802 may be extendable and may have a first state (e.g., FIG. 67) and a second state (e.g., FIG. 68) extended compared to its first state. The first link 5802 may include a spring 5836 (or other bias element(s)), which may be disposed circumferentially about its shaft 5834 and which may bias the first link 5802 toward its second state.

The first end 5830 or other portion of the first link 5802 may be pivotably coupled to a first side or other portion of the coupler 5800 by a shaft 5838 or otherwise. The second end 5832 or other portion of the first link 5802 may be pivotably coupled to a first end or other portion of the first cam 5812 by a shaft 5839 or otherwise. The first cam 5812 may have a second end pivotably or otherwise rotatably coupled to the arm 5642 of the first clamp 5622.

The second link 5804 may have a first end 5840 (FIG. 67), a second end 5842 (FIG. 67) and a shaft 5844 (FIG. 67) extending therebetween. The shaft 5844 may have first and second ends which may be received (movably or fixedly) by the first and second ends 5840, 5842, respectively, of the second link 5804. One or more of the first and second ends 5840, 5842 of the second link 5804 may define a channel to slidingly or otherwise movably receive the respective end of the shaft 5844 to allow the second link 5804 to extend and contract. Thus, the second link 5804 may be extendable and may have a first state (e.g., FIG. 67) and a second state (e.g., FIG. 68) extended compared to its first state. The second link 5804 may include a spring 5846 (or other bias element(s)), which may be disposed circumferentially about its shaft 5844 and which may bias the second link 5804 toward its second state.

The first end 5840 or other portion of the second link 5804 may be pivotably coupled to a second side or other portion of the coupler 5800 by a shaft 5848 or otherwise. The second end 5842 or other portion of the second link 5804 may be pivotably coupled to a first end or other portion of the second cam 5814 by a shaft 5849 or otherwise. The second cam 5814 may have a second end pivotably or otherwise rotatably coupled to the arm 5652 of the second clamp 5624.

In at least some embodiments, including but not limited to the illustrated embodiment, the first ends 5830, 5840 of the first and second links 5802, 5804, respectively, may be displaced in (or at least substantially in) the longitudinal directions 5612 and/or the longitudinal directions 5628 if the first and second links 5802, 5804 move from their first position to their second position. The second ends 5832, 5842 of the first and second links 5802, 5804, respectively, may be displaced in (or at least substantially in) lateral directions if the first and second links 5802, 5804 move from their first position to their second position.

In at least some embodiments, including but not limited to the illustrated embodiment, the first and second cams 5812, 5814 convert the displacement of the first and second ends 5832, 5842 (or other portions) of the first and second links 5802, 5804, respectively, into pivotal or otherwise rotational motion, which causes pivotal or otherwise rotational motion of the first and second clamps 5622, 5624, e.g., from their first position (e.g., FIG. 67) to their second position (e.g., FIG. 68).

In at least some embodiments, the binding system 5604 has a latch state (e.g., FIG. 67) and a release state (e.g., FIG. 68). In at least some embodiments, the latch state operates as follows. The arms 5642, 5652, of the clamps 5622, 5624 are in a first position (e.g., FIG. 67) in which the jaws have a first lateral spacing and releasably retain the boot plate 5606 to the binding plate 5620. The solenoid 5668 is in a first state (e.g., unpowered, FIG. 67) and the plunger 5670 is in its first position (e.g., FIG. 67), thereby allowing the coupler 5800 to be in its first position (e.g., FIG. 67). Such positioning of the coupler 5800 retains the first and second links 5802, 5804 in their first position, which retains the first and second cams 5812, 5814 in their first position, which retains the arms 5642, 5652, respectively, of the clamps 5622, 5624, respectively, in their first position to releasably attach the boot plate 5608 to the binding plate 5620.

In at least some embodiments, the release state operates as follows. The solenoid 5668 is powered (e.g., energized, FIG. 68) and the resulting magnetic field results in a force that counters the bias of the spring 5732 or other bias element and pulls the plunger 5670 from its first position forward to its second position, which in turn pulls the coupler 5800 from its first position forward to its second position, which in turn pulls the first and second links 5802, 5804 from their first position to their second position. The movement of the first and second links 5802, 5804 pulls the first end of the cams 5812, 5814 laterally inward, which in turn causes the arms of the clamps to pivot or otherwise rotate (e.g., laterally outward) toward their second position in which the jaws 5646, 5656 have a second lateral spacing greater than the first lateral spacing and in which the jaws 5646, 5656 are spaced apart from the boot plate 5608 (released state).

In at least some embodiments, the binding system 5604 further includes a heel lock.

In at least some embodiments, the binding system 5604 may have a heel lock as described above with respect to FIGS. 14-20.

As stated above, the plurality of sensors 5562 may comprise any type(s) of sensors.

In at least some embodiments, one or more of the sensors 5562 may provide one or more of the following types of motion and position sensing for tracking body movements: mechanical, magnetic, optical, acoustic and/or inertial. Mechanical trackers often include linkages with linear and rotary potentiometers to determine relative angle and position between limbs. They are physically mounted to the body by which one sensor measures one degree of freedom the joint. Magnetic sensors utilize AC or DC magnetic fields to determine the position and orientation of a sensor relative to a source transmitter. Optical sensors include both camera and laser-based systems. Cameras utilize a pixel array for 30 Hz-120 Hz frame rates that are processed via a computer to determine position and orientation. Laser based systems, such as LIDAR, typically produce a point cloud designated by distances and angles. Processing of the point cloud reveals body position and orientation. RADAR is similar but relies more heavily on wave functions for higher resolution imaging. Acoustic sensors rely on time-of-flight measurements over an array of sensors to triangulate sensor position relative to the source transmitter. Inertial sensors include accelerometers and gyroscopes to map motions of the bodies that the sensors are mounted to. In at least some embodiments, a model may be used to relate the inertial measurements to the body orientation and position.

In some embodiments, it may be desirable to employ a combination of the above different types of sensors so as to provide a hybrid sensor system that may be capable of improving upon any given singular solution by drawing on their unique advantages.

Figure 69:
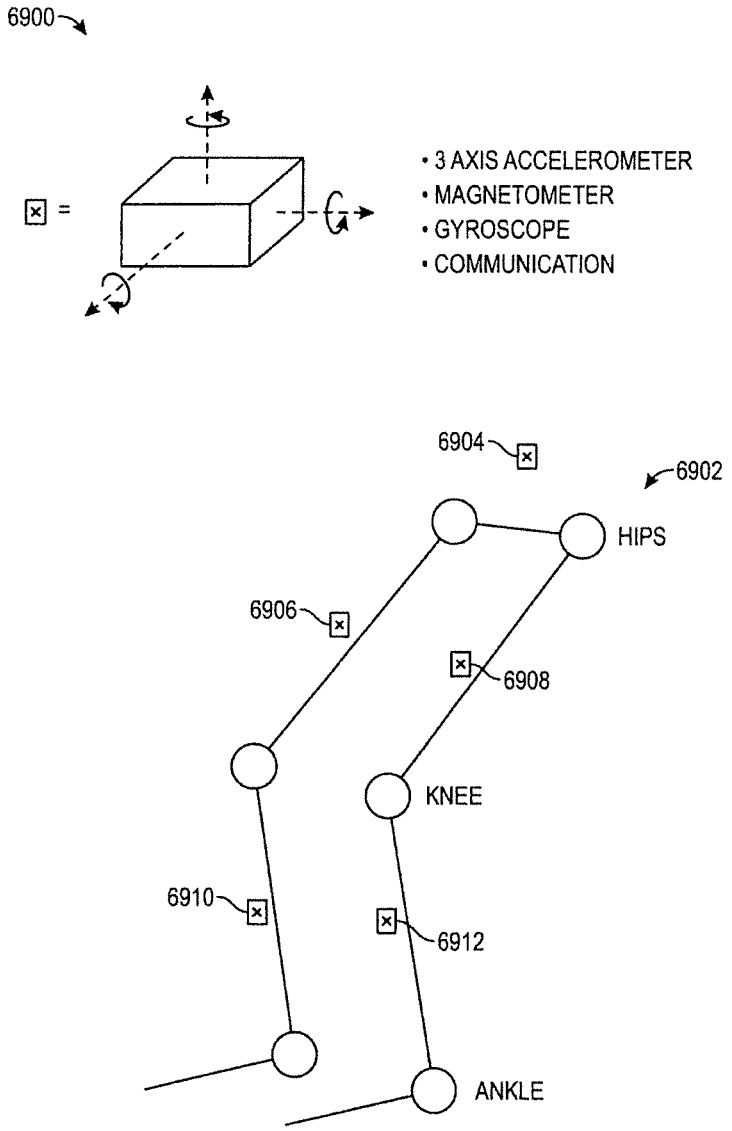
FIG. 69 is a schematic representation of a sensor system, in accordance with at least some embodiments.

FIG. 69 is a schematic representation of one embodiment of the sensor system 5662.

Referring to FIG. 69, in accordance with at least some embodiments, the sensor system 5662 may include a plurality of inertial (or other type) sensors positioned on a skier 6902. The plurality of sensors may include a sensor 6904 positioned on a hip of the skier, a sensor 6906 positioned on a right femur of the skier, a sensor 6908 positioned on a left femur of the skier, a sensor 6910 positioned on a right tibia of the skier and a sensor 6912 positioned on a left tibia of the skier. In at least some embodiments, including but not limited to the illustrated embodiment, an inertial sensor is capable of measuring: (1) three axis acceleration via a three axis accelerometer, (2) three axis rotational velocity via a three axis gyroscope, and (3) absolute heading via a magnetometer.

In at least some embodiments, the plurality of sensors, e.g., sensors 6904-6912, may be positioned to capture orientation of the knee and hip joints. To that effect, each sensor may be positioned on the leg such that the difference between relative measurements can be used to calculate knee and hip position and motion. The tibia sensors may be positioned in the center-front of the tibia. The femur sensors may be positioned on the center top of the femur. The hip sensor or sensors may be positioned above the crotch and below the belly button where a belt-buckle might fall, central to the skier's hip.

In at least some embodiments, one or more portions of the control system 162 may be integrated into or otherwise mounted on clothing or other article(s) worn by a skier.

Figure 70:
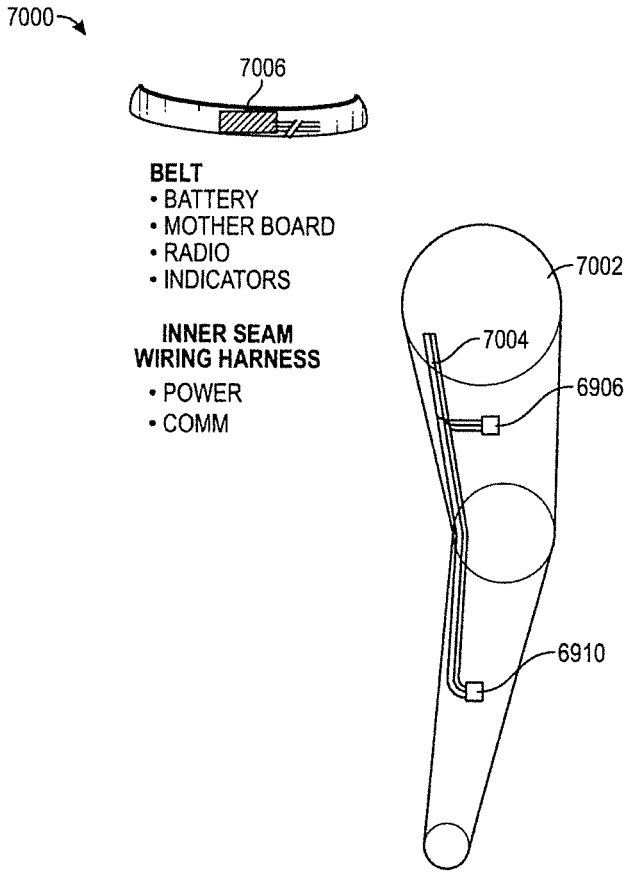
FIG. 70 is a schematic representation of clothing that may be worn by a skier and portions of a control system that may be integrated into or otherwise mounted thereon, in accordance with at least some embodiments.

FIG. 70 is a schematic representation of clothing that may be worn by a skier, e.g., skier 6902, and portions of the control system 162 that may be integrated into or otherwise mounted thereon, in accordance with at least some embodiments.

Referring to FIG. 70, in accordance with at least some embodiments, the clothing that may be worn by a skier, e.g., skier 6902, may include a belt 7000 and a pair of leggings 7002 (thermal or otherwise) (only one leg is shown), which may be stitched into an inner lining of ski pants worn by the skier, or may be independently provided and worn as such.

Sensors to be positioned on the legs of the skier, e.g., sensors 6906-6912 (FIG. 69), may be integrated into or otherwise mounted on the leggings 7002.

A wiring harness (or wiring in any other form) 7004 may distribute power to, and communication signals to and/or from, some or all of the sensors positioned on the legs of the skier. In at least some embodiments, the wiring harness may be routed on an interior seam of the leg to help reduce potential damage from falls and general abuse. In at least some embodiments, the wiring may have the form of a power and communication bus, which may connect the sensors. In some embodiments, the power and/or communication bus may run the length of the leggings 7002.

One or more other portions 7006 of the control system 162 may be integrated into or otherwise mounted on the belt 7000. In at least some embodiments, these other portions may include: (1) a motherboard, (2) a radio for communication to: a smart phone and/or a network (Bluetooth or otherwise) enabled device, (3) a battery, e.g., for powering the control system 162 or portions thereof, (4) battery charging circuitry, (5) a waist sensor and/or (6) one or more visible network status indicators, integrated into or otherwise mounted on the belt 7000. In at least some embodiments, the motherboard itself includes the: (2) radio for communication to: a smart phone and/or a network (Bluetooth or otherwise) enabled device, (3) battery, (4) battery charging circuitry, (5) waist sensor and/or (6) one or more visible network status indicators, and is integrated into or otherwise mounted on the motherboard.

Data from the sensors, e.g., sensors 6904-6912, may be sampled (continuously or otherwise) by the processor 5560.

In at least some embodiments, the processing may include a model of the skier. In at least some embodiments, this model is a physiological model is used to "observe" all sensors. In at least some embodiments, the sensor data is supplied to the model which may generate one or more signals in response at least thereto. Sensor data may be combined via a digital filter that incorporates the model to recursively update the current skier orientation, speed, and heading. Such data may be used to predict if a potential injury will occur. In at least some embodiments, the ski binding safely releases prior to the injury.

In at least some embodiments, the processor 5560 may be responsible for updating the skier model, determining the release decision (i.e., a decision as to whether to release the ski boot), recording performance data and/or communicating to an application on a user device and/or a separate computer.

In at least some embodiments, the model of the skier may comprise a set of equations relating model inputs and sensor readings. The set of equations may be integrated using a variant of traditional Kalman filtering to output limb and body position, velocity, and muscle activity.

In at least some embodiments, the model of the skier is used within a feedback structure as an "observer" whereby the model is used to inform predictions of future body position, but incorrect predictions update the model when necessary. In this way, the algorithm is able to predict danger of ACL damage and skier injury.

In at least some embodiments, the control system 162 may include a self-check process that has the purpose of measuring and diagnosing the health of each critical component. In at least some embodiments, the result of the system check is readable via a ski-binding light with pre-programmed sequences (red, yellow, green, blinking red, for example) and/or via a smart phone application which may contain more detailed diagnostics. Each system check result may be tracked via personal profile linked to the binding to alert the skier of component damage of health degradation.

In at least some embodiments, the system check isolates key system features including: (1) binding release mechanism via a current and position monitor, (2) sensor response and calibration via a user sequence of actions and/or (3) software and firmware version control.

In at least some embodiments, if the system-check determines that the system is not suitable for skiing, the system does not allow the ski binding to close and the user is unable to use the ski binding or it's features. A log may be stored for individual diagnostic troubleshooting.

In at least some embodiments, a wireless controller is installed on the binding or on the ski pole to manually trigger the entry and release of the binding. In at least some embodiments, a system check is performed with each entry of the ski. In at least some embodiments, the user need not access their phone for usage, all controls are ergonomic for glove wearing skier.

There have been numerous studies investigating the proper DIN number for ski bindings across gender and age boundaries that typically consider number of false releases compared to number of ankle and knee injuries caused by a lack of release. In at least some embodiments, an extensive profile of the profile should enable data better correlated for physical conditions most relevant to likelihood of an ACL injury.

In at least some embodiments, the skier model is an important dataset that is initially calibrated to the skier via an extensive physical evaluation. The model may include: (1) a questionnaire with traditional height, weight, skiing ability, gender, age, (2) a model using the sensors for limb length, form, and musculature, (3) a process to update the model based on skiing performance. For example, the forces and positions of the sensor array can be compared against the expectations from the model and updated accordingly and/or (4) a database keeping track of each model, skiing data, and an event log documenting releases and their conditions to better predict misses, false alarms, or hits. (Miss=did not release when it should have, False Alarm (FA)=a release when it should have not, Hit=a release when it should have).

In at least some embodiments, the ski model and data recording may be used by an individual or coach to gauge skier performance for safe and proper ski technique. In at least some embodiments, the system may include software (artificial intelligence software or otherwise) to label where poor or unsafe technique was measured. The software may record the data that would be necessary for visual replay. In at least some embodiments, akin to a race car driver re-driving a race track or course, the user will be able to replay their downhill run via a simulator or other similar device.

In at least some embodiments, the system may be used to augment skier performance in real time via auxiliary systems such as: (1) ski stiffeners, (2) muscle/limb enhancements, (3) Ski shape deformation and/or (4) trajectory/terrain mapping.

In at least some embodiments, the ski binding system may be a suitable platform for integrating safety features that may be especially useful for off-trail skiing. These may include (1) location tracking, (2) avalanche detection, (3) emergency alert system and/or (4) audible and visual signals.

It should be understood that the features disclosed herein may be used in any combination or configuration. Thus, in at least some embodiments, any one or more of the embodiments (or feature(s) thereof) disclosed herein may be used in association with any other embodiment(s) (or feature(s) thereof) disclosed herein. In at least some embodiments, any one or more of the features disclosed herein may be used without any one or more other feature disclosed herein.

Also, as described, some aspects may be embodied as one or more methods. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Unless stated otherwise, a processor may comprise a microprocessor and/or any other type of processor. For example, a processor may be programmable or non-programmable, general purpose or special purpose, dedicated or non-dedicated, distributed or non-distributed, shared or not shared, and/or any combination thereof. A processor may include, but is not limited to, hardware, software (e.g., low-level language code, high-level language code, microcode), firmware, and/or any combination thereof.

The terms "program" or "software" are used herein in a generic sense to refer to any type of computer code or set of computer-executable instructions that may be employed to program a computer or other processor to implement various aspects as described above. Additionally, it should be appreciated that according to one aspect, one or more computer programs that when executed perform methods of the present application need not reside on a single computer or processor, but may be distributed in a modular fashion among a number of different computers or processors to implement various aspects of the present application.

Computer-executable instructions may be in many forms, such as for example, but not limited to, program modules, executed by one or more computers or other device(s).

Unless stated otherwise, a program or software may include, but is not limited to, instructions in a high-level language, low-level language, machine language and/or other type of language or combination thereof.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

Unless stated otherwise, a processing device is any type of device that includes at least one processor.

Unless stated otherwise, a computing device is any type of device that includes at least one processor.

Unless stated otherwise, a control system is any type of control system that includes at least one processor.

Unless stated otherwise, a processing system is any type of system that includes at least one processor.

Further, it should be appreciated that a computer may be embodied in any of a number of forms, such as a rack-mounted computer, a desktop computer, a laptop computer, or a tablet computer, as non-limiting examples. Additionally, a computer may be embedded in a device not generally regarded as a computer but with suitable processing capabilities, including a Personal Digital Assistant (PDA), a smart phone or any other suitable portable or fixed electronic device.

Unless stated otherwise, a mobile (or portable) computing device includes, but is not limited to, any computing device that may be carried in one or two hands, worn on a body (or portion(s) thereof), affixed to a body (or portion(s) thereof) and/or implanted in a body (or portion(s) thereof).

Unless stated otherwise, a "communication link" may comprise any type(s) of communication link(s), for example, but not limited to, wired links (e.g., conductors, fiber optic cables) or wireless links (e.g., acoustic links, radio links, microwave links, satellite links, infrared links or other electromagnetic links) or any combination thereof, each of which may be public and/or private, dedicated and/or shared. In some embodiments, a communication link may employ a protocol or combination of protocols including, for example, but not limited to the Internet Protocol.

Unless stated otherwise, information may include data and/or any other type of information. Also, unless stated otherwise, data or other information may have any form(s) and may be received from any source(s) (internal and/or external).

Unless stated otherwise, a signal (control or otherwise) may have any form, for example, analog and/or digital, and is not limited to a single signal on a single line but rather, for example, may comprise multiple signals on a single line or multiple signals on multiple lines. Also, unless stated otherwise, a signal (control or otherwise) may have any source(s), internal and/or external.

Unless stated otherwise, terms such as, for example, "in response to" and "based on" mean "in response (directly and/or indirectly) at least to" and "based (directly and/or indirectly) at least on", respectively, so as not to preclude intermediates and being responsive to and/or based on, more than one thing.

Unless stated otherwise, terms such as "coupled to" and "attached to" mean "coupled (directly and/or indirectly) to" and "attached (directly and/or indirectly) to," respectively.

Unless stated otherwise, terms such as, for example, "comprises," "has," "includes," and all forms thereof, are considered open-ended, so as not to preclude additional elements and/or features.

Unless stated otherwise, terms such as, for example, "a," "one," "first," are considered open-ended, and do not mean "only a", "only one" or "only a first", respectively.

Unless stated otherwise, the term "first" does not, by itself, require that there also be a "second."

Unless stated otherwise, the phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Elements other than those specifically identified by the "and/or" clause may optionally be present, whether related or unrelated to those elements specifically identified. Thus, as a non-limiting example, a reference to "A and/or B", when used in conjunction with open-ended language such as "comprising" may refer, in one embodiment, to A only (optionally including elements other than B); in another embodiment, to B only (optionally including elements other than A); in yet another embodiment, to both A and B (optionally including other elements); etc.

Having thus described several aspects and embodiments of the technology of this application, it is to be appreciated that various alterations, modifications, and improvements will readily occur to those of ordinary skill in the art. Such alterations, modifications, and improvements are intended to be within the spirit and scope of the technology described in the application. For example, those of ordinary skill in the art will readily envision a variety of other means and/or structures for performing the function and/or obtaining the results and/or one or more of the advantages described herein, and each of such variations and/or modifications is deemed to be within the scope of the embodiments described herein.

What is claimed is:

1. A processor-controlled snow sports binding system, comprising:

a snow sport binding system that controllably releases a boot from a snow sport apparatus;

the binding system comprising a pair of opposing clamps that have a first position which secures said boot to said snow sport apparatus and a second position which releases said boot from said snow sports apparatus, said binding system further comprising a mechanical linkage which controllably moves between a first position of the mechanical linkage causing said clamps to be in said first position thereof, securing said boot, and a second position of the mechanical linkage causing said clamps to be in a second position thereof, releasing said boot;

one or more sensors that sense one or more physical conditions during said snow sports;

a processor-based control system comprising a processor circuit configured and arranged to generate a control signal based at least on the received signals from the sensors, wherein said control signal causes the movement of said mechanical linkage so as to controllably move the opposing clamps from said first position to said second position of said clamps, thereby releasing said boot from said snow sport apparatus; and a linear actuator in mechanical communication with the mechanical linkage, the linear actuator having an extended state and a retracted state with respect to a first axis, wherein:

the mechanical linkage includes one or more motion converters that cause the opposing clamps to transition between said first position of said clamps and said second position of said clamps in response to a movement of the linear actuator, said first position of said clamps and said second position of said clamps are aligned along a second axis that is orthogonal to the first axis, and the linear actuator is in electrical communication with the processor circuit to receive the control signal.

2. The system of claim 1, further comprising a data communications link between said processor to said one or more sensors.

3. The system of claim 1, further comprising a data communications link between said processor and a data store that records data collected from said system.

4. The system of claim 1, wherein said one or more sensors sense one or more of: a user's body movement; an angle of a user's limbs; a position of a user's limbs; an acceleration.

5. The system of claim 4, said one or more sensors being disposed in or on a user's clothing including at a user's hip or at a user's leg.

6. The system of claim 1, said sensors and processor being configured and arranged to compute a predicted danger of injury to a user's anterior cruciate ligament (ACL) and to cause a release of said boot from said snow sports apparatus prior to said injury.

7. The system of claim 1, further comprising a user device in data communication with said processor, the user device providing an output indicative of a condition or setting of said system.

8. The system of claim 1, wherein the one or more motion converters include a first motion converter and a second motion converter, the first motion converter coupled to a first clamp, the second motion converter coupled to a second clamp.

9. The system of claim 8, wherein the first motion converter comprises a first cam and the second motion converter comprises a second cam.

10. The system of claim 8, wherein the mechanical linkage includes a coupler and first and second links, the first link coupled to the coupler and the first motion converter, the second link coupled to the coupler and the first motion converter.

11. The system of claim 8, wherein a plunger is coupled to the linear actuator and the mechanical linkage.

12. A method of operating a snow sports binding system that couples a boot worn by a user to a snow sport apparatus, comprising:

sensing one or more conditions, using one or more sensors coupled to the user, a user's clothing, or a snow sports apparatus;

communicating one or more signals from said one or more sensors to a processor;

determining in said processor whether an injury to the user is likely to occur based on a model accounting for one or more of: a user's orientation, speed, heading, acceleration, relative position of the user's hip, legs, or other measured sensor readings corresponding to said signals;

generating a control signal by said processor in response to a determined likelihood that an injury will occur to initiate a release of said boot from said snow sport apparatus;

extending a linear actuator, in response to said control signal, from a retracted state to an extended state with respect to a first axis to move a mechanical linkage in said snow sports binding system from a first position of the mechanical linkage to a second position of the mechanical linkage; and translating a motion of the mechanical linkage with one or more motion converters to cause a pair of opposing clamps to be moved from a first position of said clamps to a second position of said clamps, releasing said boot from said snow sports apparatus, wherein said first position of said clamps and said second position of said clamps are aligned along a second axis that is orthogonal to the first axis.

13. The method of claim 12, further comprising logging data relating to an operation of said sensors and processor in a data store coupled to said processor over a data communication link.

14. The method of claim 12, further comprising generating an output on a user device indicating a condition of said snow sport apparatus or processor.

15. The method of claim 12, determining whether an injury is likely to occur comprising determining whether an injury to a user's anterior cruciate ligament (ACL) is likely to occur as a result of sensed conditions during performance of the snow sport.

16. The method of claim 12, wherein the one or more motion converters include a first motion converter and a second motion converter, the first motion converter coupled to a first clamp, the second motion converter coupled to a second clamp.

17. The method of claim 16, wherein the first motion converter comprises a first cam and the second motion converter comprises a second cam.

18. The method of claim 16, wherein the mechanical linkage includes a coupler and first and second links, the first link coupled to the coupler and the first motion converter, the second link coupled to the coupler and the first motion converter.

19. The method of claim 16, wherein a plunger is coupled to the linear actuator and the mechanical linkage.

* * * * *